US008734239B2

(12) United States Patent
Kelly et al.

(10) Patent No.: US 8,734,239 B2
(45) **Date of Patent: *May 27, 2014**

(54) PROGRESSIVE GAME AND PROCESSING SYSTEM THEREOF

(71) Applicant: Bally Gaming, Inc., Las Vegas, NV (US)

(72) Inventors: Bryan M. Kelly, Alamo, CA (US); Dennis W. Lockard, Tracy, CA (US); Frank J. Silvestro, Tuckerton, NJ (US); Thomas P. Doyle, Reno, NV (US); Ronald C. Gallaway, Reno, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/728,923

(22) Filed: Dec. 27, 2012

(65) Prior Publication Data

US 2013/0165219 A1 Jun. 27, 2013

Related U.S. Application Data

(63) Continuation of application No. 11/208,198, filed on Aug. 19, 2005, now Pat. No. 8,353,761.

(51) Int. Cl.
*A63F 9/00* (2006.01)

(52) U.S. Cl.
USPC ..... 463/27

(58) Field of Classification Search
None
See application file for complete search history.

(56) References Cited

U.S. PATENT DOCUMENTS

| | | | | |
|---|---|---|---|---|
| 6,266,103 | B1 * | 7/2001 | Barton et al. | 348/675 |
| 6,435,968 | B1 | 8/2002 | Torango | |
| 6,471,591 | B1 * | 10/2002 | Crumby | 463/26 |
| 6,604,997 | B2 * | 8/2003 | Saidakovsky et al. | 463/9 |
| 6,629,177 | B1 * | 9/2003 | Chong | 710/240 |
| 2001/0036857 | A1 | 11/2001 | Mothwurf et al. | |
| 2002/0004424 | A1 * | 1/2002 | Nelson et al. | 463/42 |
| 2002/0042299 | A1 | 4/2002 | Soltys et al. | |
| 2002/0160825 | A1 | 10/2002 | Nicastro et al. | |
| 2003/0027625 | A1 * | 2/2003 | Rowe | 463/20 |
| 2003/0054877 | A1 | 3/2003 | Baerlocher | |
| 2003/0119586 | A1 * | 6/2003 | Crumby | 463/26 |
| 2003/0209853 | A1 * | 11/2003 | Harris | 273/139 |
| 2004/0038741 | A1 | 2/2004 | Gauselmann | |
| 2004/0043810 | A1 * | 3/2004 | Perlin et al. | 463/16 |
| 2004/0102238 | A1 | 5/2004 | Taylor | |

(Continued)

FOREIGN PATENT DOCUMENTS

DE 202005005719 7/2005

*Primary Examiner* — Seng H Lim
(74) *Attorney, Agent, or Firm* — Brooke Quist; Marvin Hein

(57) ABSTRACT

A progressive game is implemented on a gaming system, wherein the gaming system includes one or more gaming machines connected to a game server, and wherein the progressive game has a progressive prize value that increases according to a progressive prize growth rate. The progressive game includes a selectable targeted progressive prize value, a selectable targeted progressive prize time, and one or more enticement factors. The progressive prize growth rate is calculated using the selectable targeted progressive prize value, the selectable targeted progressive prize time, and the one or more enticement factors. The selectable targeted progressive prize time is used to calculate the predetermined time period for testing for a progressive prize win. If a progressive prize win has not been identified, the progressive prize value is incremented by the progressive prize growth rate. If a progressive prize win has been identified, one or more winners are determined.

104 Claims, 25 Drawing Sheets

(56) References Cited

U.S. PATENT DOCUMENTS

| | | | | |
|---|---|---|---|---|
| 2004/0166918 | A1 | 8/2004 | Walker et al. | |
| 2005/0037837 | A1* | 2/2005 | Rowe | 463/25 |
| 2005/0215314 | A1* | 9/2005 | Schneider et al. | 463/26 |
| 2005/0288081 | A1 | 12/2005 | Amaitis et al. | |
| 2006/0030399 | A1* | 2/2006 | Baerlocher | 463/20 |
| 2006/0183538 | A1* | 8/2006 | Michaelson et al. | 463/27 |
| 2007/0060320 | A1 | 3/2007 | Kelly et al. | |
| 2007/0167210 | A1 | 7/2007 | Kelly et al. | |
| 2007/0167226 | A1 | 7/2007 | Kelly et al. | |
| 2007/0259709 | A1 | 11/2007 | Kelly et al. | |
| 2008/0254883 | A1 | 10/2008 | Patel et al. | |
| 2008/0254893 | A1 | 10/2008 | Patel et al. | |
| 2008/0305864 | A1 | 12/2008 | Kelly et al. | |
| 2008/0305865 | A1 | 12/2008 | Kelly et al. | |
| 2008/0305866 | A1 | 12/2008 | Kelly et al. | |
| 2009/0088244 | A1 | 4/2009 | Nicely et al. | |

* cited by examiner

170

View Progressive

| Link Name | Prog. Id | Reset Value | Curr. Value | Desired Size | Desired Time | Start Date | Elapsed Time | More Details |
|---|---|---|---|---|---|---|---|---|
| | | | | | | | | |
| | | | | | | | | |
| | | | | | | | | |

170

Progressive Details

Link Name ABCD 15 minutes wiggle factor (Rank-47.5)/200 ON OFF 1 minute wiggle factor Random (xx-aa)/10000 ON OFF Accrual Type Front End

170

PPE Win Report

Start Date 01/01/2005 End Date 01/31/2005

| Link ID | Link Name | Win Date | Winning Amount |
|---|---|---|---|
| | | | |
| | | | |
| | | | |

Summary for this Period

#of Win 10
Total Win Amount $$$$.$$

FIG. 3C

FIG. 3D
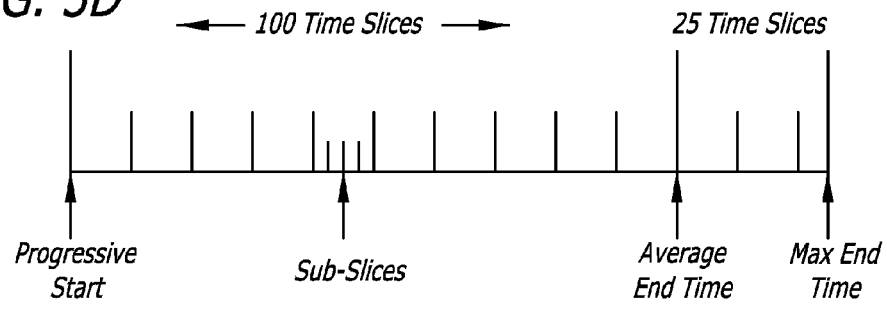
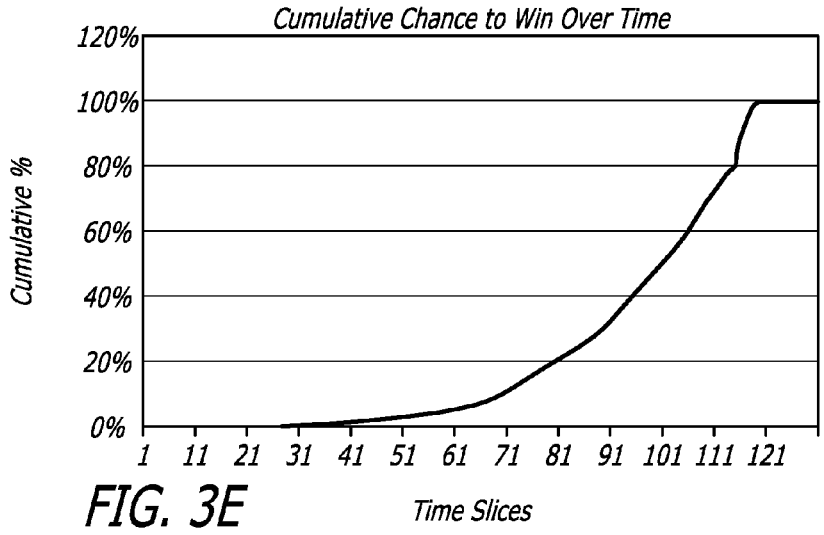
FIG. 3E
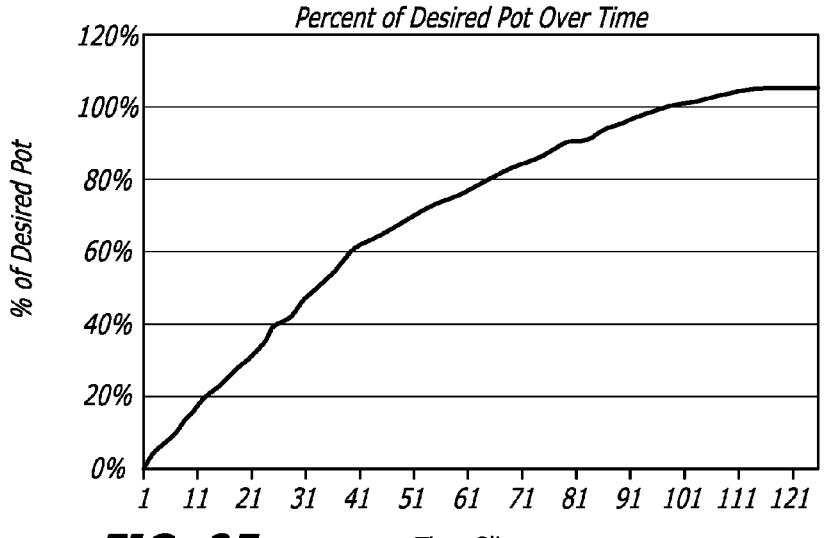
FIG. 3F

Master Table Current Value-12:14 AM

| Row | Time | Active Carded Players |
|---|---|---|
| 1 | 12:00 AM | 25 |
| 2 | 12:15 AM | 22 |
| 3 | 12:30 AM | 18 |
| 4 | 12:45 AM | 15 |
| 5 | 1:00 AM | 12 |
| ... | ... | ... |
| 94 | 11:15 PM | 43 |
| 95 | 11:30 PM | 38 |
| 96 | 11:45 PM | 28 |

Master Table New Value-12:15 AM

| Row | Time | Active Carded Players |
|---|---|---|
| 1 | 12:00 AM | 25 |
| 2 | **12:15 AM** | **26** |
| 3 | 12:30 AM | 18 |
| 4 | 12:45 AM | 15 |
| 5 | 1:00 AM | 12 |
| ... | ... | ... |
| 94 | 11:15 PM | 43 |
| 95 | 11:30 PM | 38 |
| 96 | 11:45 PM | 28 |

Sorted Table (after 12:15 AM Interval updated)

| Row | Time | Active Carded Players |
|---|---|---|
| 1 | 1:00 AM | 12 |
| 2 | 12:45 AM | 15 |
| 3 | 12:30 AM | 18 |
| 4 | 12:00 AM | 25 |
| ... | ... | ... |
| **87** | **12:15 AM** | **26** |
| ... | ... | ... |
| 95 | 11:30 PM | 38 |
| 96 | 11:15 PM | 43 |

FIG. 5

Choose a type of game
$7.50
1) Sports book
2) Video Reel Games
3) Poker Games
4) Other Card games
5) Tournaments
6) Raffles
7) Sweepstakes
8) Bingo Games
9) Skill Games
10) More eGameCash

| | |
|---|---|
| Bonus Points | 23,768 |
| Base Game Cash | $20.25 |
| eCash | $5.00 |
| PrizePoints | 102,304pp |

75

System Game Winnings: $0.00

View/Manage your account

180

Game Setup -Bingo Mania (min cost $.25)

| | |
|---|---|
| Change Denomination ($.01,.05,.10,.25,.50,$1.00) | Current Value |
| AutoPlay/Normal Mode | .25 |
| Play for Points | Auto |
| Play for eGameCash | No |
| # of Credits | Yes |
| View Bingo Mania Rules | 3 |

Modify

Cancel

Play Game

182

John Doe Account

| | |
|---|---|
| eGameCash(cashable) | $2.50 |
| eGameCash(un-cashable) | $5.00 |
| Bonus Points(cashable) | 23,768 |
| PrizePoints | 102,304pp |
| eCash | $5.00 |
| Base Game Cash | $20.25 |

Purchase eGameCash

Transfer to/ from accounts

DONE

View Account history

Set up preferences

Messaging-Prompt area

184

FIG. 6

186 eGameCash Purchase

Your eGameCash=$0.00 Your Bonus Points(17898) Your eCash ($5.00) Your Base Game Cash ($25.25)

Please choose
1) Transfer Base game credits to your eGameCash account ($1.00=$1.00eGameCash)
2) Purchase eGameCash with Bonus Points ($1.00 eGameCash=100 Bonus Points)
3) Transfer from eCash account ($1.00 eGameCash=$1.00 eCash
4) Convert Prize Points to eGameCash ($1.00 eGameCash=850 Prize Points)
5) Banking Transfer
6) 3rd party transfer Select Back

188

John Doe's Account Activity Detail Page Trans ID 16981

Description: You advance to level 2 player & win 50 raffle tickets to yearly raffle.
Tourn ID=8836892. Tourn Start Time: 6/8/05 6:15am Tourn Close Time: 6/9/04 6:15am
Type: Daily Tournment

| Date | # | Player Name | Score | Prize |
|---|---|---|---|---|
| 6/8/05 6:15am | #1 | Bob L | 187,984 | $5.00 eGameCash |
| 6/9/05 6:00am | #2 | You | 182,111 | Advance to level 2 + 50 raffle tickets to raffle ID 187. |
| 6/9/05 6:01am | #3 | Wait | 177,838 | - |
| 6/9/05 6:04am | #4 | Warren | 172,111 | - |

...
...

More Prev

Back

188

John Doe's Account Activity

| Trans ID | Date | TYPE | Description |
|---|---|---|---|
| 11363 | 6/7/04 3:30pm | Raffle Win | $25 raffle won |
| 11981 | 6/7/04 3:31pm | Game Win | $1.25 eGame Cash won on Blazing 7's |
| 16981 | 6/9/04 6:15am | Tourn Win | You advance to level 2 |
| 16997 | 6/9/04 6:16am | Transfer | $50.00 eGameCash to base game Credits |
| 17981 | 6/9/04 6:20pm | Sweepstacks | 50 tickets purchased for Sweep ID 587 |
| 18941 | 6/9/04 6:40pm | 3rd Party Game | $5 transfer to Keno-online.com |

More Previous Search/Sort Show Detail

Back

FIG. 7

190

Game Selection

| | | |
|---|---|---|
| Poker 50¢ | Black Jack 50¢ | Bingo |
| Keno | Poker $1 | Black Jack $1 |
| Cancel/Back | | More... |

192

Game Setup -Bingo Mania (min cost $.25) (1 cent per ball)

| | Current Value | |
|---|---|---|
| Change Denomination ($.01,.05,.10,.25,.50,$1.00) | .25 | modify |
| AutoPlay/Normal Mode | Auto | modify |
| Play for Points | No | modify |
| Play for eGameCash | Yes | modify |
| # of Credits | 3 | modify |
| View Bingo Mania Rules | | |
| Fast Play/Slow Play | Fast | modify |

Cancel Play Game

194

John Doe Account

DONE

| | |
|---|---|
| eGameCash(cashable) | $2.50 |
| eGameCash(un-cashable) | $5.00 |
| Bonus Points(cashable) | 23,768 |
| PrizePoints | 102,304pp |
| eCash | $5.00 |
| Base Game Cash | $20.25 |

| | | |
|---|---|---|
| Get eGameCash | Cashout eGameCash | Convert Points to Base game credits |
| View Account history | Set up preferences | |

Messaging-Prompt area

FIG. 8

196

Mounds of Money

Just by playing this Slot machine you can also win large cash progressives in addition to your other Bonus System Games winnings

| | |
|---|---|
| Super Progressive: | $123,052.11 |
| Weekly Progressive: | $ 7,988.23 |
| Daily Progressive: | $ 1,134.98 |

Winners will be chosen at surprise time, and you can be one of them. So hurry up and get playing.

198

Mounds of Money Winner!

YOU JUST WON a surprise progressive Bonus Jackpot

Amount: $1,155.91

Touch here to collect your winnings.

FIG. 9

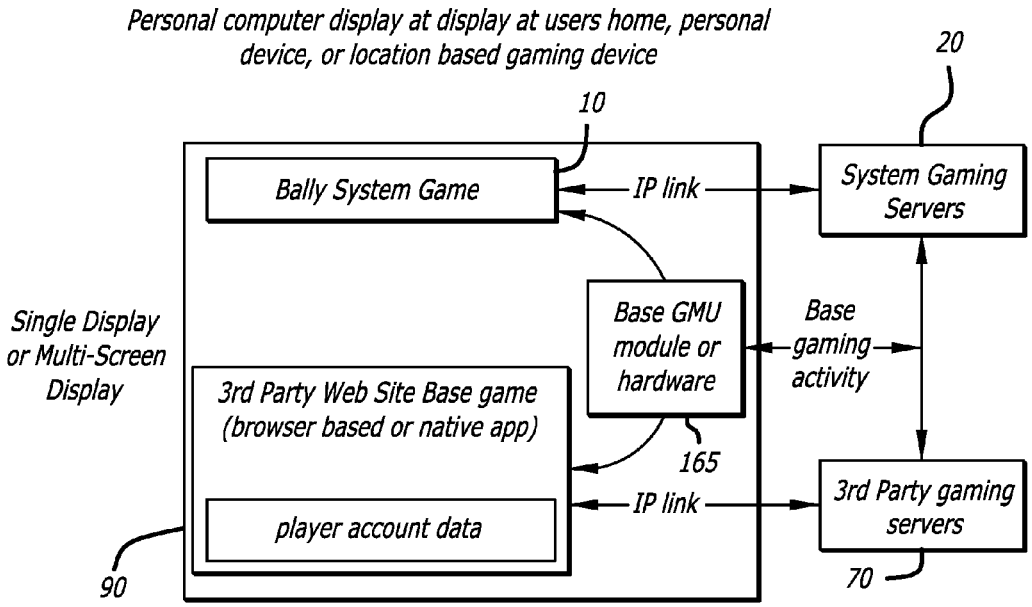

| Card# | eGameCash (uncashable) | eGameCash (cashable) | eGameCash (player funded) | eGameCash (cashable) |
|---|---|---|---|---|
| 132 | $01.1200 | $00.0000 | $00.0000 | 150,000 |
| 384 | $23.2300 | $10.1000 | $00.0000 | 123,013 |
| 892 | $15.0000 | $01.5000 | $00.0000 | 15,001 |
| 126 | $00.0000 | $00.0000 | $00.0000 | 0 |
| .. | .. | .. | .. | .. |
| .. | .. | .. | .. | .. |
| . | . | . | . | . |

PROGRESSIVE GAME AND PROCESSING SYSTEM THEREOF

CROSS-REFERENCE TO RELATED APPLICATION

This application is a continuation of U.S. patent application Ser. No. 11/208,198, filed Aug. 19, 2005, which is herein incorporated by reference in its entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD OF TECHNOLOGY

This disclosure relates generally to a gaming system that incorporates a progressive game, and more particularly, to a gaming system that incorporates a customizable, time-based progressive game.

BACKGROUND

Traditionally, gaming machines have been designed for gaming purposes only. In this regard, gaming machines have been constructed only to include gaming functionality. Recently, however, casino owners have become aware that by adding additional features to gaming machines, they may be able to maintain a player's attention to the gaming machines for longer periods of time. This, in turn, leads to the player wagering at the gaming machine for longer periods of time, thereby increasing casino profits.

One technique that has been employed to maintain a player's attention at the gaming machine has been to provide players with access to gambling-related information. By attaching a small electronic display to the gaming device, gambling-related information, as well as news and advertisements can be sent to the player. The gambling-related information may include, for example, information on sports betting and betting options for those sporting events. Additionally, the gambling-related information may also include information such as horse racing and off-track betting. News and advertisements can also maintain a player's attention by providing the player with access to information ranging from show times, to restaurant and hotel specials, and to world events, thus reducing the need and/or desire for the player to leave the gaming machine.

Moreover, it would be desirable to provide the player with interactive access to the above information. This type of interactivity would allow players significantly more flexibility to make use of the above-described information. The gambling-related information could also be utilized by the player in a much more efficient manner. In this regard, greater levels of flexibility and access are likely to make a player remain and gamble at the gaming machine for significantly longer periods of time. Unfortunately, the system components that are currently utilized for displaying and accessing this type of information, such as external keypads and display modules, are extremely limited in the functionality and capabilities that they provide, thus limiting the success of their ability to maintain a player's attention.

In addition to displaying gambling-related information, it would also be desirable for an electronic display that was attached to the gaming device to be capable of utilizing other techniques for creating player interest and competitiveness as a method for increase game play on the gaming device. Competition can be a powerful incentive for increased game play. As such, it is desirable to engage players and potential players with the opportunity for additional competition in order to extend playing time on the related gaming devices.

As stated above, attempts to distribute gambling-related information and advertisements to players, has typically required additional system components to be attached to the gaming devices separately and apart from the construction of the gaming machine itself. Specifically, these components for accessing and displaying information from gaming machines have been extremely limited in their usefulness because of the lack of capabilities inherent in these components. Such components have generally included a keypad, card reader, and display equipment, such as a 2-line LED display. It would be desirable for these components to be integrated into the gaming device itself, in a more unified fashion to provide substantially greater functionality than that which has been previously available.

Accordingly, those skilled in the art have long recognized the need for a system that is capable of integrating expanded service and systems capabilities with the more traditional function of a gaming device. The disclosed embodiments clearly address these and other needs.

SUMMARY

One embodiment discloses a non-transitory storage medium having stored thereon a progressive game program to implement a progressive game on a gaming system, wherein the gaming system includes one or more gaming machines connected to a server, and wherein the progressive game has a progressive prize with a progressive prize value that increases according to a progressive prize growth rate. The progressive game program, upon execution on the gaming system provides execution of the progressive game, includes: a selectable targeted progressive prize value; a selectable targeted progressive prize time which is a theoretical average time when the progressive prize is awarded; an erratic movement enticement factor, wherein the erratic movement enticement factor contributes erratic motion to the progressive prize growth rate that causes the progressive growth rate to erratically move in a +/−5% range, wherein the progressive prize growth rate is determined using the selectable targeted progressive prize value, the selectable targeted progressive prize time, and the erratic movement enticement factor; wherein if a progressive prize win has not been identified, the progressive prize value is incremented by the progressive prize growth rate; and wherein if a progressive prize win has been identified, one or more winners of the progressive prize are determined.

In one aspect of a preferred embodiment, the progressive prize growth rate is determined by referencing a table of values. In another aspect of a preferred embodiment, the progressive prize growth rate is determined by referencing a formula. In yet another aspect of the preferred embodiment, the one or more winners of the progressive prize are determined using a random number generation algorithm. In still another aspect of the preferred embodiment, the one or more winners of the progressive prize are determined using predetermined selection criteria.

In another embodiment, the one or more enticement factors of the progressive game include a player activity enticement factor, a number of eligible players enticement factor, an erratic movement enticement factor, and a casino revenue factor. The player activity enticement factor partially associates player floor activity to the progressive prize growth rate. The number of eligible players enticement factor associates the number of eligible players on a gaming floor to the progressive prize growth rate. The erratic movement enticement factor contributes randomized motion to the progressive prize growth rate. The casino revenue factor enables self-tuning of the progressive game to facilitate achieving a desired casino profitability level.

In one preferred embodiment, the enticement factor is derived from third party revenue data. In one aspect of an embodiment, the progressive prize is funded from non-wagered funds. Preferably, the non-wagered funds include funds designed to correlate with data. The data may be relating to, by way of example only, and not by way of limitation, the number of eligible participants, loss data from related base games, coin out data from related base games, and other statistical data from related base games. It may further include, by way of example only, and not by way of limitation, data derived from related base game data, data derived from combinations of related base game data, and data derived from mathematical manipulations of related base game data. The non-wagered funds may originate from marketing funds or from promotions department funds. The progressive prize may be available to all players having a player tracking card inserted into a gaming machine that is part of the gaming system, or available to all players playing at a gaming machine that fulfills predetermined selection criteria. The progressive prize may be awarded randomly to one or more players having a player tracking card inserted into a gaming machine that is part of the gaming system or can be awarded from the beginning of the progressive game.

In one aspect of the embodiment, the progressive game requires no player interaction during the progressive game. In another aspect of the embodiment, the progressive prize is available to all players that are dynamically grouped in accordance with any identifiable gaming machine parameter. In yet another aspect of the embodiment, the progressive game is displayed on a user interface that is additional to a primary game presentation of a gaming machine in the gaming system. In accordance with one aspect of a preferred embodiment, the progressive game is operatively associated with a player-tracking device. In one embodiment, the progressive game is player-selected from a plurality of eligible progressive games. In another aspect of the preferred embodiment, a carded player is eligible to win a progressive prize, even if the carded player is not present when the progressive prize is given, by meeting predetermined eligibility criteria.

In one aspect of the preferred embodiment, the payout curve is displayed to a casino administrator, and the progressive prize value is plotted against the progressive prize time. In a further aspect of the preferred embodiment, the payout curve includes points along the payout curve and an alterable shape. The points along the payout curve are selectable and dragable by a game administrator to modify the shape of the payout curve, thereby correspondingly altering intersection points of the progressive prize value with the progressive prize time along the payout curve. Preferably, a graphical user interface enables a game administrator to modify the shape of the payout curve, by selecting and dragging points along the payout curve to modify the shape of the payout curve. In one aspect of the embodiment, the payout curve is plotted using data points that are manually entered from an administration. In another aspect of the embodiment, the payout curve is modifiable during the progressive game. In yet another aspect of the embodiment, the payout curve for the progressive prize is a non-linear growth curve. In still another aspect of the embodiment, the payout curve is a front-loaded payout curve.

Still another embodiment is directed towards a progressive gaming method implemented on a gaming system, wherein the gaming system includes one of more gaming machines connected to a server, and wherein the progressive gaming method has a progressive prize with a progressive prize value that increases according to a progressive prize growth rate until a winning time period occurs. The progressive gaming method includes: receiving a selectable targeted progressive prize value; receiving a selectable targeted progressive prize time which is a theoretical average time when the progressive prize is awarded; calculating the progressive prize growth rate using the selectable targeted progressive prize value, the selectable targeted progressive prize time, and an erratic movement enticement factor, wherein the erratic movement enticement factor contributes erratic motion to the progressive prize growth rate that causes the progressive growth rate to erratically move in a +/−5% range, and wherein the progressive prize growth rate is funded from non-wagered funds; determining if there is a progressive prize win at each calculated time period, wherein the selectable targeted progressive prize time is used to calculate the time period for testing for a progressive prize win; if a progressive prize win has not been identified, incrementing the progressive prize value by the progressive prize growth rate; and if a progressive prize win has been identified, determining one or more winners of the progressive prize.

In one aspect of a preferred method, the progressive prize is partitioned between a plurality of winning players. In another aspect of an embodiment, the entire progressive prize value is given to all eligible winning players. In a further embodiment, a first randomly chosen winner receives the entire progressive prize value, and secondary winners receive a portion of the progressive prize value.

In one aspect of a preferred embodiment, the progressive prize growth rate is calculated from a formula using the selectable targeted progressive prize value, the selectable targeted progressive prize time, and the one or more enticement factors. Another aspect is directed towards calculating the progressive prize growth rate from a table and interpolating the growth rate using the selectable targeted progressive prize value, the selectable targeted progressive prize time, and the one or more enticement factors.

In one aspect of the embodiment, the one or more winners of the progressive prize is determined by activating a random number generation algorithm. In yet another aspect of the embodiment, the one or more enticement factors are selected from a group consisting of: a player activity enticement factor, a number of eligible players enticement factor, and an erratic movement enticement factor. Preferably, the player activity enticement factor partially associates player floor activity to the progressive prize growth rate, wherein the number of eligible players enticement factor associates the number of eligible players on a gaming floor to the progressive prize growth rate, and wherein the erratic movement enticement factor contributes randomized motion to the progressive prize growth rate. In a further aspect of the embodiment, the progressive prize is funded from non-wagered funds.

In one aspect of the preferred embodiment, the non-wagered funds include, by way of example only, and not by way of limitation, funds designed to correlate with data relating to the number of eligible participants; loss data from related base games; coin out data from related base games; other statistical data from related base games; and data derived from related base game data; data derived from combinations of related base game data; and data derived from mathematical manipulations of related base game data.

In a further aspect of the preferred method, the progressive prize is available to all players having a player tracking card inserted into a gaming machine that is part of the gaming system. The progressive prize is awarded randomly to one or more identified eligible players.

In another aspect of the preferred method, the identified eligible players include, by way of example only, and not by way of limitation, players having a player tracking card inserted into a gaming machine that is a part of the gaming system, and players that are logged on to the gaming system. Further, players that are logged on to the gaming system include players with username and password accounts, players with player card accounts, and players with other identifier accounts.

In one preferred embodiment, the progressive prize can be awarded at the beginning of the progressive gaming method. In another preferred embodiment, the progressive gaming method requires no player interaction during the progressive gaming method. In yet another preferred embodiment, the progressive prize is available to all players that are dynamically grouped in accordance with any identifiable gaming machine parameter. In still another preferred embodiment, the progressive gaming method is displayed on a user interface that is additional to a primary game presentation of a gaming machine in the gaming system. In a further preferred embodiment, the progressive gaming method is displayed on any user interface of a gaming machine in the gaming system. In an alternate preferred embodiment, the progressive gaming method is player-selected from a plurality of eligible progressive gaming methods. In yet another preferred embodiment, a payout curve is displayed to a casino administrator, and wherein the payout curve is the progressive prize value plotted against the progressive prize time.

In a further embodiment of the progressive gaming method, the payout curve includes points along the payout curve and an alterable shape, and points along the payout curve are selectable and dragable by a game administrator to modify the shape of the payout curve, thereby correspondingly altering intersection points of the progressive prize value with progressive prize time along the payout curve. Preferably, a graphical user interface enables a game administrator to modify the shape of the payout curve, by selecting and dragging points along the payout curve to modify the shape of the payout curve. In a further embodiment, the payout curve is modifiable during the progressive game. In another embodiment, the payout curve for the progressive prize is a non-linear growth curve. In yet another embodiment, the payout curve is a front-loaded payout curve.

Still another embodiment is directed towards a method of providing a progressive prize by funding a progressive prize using non-gaming funds, processing progressive prize information, and randomly awarding the progressive prize. The non-gaming funds include funds that are unrelated to base game activity on a gaming floor. The progressive prize is randomly awarded to at least one eligible person within a specified time period wherein a targeted progressive prize value and a targeted progressive prize time are configured by an administrator.

In a further embodiment, the targeted progressive prize value and the targeted progressive prize time are selected by an administrator before the processing of the progressive prize information. In another aspect of the preferred embodiment, the progressive prize has a lower cumulative probability of being awarded early in the time period and increases to a higher cumulative probability of being awarded later in the time period. In yet another aspect of the preferred embodiment, the targeted progressive prize value and the targeted progressive prize time are adjustable during the processing of the progressive prize information. Preferably, the funding of the progressive prize using non-wagered funds includes, by way of example only, and not by way of limitation, funding the progressive prize using funds from non-gaming related companies, non-gaming related activities, or government agencies. Further, the non-gaming companies include, by way of example only, and not by way of limitation, gas stations, toll stations, bus stations, subway stations, restaurants, grocery stores, automobile dealerships, banks, merchandise stores, airlines, hotels, financial institutions, malls, web businesses, movie theaters, bowling alleys, and professional and college sports organizations.

Still another embodiment is directed towards a method of awarding a progressive prize by funding a progressive prize using non-wagered funds; obtaining a targeted progressive prize amount to be awarded and a targeted time in which the progressive prize is to be awarded; processing progressive prize information; determining if a progressive prize event has occurred at successive time intervals; incrementing the progressive prize value by a progressive prize value growth rate that is calculated using the targeted progressive prize amount to be awarded and the targeted time in which the progressive prize is to be awarded; and in response to a progressive prize event occurring, determining at least one winning person and providing the progressive prize to the winning person.

In one preferred embodiment, the determination of the winning player for the progressive prize occurs randomly. In another preferred embodiment, the determination of the winning player for the progressive prize utilizes pre-determined selection criteria. In yet another preferred embodiment, the non-wagered funds include, by way of example only, and not by way of limitation, funds designed to correlate with data relating to the number of eligible participants, loss data from related base games, coin out data from related base games, other statistical data from related base games, and data derived from related base game data, data derived from combinations of related base game data, and data derived from mathematical manipulations of related base game data.

In one aspect of the embodiment, the time intervals are calculated before the processing of the progressive prize information using the targeted progressive prize amount to be awarded and the targeted time in which the progressive prize is to be awarded. In another aspect of the embodiment, the time intervals are calculated during the processing of the progressive prize information using the targeted progressive prize amount to be awarded and the targeted time in which the progressive prize is to be awarded.

In one preferred embodiment, the method of awarding the progressive prize is self-tunable to a desired casino profitability level by adjusting the targeted progressive prize amount to be awarded and the targeted time in which the progressive prize is to be awarded, during the processing of the progressive prize information. In another preferred embodiment, the method of awarding the progressive prize is automatically reoccurring after each progressive prize is awarded. In yet another preferred embodiment, the method of awarding the progressive prize includes inserting a delay between the restarting of each automatically reoccurring progressive prize. In still another preferred embodiment, the method of awarding the progressive prize includes resetting the progressive prize at a reset level after a progressive prize has been awarded.

Still another embodiment is directed towards a method of awarding a progressive prize by funding a progressive prize using non-wagered funds; obtaining a targeted progressive prize amount to be awarded and a targeted time in which the progressive prize is to be awarded; determining if a progressive prize event has occurred at successive time intervals; incrementing the progressive prize value by a progressive prize value growth rate that is calculated using the targeted progressive prize amount to be awarded and the targeted time in which the progressive prize is to be awarded; self-tuning progressive prize parameters to achieve a desired casino profitability level by adjusting the targeted progressive prize amount to be awarded and the targeted time in which the progressive prize is to be awarded; and in response to a progressive prize event occurring, determining at least one winning person and providing the progressive prize to the winning person.

Yet another embodiment is directed towards a method of awarding a progressive prize by funding a prize using non-wagered funds; obtaining a targeted progressive prize amount to be awarded; obtaining a targeted time in which the progressive prize is to be awarded; calculating time-slice values from the targeted time in which the progressive prize is to be awarded; calculating time sub-slice values from the time-slice values; determining if a progressive prize event has occurred during each time sub-slice interval; if the award event has not occurred; incrementing the progressive prize value using the targeted progressive prize amount to be awarded and the targeted time in which the progressive prize is to be awarded; and if the award event has occurred, randomly determining a winning player and providing the progressive prize to the winning player.

Another embodiment is directed towards a progressive prize gaming system that includes, by way of example only, and not by way of limitation, means for funding a progressive prize with non-gaming funds, wherein non-gaming funds comprise funds that are unrelated to base game activity on a gaming floor; means for processing progressive prize information; and means for randomly awarding the progressive prize to at least one eligible player.

In one preferred embodiment, funding the progressive prize includes using funds from non-gaming related companies or non-gaming related activities. In another preferred embodiment, the non-gaming companies include, by way of example only, and not by way of limitation, gas stations, toll stations, bus stations, subway stations, restaurants, grocery stores, automobile dealerships, banks, merchandise stores, airlines, hotels, financial institutions, malls, web businesses, movie theaters, bowling alleys, and professional and college sports organizations. In yet another preferred embodiment, the method of awarding a progressive prize is self-tunable to a desired casino profitability level by adjusting the targeted progressive prize amount to be awarded and the targeted time in which the progressive prize is to be awarded, during the processing of the progressive prize information. In still another preferred embodiment, the non-wagered funds include, by way of example only, and not by way of limitation, funds designed to correlate with data selected from the group including data relating to the number of eligible participants, loss data from base game, coin out data from base game, other statistical data from base game, and data derived from base game data.

Still another embodiment is directed towards a progressive game implemented on a gaming system, wherein the gaming system includes one or more gaming machines connected to a processing system, and wherein the progressive game has a progressive prize value that increases according to a progressive prize growth rate. The progressive game includes a selectable targeted progressive prize value, a selectable targeted progressive prize time, and a random number generation algorithm.

The selectable targeted progressive prize value is modifiable by an administrator. The selectable targeted progressive prize time is modifiable by the administrator, and wherein the progressive prize growth rate is calculated using the selectable targeted progressive prize value and the selectable targeted progressive prize time. The random number generation algorithm tests to determine if there is a progressive prize win at each successive time period, and the selectable targeted progressive prize time is used to calculate the time period for testing for a progressive prize win. The progressive prize value is incremented by the progressive prize growth rate. If a progressive prize win has been identified, one or more winners of the progressive prize are determined.

In one aspect of a preferred embodiment, winning the progressive prize triggers additional events or promotions. In another aspect of a preferred embodiment, the progressive prize growth rate is determined by referencing a table of values. In yet another aspect of a preferred embodiment, the one or more winners of the progressive prize are determined using a random number generation algorithm or a predetermined selection criteria. In still another aspect of a preferred embodiment, the time period, which is successively used to determine if a progressive prize has been won, is manually entered by a casino administrator. In an alternate aspect of a preferred embodiment, the incremental progressive rate is successively incremented using a different time period than the time period used to test if there is a progressive prize win.

Still another embodiment is directed towards a progressive gaming method implemented on a gaming system, wherein the gaming system includes one of more gaming machines connected to a processing system, and wherein the progressive gaming method has a progressive prize value that increases according to a progressive prize growth rate. The progressive gaming method includes receiving a selectable targeted progressive prize value, wherein the targeted progressive prize value is modifiable by an administrator; receiving a selectable targeted progressive prize time, wherein the targeted progressive prize time is modifiable by the administrator; calculating the progressive prize growth rate using the selectable targeted progressive prize value and the selectable targeted progressive prize time; in response to player eligibility to play the progressive gaming method, activating an algorithm to test and determine if there is a progressive prize win at each calculated time period, wherein the selectable targeted progressive prize time is used to calculate the time period for testing for the progressive prize win; incrementing the progressive prize value by the progressive prize growth rate if the progressive prize win has not been identified; determining one or more winners of the progressive prize if the progressive prize win has been identified; and awarding the progressive prize to the one or more winners.

In one aspect of a preferred embodiment, winning the progressive prize triggers additional events or promotions. In another aspect of a preferred embodiment, determining one or more winners of the progressive prize includes activating a random number generation algorithm to determine one or more winners of the progressive prize.

In a further aspect of the preferred method, the award process includes payment techniques selected from hand-paying a winner; using EFT to transfer the award to a base game upon a player selecting to redeem the award at the base game; using AFT to transfer the award to a base game upon a player selecting to redeem the award at the base game (as shown in FIG. 2B); sending the award to a player account bucket; enabling the award to be collected at a cashier cage; mailing the award to the winner; placing the award in the player's private banking account; and placing the award as a credit on the player's credit card, debit card, player club account, or other financial account. In another aspect of the preferred embodiment, the awarding the progressive prize is performed automatically without requiring player interaction.

Still another embodiment is directed towards a progressive processing system that provides an opportunity to win a progressive prize, wherein the system has a progressive prize value that increases according to a progressive prize growth rate. The progressive processing system includes a selectable targeted progressive prize value, wherein the targeted progressive prize value is modifiable by an administrator; a selectable targeted progressive prize time, wherein the targeted progressive prize time is modifiable by an administrator, and wherein the progressive prize growth rate is calculated using the selectable targeted progressive prize value and the selectable targeted progressive prize time; and an algorithm that tests to determine if there is a progressive prize win at each successive time period, and wherein the selectable targeted progressive prize time is used to calculate the time period used to test for a progressive prize win. The progressive prize value is incremented by the progressive prize growth rate. If a progressive prize win has been identified, one or more winners of the progressive prize are determined.

In one aspect of a preferred embodiment, the progressive processing system provides an opportunity to win a non-gaming promotional award. In another aspect of a preferred embodiment, the opportunity to win the non-gaming promotional award is presented at a business including, by way of example only, and not by way of limitation, gas station chains, toll stations, bus stations, subway stations, restaurants, grocery stores, Internet-based web businesses, and other businesses. In yet another aspect of a preferred embodiment, the progressive processing system comprises a system that provides opportunities to win multiple, overlapping, promotional awards. In another aspect of a preferred embodiment, the opportunities to win multiple, overlapping, promotional awards are assigned by groups of games, groups of machines, groups of players, or combinations thereof.

Another aspect of a preferred embodiment, overhead video displays show data including, by way of example only, and not by way of limitation: current progressive values, targeted progressive size, targeted win time, start time, actual winners, information revealing that a progressive prize is about to be given, player qualification rules, or combinations thereof. In an alternate aspect of a preferred embodiment, the overhead video displays comprise plasma displays, liquid crystal displays, cathode ray tube displays, or digital light processing displays. In another alternate aspect of a preferred embodiment, the algorithm that tests to determine if there is a progressive prize win is configured to prevent a progressive prize win during certain time periods. Preferably, the opportunity to win a progressive prize can be turned off by an administrator at any time. Another aspect of a preferred embodiment further includes a progressive identifier that enables the opportunity to win a progressive prize to be activated from a remote server. In yet another aspect of a preferred embodiment, the progressive identifier is created using required data that is supplied through XML messaging or by using a management screen.

In one preferred embodiment, the setup data for the progressive identifier includes all or some of the following data including, by way of example only, and not by way of limitation: desired progressive value data, desired progressive win time data, progressive reset value data, maximum progressive value data, desired start time of the progressive data, whether the progressive auto-restarts after a win, how many times the progressive repeats, whether any enticement factors are utilized, and progressive payout curve data. In another preferred embodiment, additional data for the progressive identifier is selected from the group including, by way of example only, and not by way of limitation, maximum progressive prize value data, desired start time of the progressive data, selectable progressive auto-restarts after a win, selectable number of progressive repeats, enticement factors data, and progressive payout curve data.

In one aspect of a preferred embodiment, the progressive processing system provides an automatically recurring opportunity to win a progressive prize. In another aspect of a preferred embodiment, the progressive processing system comprises a system that provides an opportunity to randomly win a promotional award at any time an eligible person is at a gaming machine.

In one preferred embodiment, the one or more winners of the progressive prize receive the award by having the award reverse mapped into a specific winning combination on each game machine at which the one or more winners are playing; thereby creating a player perception that the specific winning combination on each gaming machine caused presentation of the progressive prize. In another preferred embodiment, the specific winning combination includes, by way of example only, and not by way of limitation: a royal flush, four-of-a-kind, full house, flush in a video poker game, a blackjack in video blackjack game, a multiple jackpot symbols in a reel spinner game, a marked bingo card, and a marked keno card. Preferably, a base game or system game (e.g., an iVIEW game, or the like) is instructed to go into a bonus round in which the progressive prize is awardable.

Still another embodiment is directed towards a progressive processing method for providing an opportunity to win a progressive prize, wherein the progressive gaming method has a progressive prize value that increases according to a progressive prize growth rate. The progressive processing method includes receiving a selectable targeted progressive prize value, wherein the targeted progressive prize value is a modifiable by an administrator; receiving a selectable targeted progressive prize time, wherein the targeted progressive prize time is modifiable by an administrator; calculating the progressive prize growth rate using the selectable targeted progressive prize value and the selectable targeted progressive prize time; activating an algorithm that tests to determine if there is a progressive prize win at each calculated time period, wherein the selectable targeted progressive prize time is used to calculate the time period for testing for a progressive prize win; incrementing the progressive prize value by the progressive prize growth rate if a progressive prize win has not been identified; determining one or more winners of the progressive prize if a progressive prize win has been identified; and awarding the progressive prize to the one or more winners.

In one aspect of a preferred embodiment, the progressive processing method is automatically restarted after a progressive prize is awarded. In another aspect of a preferred embodiment, a time delay is inserted between the automatic restarting of the progressive processing method. In yet another aspect of a preferred embodiment the progressive processing method comprises a method for providing an opportunity to win a non-gaming promotional award. In still another aspect of a preferred embodiment the opportunity to win the non-gaming promotional award is presented at a business that is selected from a group consisting of: gas station chains, toll stations, bus stations, subway stations, restaurants, grocery stores, and Internet-based web businesses.

In an alternate aspect of a preferred embodiment, the progressive processing method comprises providing opportunities to win multiple, overlapping, promotional awards. In another alternate aspect of a preferred embodiment the opportunities to win multiple, overlapping, promotional awards are assigned by groups of games, groups of machines, groups of players, or combinations thereof.

In one preferred embodiment, the progressive processing method further includes providing overhead video displays that show, by way of example only, and not by way of limitation, current progressive values, targeted progressive size, targeted win time, start time, actual winners, information revealing that a progressive prize is about to be given, player qualification rules, or combinations thereof. In one aspect of a preferred embodiment, the overhead video displays comprise plasma display interfaces. In another aspect of a preferred embodiment, the algorithm that tests to determine if there is a progressive prize win is configured to prevent a progressive prize win during certain time periods. In yet another aspect of a preferred embodiment, the opportunity to win a progressive prize can be turned off by an administrator at any time.

In another preferred embodiment, the progressive processing method further includes creating a progressive identifier that enables the opportunity to win a progressive prize to be activated from a remote server. In one aspect of a preferred embodiment, the progressive identifier is created using required data that is supplied through XML messaging or by using a management screen. In another aspect of a preferred embodiment, the required data for the progressive identifier includes, by way of example only, and not by way of limitation: desired progressive value data, desired progressive win time data, progressive reset value data, maximum progressive value data, desired start time of the progressive data, whether the progressive auto-restarts after a win, how many times the progressive repeats, whether any enticement factors are utilized, and progressive payout curve data.

In yet another preferred embodiment, the one or more winners of the progressive prize receive the award by having the award reverse mapped into a specific winning combination on each game machine at which the one or more winners are playing; thereby creating a player perception that the specific winning combination on each gaming machine caused presentation of the progressive prize.

In still another preferred embodiment, a specific win includes, by way of example only, and not by way of limitation, a royal flush, four-of-a-kind, full house, flush in a video poker game, a blackjack in video blackjack game, and a triple jackpot symbols in a reel spinner game.

Still another embodiment is directed towards a progressive processing system that provides an opportunity to win a progressive prize, wherein the system has a progressive prize value that increases according to a progressive prize growth rate. The progressive processing system includes a selectable progressive prize value at which the progressive prize is given, wherein the selectable progressive prize value is modifiable by an administrator; and a selectable targeted progressive prize time, wherein the targeted progressive prize time is modifiable by an administrator, and wherein the progressive prize growth rate is calculated using the selectable targeted progressive prize value and the selectable targeted progressive prize time. The progressive prize value is incremented by the progressive prize growth rate. If a progressive prize win has been identified, one or more winners of the progressive prize are determined. Preferably, the progressive prize value is incrementable to a ceiling value, if a progressive prize win has not first been identified, at which point the progressive prize converts into a fixed award value.

Yet another embodiment is directed towards a progressive processing system that provides an opportunity to win a progressive prize, wherein the system has a progressive prize value that increases according to a progressive prize growth rate. The progressive processing system includes a selectable targeted progressive prize value, wherein the targeted progressive prize value is modifiable by an administrator, and a selectable progressive prize time at which the progressive prize is given, wherein the progressive prize growth rate is calculated using the selectable targeted progressive prize value and the selectable progressive prize time; and wherein the selectable progressive prize time is used to calculate the time period for incrementing the progressive prize value. The progressive prize value is incremented by the progressive prize growth rate if a progressive prize win has not been identified. If a progressive prize win has been identified, one or more winners of the progressive prize are determined.

Still another embodiment is directed towards a method providing a progressive prize. The method includes selecting an initial progressive value, wherein the starting progressive value is configurable by an operator; selecting a desired progressive prize value, wherein the desired progressive prize value is configured by an operator; electing a desired progressive prize time period, wherein the desired progressive prize time period is configured by an operator; increasing a current progressive prize value that grows from the starting progressive value towards the desired progressive value over the desired progressive prize time period at a rate at least partially calculated from the desired progressive prize value and the desired progressive prize time; and testing for a winner at multiple time intervals throughout the progressive prize time period using at least one random number. A cumulative probability of awarding the progressive prize is smaller early in the desired progressive prize time period, and wherein the cumulative probability grows larger later in the desired progressive prize time period.

Yet another embodiment is directed towards a progressive prize processing system. The system includes a first server software module and a second server software module. The first server software module increments a progressive prize over a configurable bonus time period from an initial progressive value towards a targeted progressive value, wherein the first server software module determines the progressive prize time by testing for the progressive prize at multiple time intervals during the configurable bonus time period. The second server software module determines one or more winners of the progressive prize, wherein the first server software module sends a current progressive value to the second server software module at the progressive prize time, and wherein the second server software module initiates distribution of the progressive prize to the one or more winners.

Still another embodiment is directed towards a casino-based progressive prize system for providing a progressive prize. The system includes a server side progressive software module and a player tracking interface in connection with a gaming device. The server side progressive software module increments a current progressive prize value over time from an initial progressive prize value, and wherein the server side progressive software module randomly determines a final award time for the progressive prize during a configurable bonus time period. The player tracking interface in connection with a gaming device is such that the current progressive prize value is displayable on the player tracking interface during the bonus time period. The progressive prize value incrementing is stopped at the final award time. A final progressive value is determined by a server side progressive software module. The final progressive value is awarded to a qualified player account or to at least one qualified gaming device credit meter. In one embodiment, the system enables the progressive prize to be cashed out of the gaming device. In some instances this progressive prize may be given as restricted, non-cashable credits to a gaming device, thereby requiring the credits to be played off on the gaming device.

Yet another embodiment is directed towards a progressive game implemented on a gaming system, wherein the gaming system includes one or more gaming machines connected to a server, and wherein the progressive game has a progressive prize value that increases according to an incremental progressive prize growth rate. The progressive game includes a desired approximate progressive prize value that is configured by an administrator before the progressive game is initiated; a desired approximate progressive prize time that is configured by an administrator before the progressive game is initiated; a progressive prize growth rate calculated using the desired approximate progressive prize value and the desired approximate progressive prize time; and a random number generation algorithm that tests to determine if there is a progressive prize win at each calculated time period, wherein the desired approximate progressive prize time is used to calculate frequency, and wherein the frequency is used to test for a progressive prize win. The progressive prize value is incremented by the progressive prize growth rate; wherein if a progressive prize win has been identified, one or more winners of the progressive prize are identified; and wherein the progressive prize is given to the identified winners on the gaming devices upon which the users are playing.

Still another embodiment is directed towards a method providing a progressive prize. The method includes selecting an initial progressive value, wherein the initial progressive value is configurable by an operator; selecting a desired progressive prize value, wherein the desired progressive prize value is configurable by an operator; selecting a desired progressive prize time period, wherein the desired progressive prize time period is configured by an operator; providing a bonus game, wherein a current progressive prize value grows from the initial progressive value over the desired progressive prize time period at a rate at least partially calculated from the desired progressive prize value and the desired progressive prize time; randomly testing for a progressive win at various time intervals throughout the progressive prize time period; and determining a final progressive prize value after the progressive prize time is determined, wherein the bonus game shows a winning combination that awards the final progressive prize amount to a winning person.

Other features and advantages of the disclosed embodiments will become apparent from the following detailed description when taken in conjunction with the accompanying drawings, which illustrate by way of example, the features of the disclosed embodiments.

BRIEF DESCRIPTION OF THE DRAWING

FIGS. 2A-1, 2A-2, 2A-3, and 2A-4 illustrate a relational diagram of a progressive processing system, interconnected with associated servers, devices, components, services, and the Internet;

FIG. 3A-3F illustrate various examples of progressive parameter set-up screens;

FIG. 5 illustrates player's eCash bucket screen, game setup screen, and personal account screen, as viewed over a system gaming user interface;

FIG. 6 illustrates an eCash purchase screen where a player may transfers credits from one form to another, as well as additional personal account activity screens;

FIG. 7 illustrates game setup screen for modifying a bingo game, a game selection screen, and a personal account display screen that shows both cashable and uncashable funds for a system game in the same display screen;

FIG. 8 illustrates a user interface for a progressive game in attract mode, as well as user interface for a progressive game showing an "award display screen" after a progressive prize has been won;

FIG. 9 illustrates a progressive processing system incorporating web services that enable viewing of the progressive games from a home web browser or other personal client computing device;

DETAILED DESCRIPTION OF THE PREFERRED EMBODIMENTS

A preferred embodiment of the time-based progressive game and method is implemented over a gaming system on a system game user interface of a gaming machine. In this manner, the time based progressive game increases user excitement and competition, thereby increasing a user's average playing time on gaming machines in the gaming system. The gaming system includes one or more gaming machines that are connected to a system server, preferably over a network. The system game user interface utilized by the time-based progressive game and method provides enhanced player satisfaction and excitement through player competition (or perceived competition) and additional opportunities to "win," which results in increased user playing time on games in the system.

Figure 1:
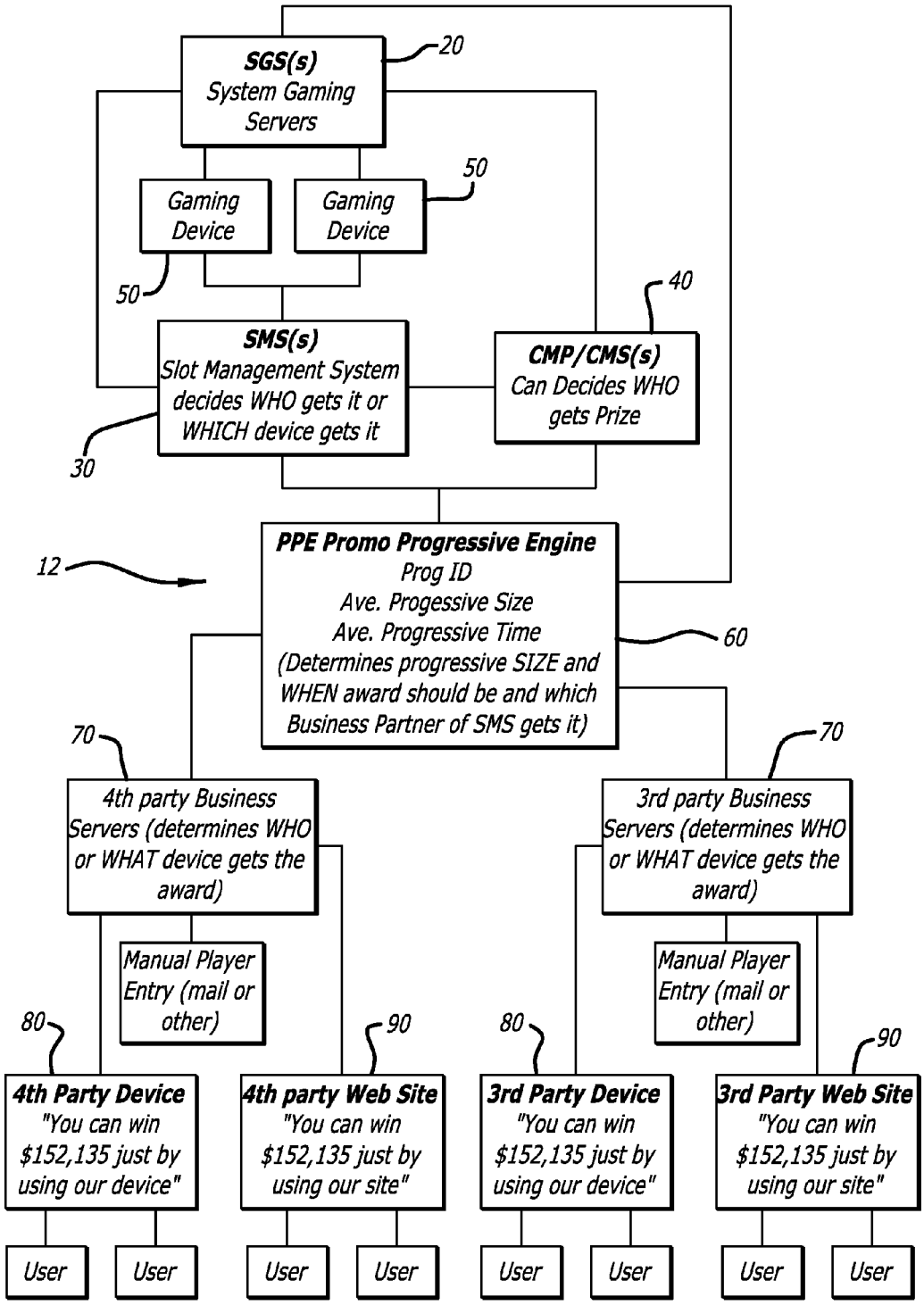
FIG. 1 illustrates a relational diagram of a progressive processing system, configured in accordance with the disclosed embodiments, interconnected with associated servers and devices.

Referring now to the drawings, wherein like reference numerals denote like or corresponding components throughout the drawings and, more particularly to FIGS. 1, 2A-1, 2A-2, 2A-3, 2A-4, and 2B, there is shown an embodiment of a progressive game 10 implemented on a progressive processing system 12. Specifically, FIG. 1 shows a time-based progressive game 10 implemented on a progressive processing system 12 that includes system gaming servers 20, a slot management system 30, a casino management system 40, gaming machines 50, a progressive engine 60, 3rd and 4th party business servers 70, and 3rd and 4th party devices 80 and web sites 90. In one preferred embodiment, the time-based progressive game 10 is a promotional game, in that it is funded using non-wagered dollars. The time-based progressive game 10 is preferably customizable, enabling gaming parameters of the time-based progressive game to be controlled by casino administrators that implement and manage the game.

Specifically, a casino that employs a preferred embodiment of the progressive game 10 is able to select the targeted progressive prize size and targeted progressive prize length of time until the award is given. This affords casino administrators a much greater (and desirable) amount of control, in contrast to typical progressive games that are usually driven by components such as "coin in" to the gaming machines in the system, which are not controlled by the casino. Furthermore, in a preferred embodiment of a progressive game 10, casino administrators are also able to customize the shape of the "payout curve" (i.e., the curve of progressive prize size versus time at which the progressive prize is paid out). This as well is a highly desirable degree of control that is achievable in a preferred embodiment of a progressive game 10. This payout curve increases the desired excitement and anticipation of the players for the specific progressive.

In a preferred embodiment of the progressive game 10, the casino administrators typically control (1) the targeted length of time at which each progressive prize is to be won, (2) the targeted progressive prize value in dollars, (3) the "enticement factors," if any, that are used to help increase player excitement and/or control of the "payout curve," and (4) the progressive prize reset value. Correspondingly, in a preferred embodiment of the progressive game 10, the progressive processing system 12 typically controls the remaining factors of the progressive game, including by way of example only, and not by way of limitation: (1) the targeted increment rate of the progressive prize, which is calculated using the targeted progressive prize value, the targeted progressive prize time, and any added "enticement" factors; (2) the random number generation algorithm used to determine if there will be a progressive prize winner; and (3) if a progressive prize is to be awarded, the random number generation algorithm used to determine who the award winner will be.

In another preferred embodiment of the progressive game 10, the player selection may not use a random number generator at all. For instance, by way of example only, and not be way of limitation, the slot management system (SMS) may pick the person with the longest current play session, the person with the most money played, the person who lost or won the most money in the last fifteen minutes, the first person to insert a player card into a gaming device at the start of the last fifteen minute period, or any other identifiable selection criteria.

The progressive game 10 includes several desirable characteristics. For example, in a preferred embodiment of the progressive game 10, the player has the opportunity to win a progressive prize from the very beginning of the promotional progressive game cycle. Additionally, in a preferred embodiment of the progressive game 10, the progressive prize growth rate is not directly linked to the wagered "coin in" of floor play (i.e., "coin in" from participating gaming machines does not directly contribute to the progressive prize growth). However, the progressive prize can be indirectly (or partially) linked, if desired, with activity on the gaming floor using an "enticement factor," as described in further detail below. Such an enticement factor can create a casino-moderated "ebb and flow" in response to gaming activity, if the casino so desires.

In some preferred embodiments, the progressive game 10 uses one or more various "enticement" factors that speed up and/or slow down the incremental growth rate of the targeted progressive prize. In one preferred embodiment, one such "enticement" factor (referred to herein as a "floor activity enticement factor") is based on gaming activity on the floor. In an additional preferred embodiment, another such "enticement" factor (referred to herein as an "erratic movement enticement factor") provides the addition of randomized movement to the incremental growth rate, which gives the progressive increment rate a desirable "look and feel" (i.e., makes the players feel like "sometime is happening" or that "sometime is about to happen").

In yet an additional preferred embodiment, another such "enticement" factor is based on the number of eligible players in the progressive gaming system (e.g., the number of player cards inserted in gaming machine) and not the "coin in" amount. Various other types of "enticement" factors are customizable as desired to influence player behavior. For example, in one preferred embodiment, the displays digits of the time-based progressive game 10 count faster from 1 to 3, then slower from 4 to 6, and finally at a medium count rate from 7 to 9.

With respect to another aspect of a preferred embodiment of the progressive game 10, the winning player is selected randomly from among all active players at the time the progressive is awarded. In this regard, an "active player" is defined as a player who has a player tracking card 54 inserted into a gaming machine in the gaming system. In another preferred embodiment, more than one player is randomly selected from among all active players at the time the progressive is awarded. In one such preferred embodiment, the primary winning player receives X % of the progressive prize and the rest of the winning players receive the remainder (100%-X %) of the progressive prize.

Figures 1, 2A:
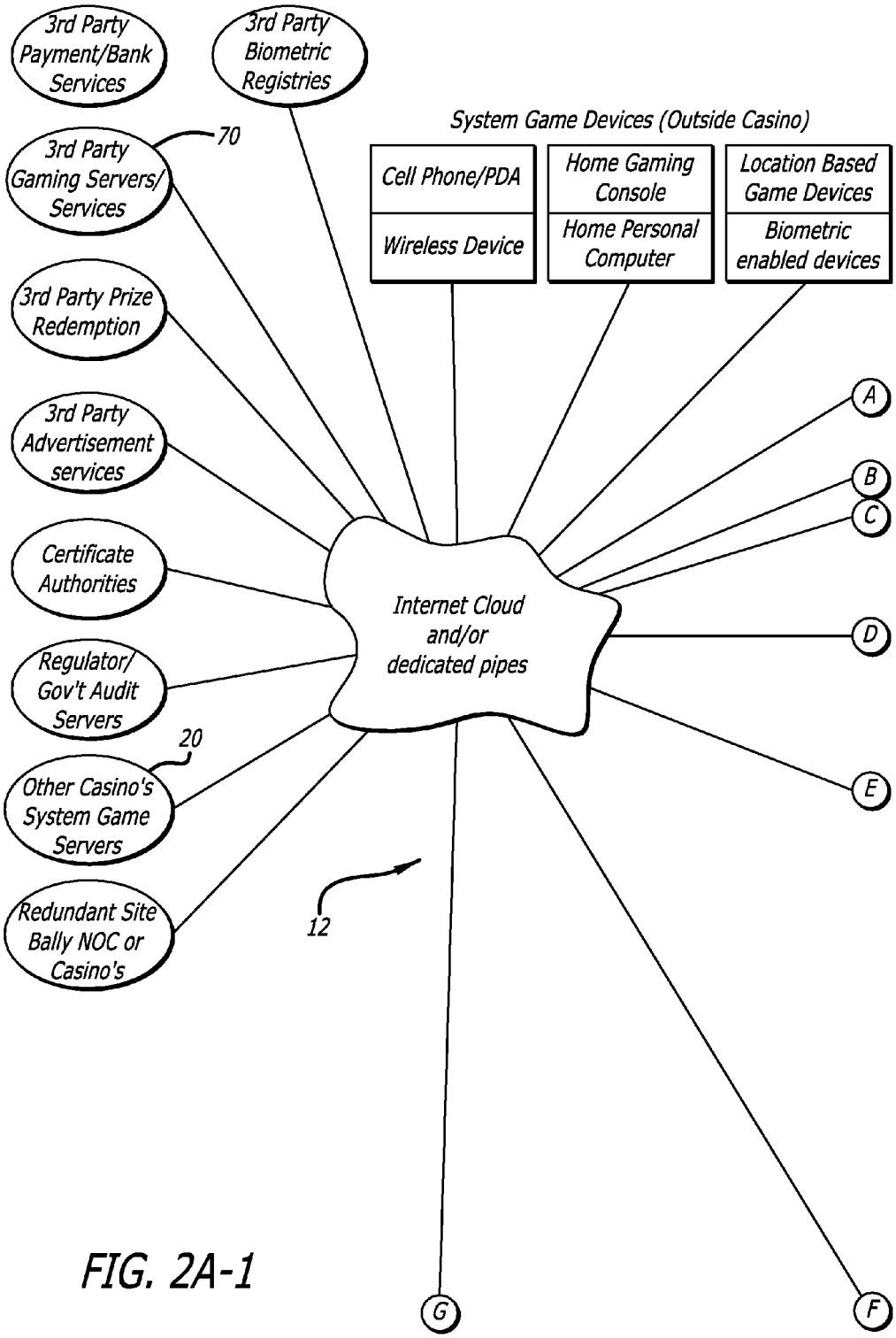
Figures 2, 2A:
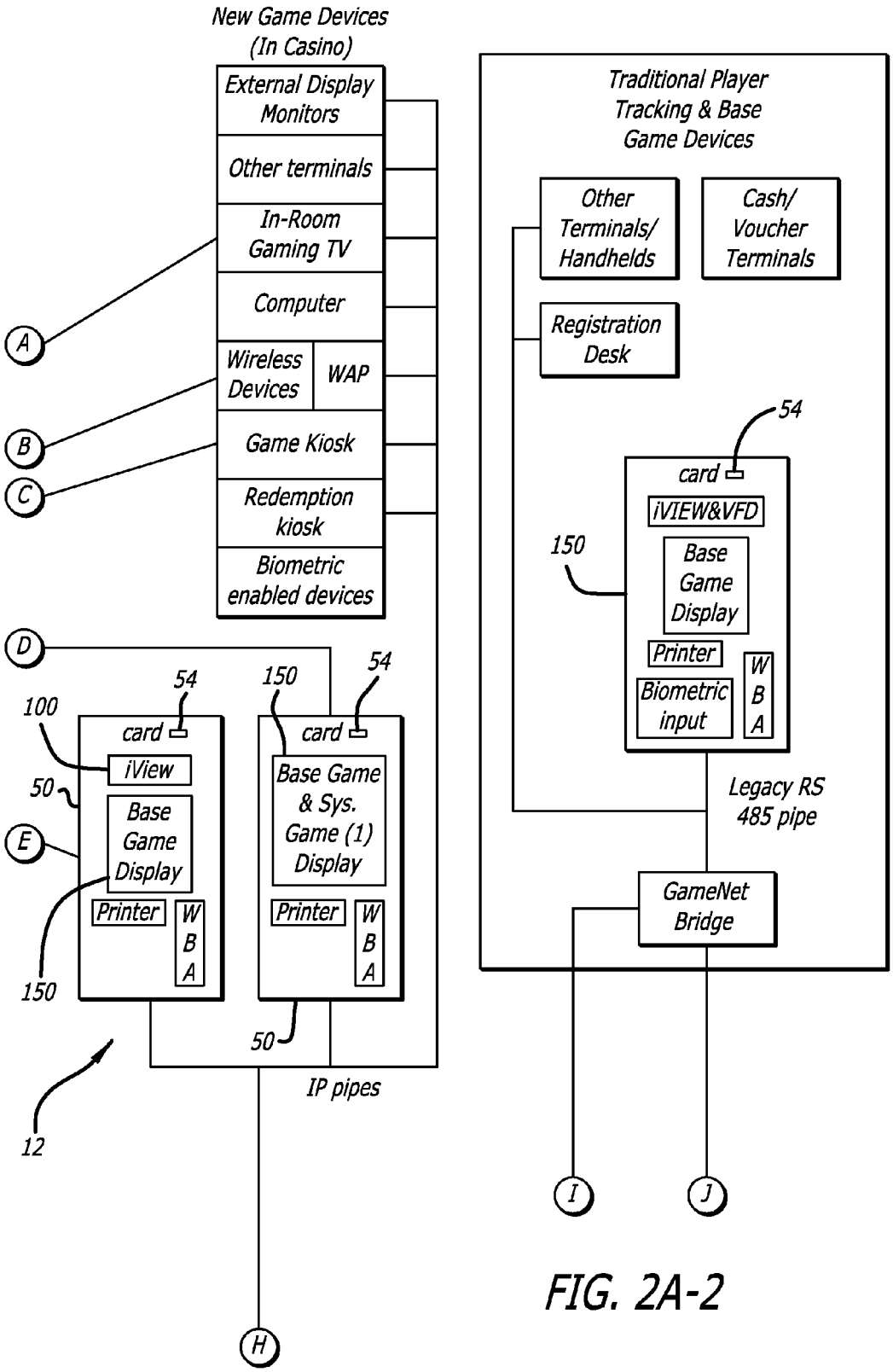
Figures 2, 2A, 3:
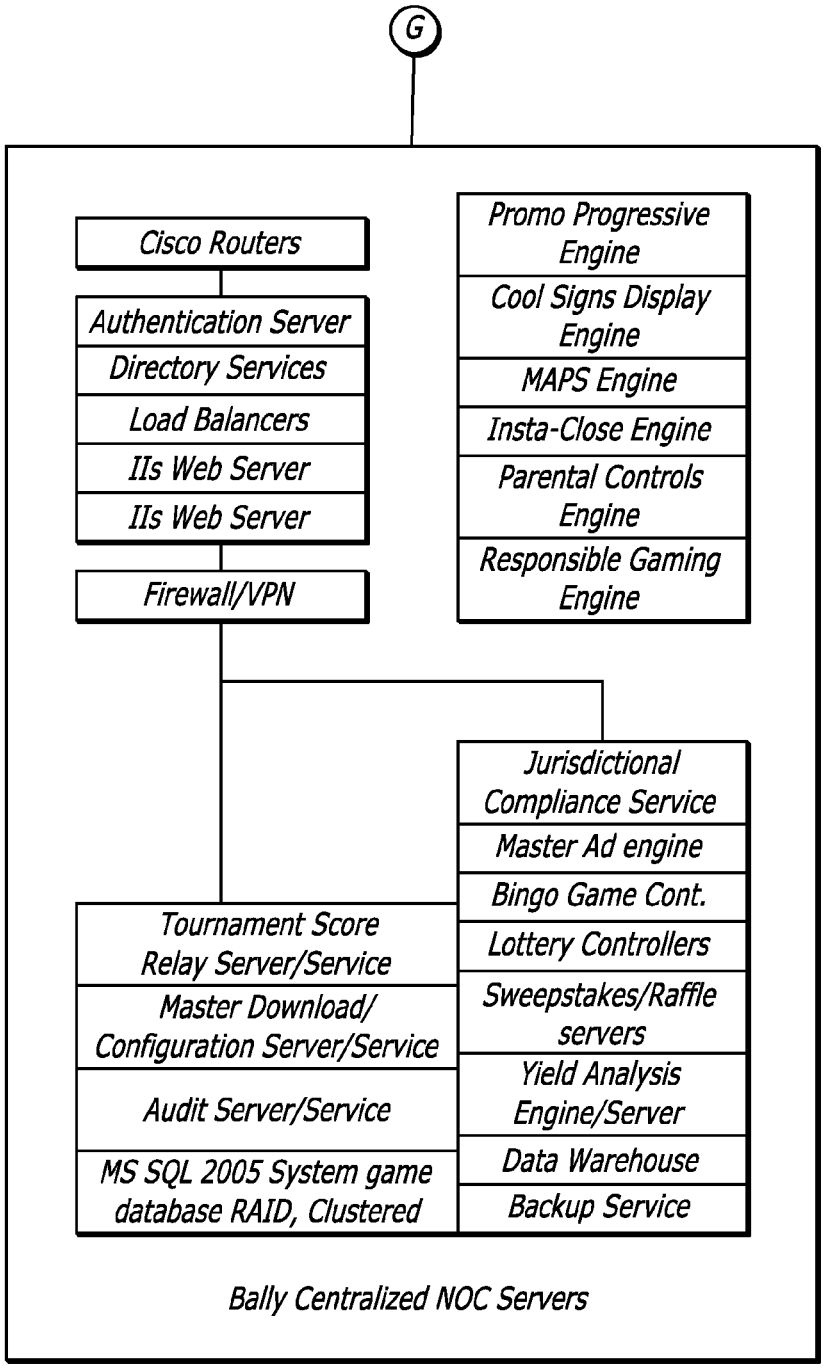
Figures 2, 2A, 3, 4:
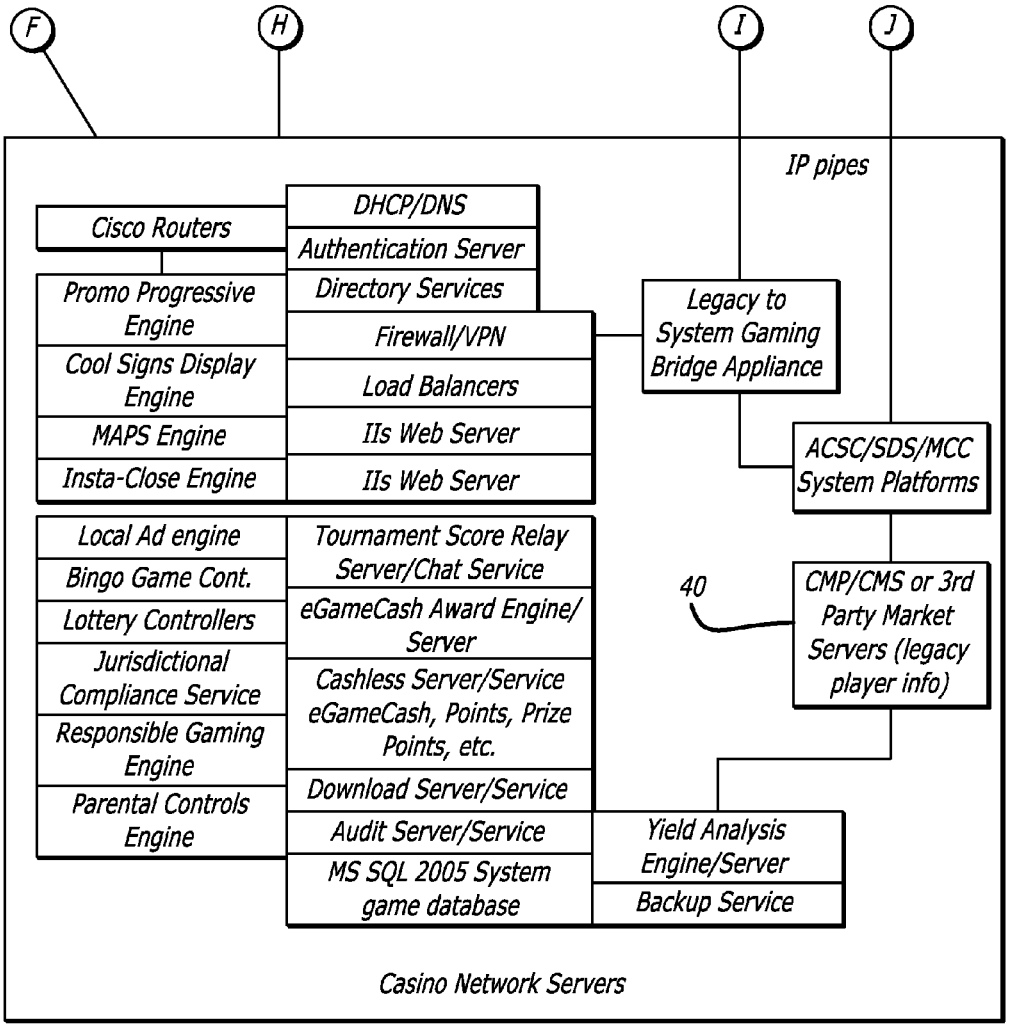
Figure 2B:
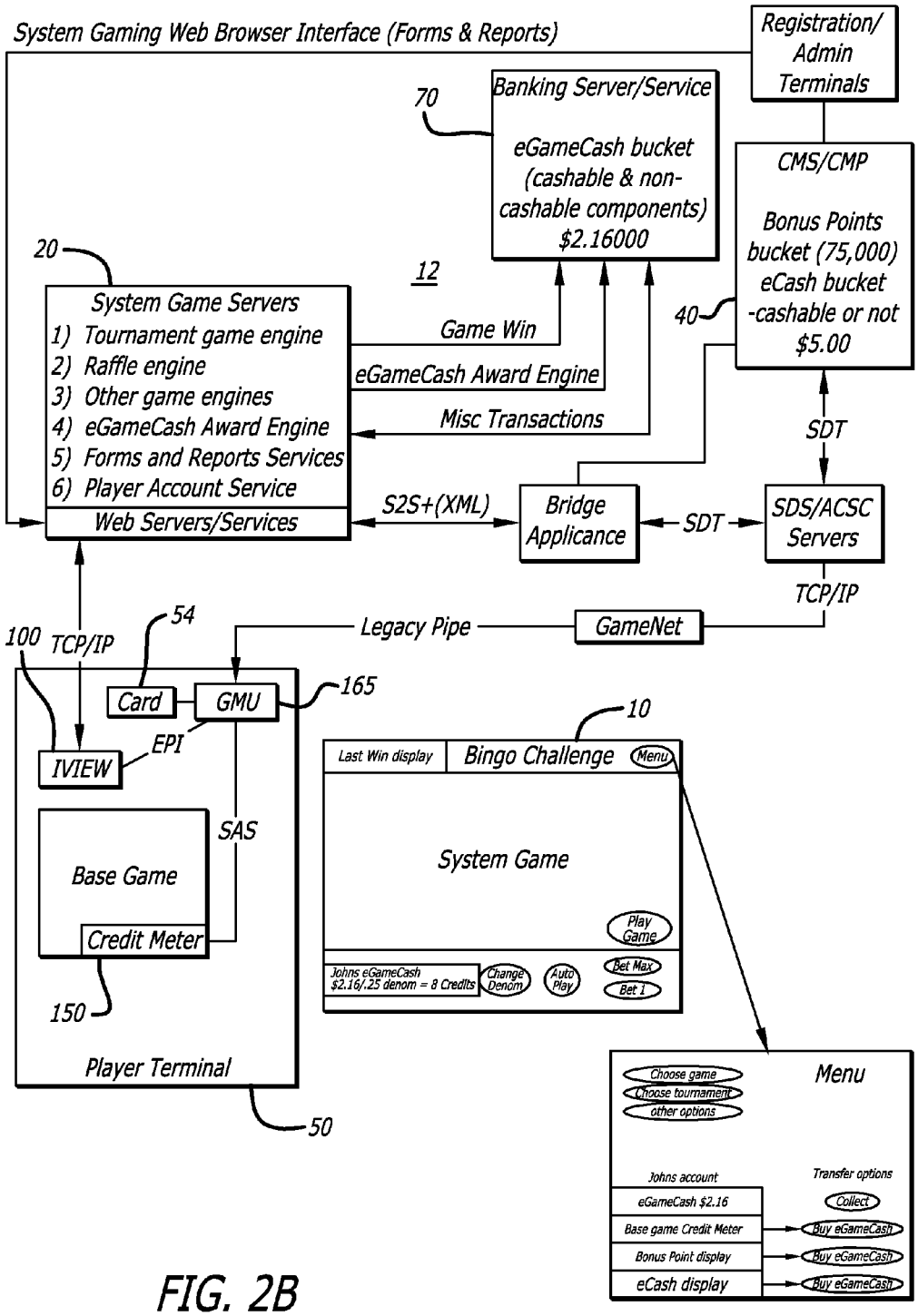
FIG. 2B illustrates a relational diagram of a progressive processing system, interconnected with associated servers, devices, components, services, display screens, and menus.
Figure 3A:
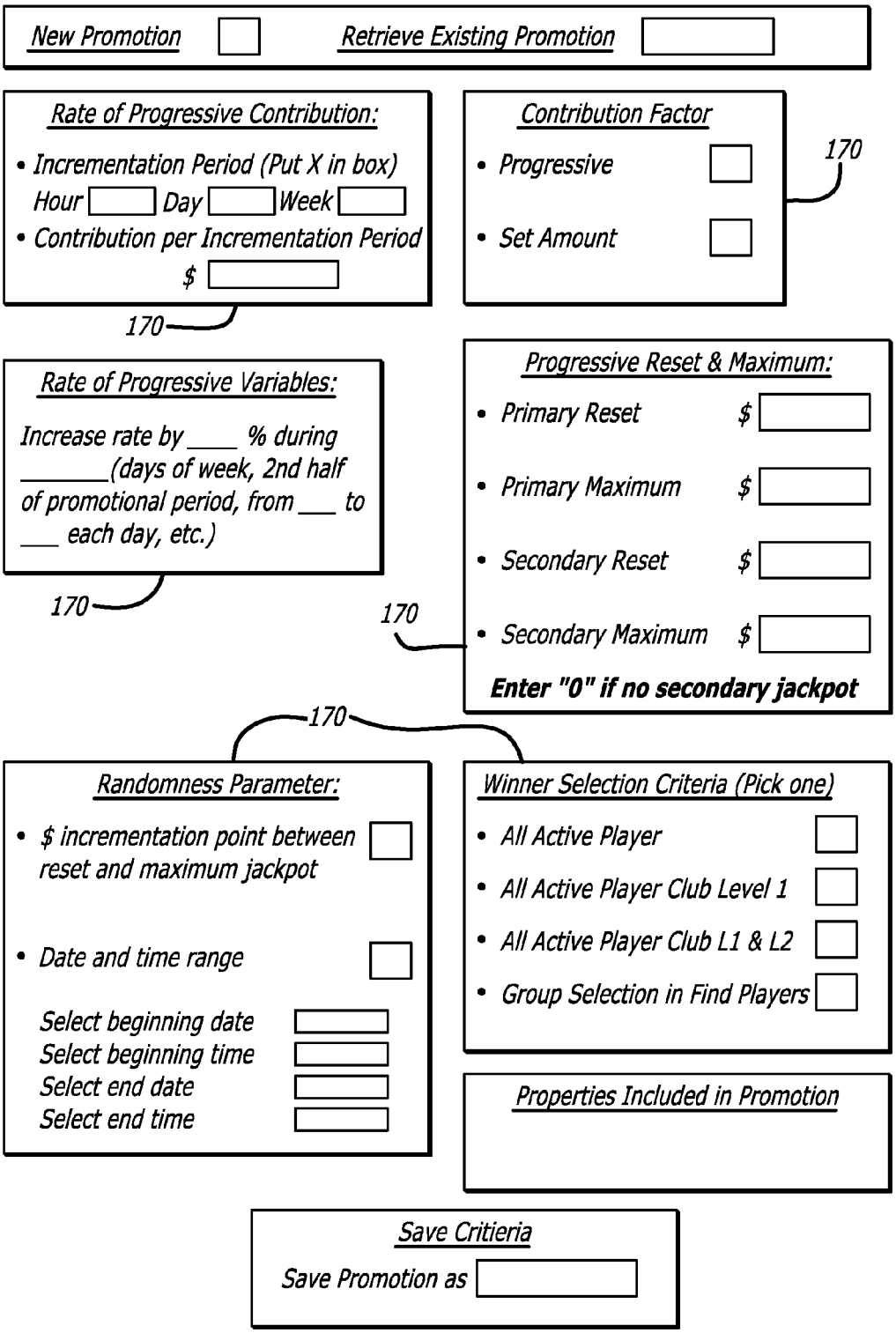
Figure 3B:
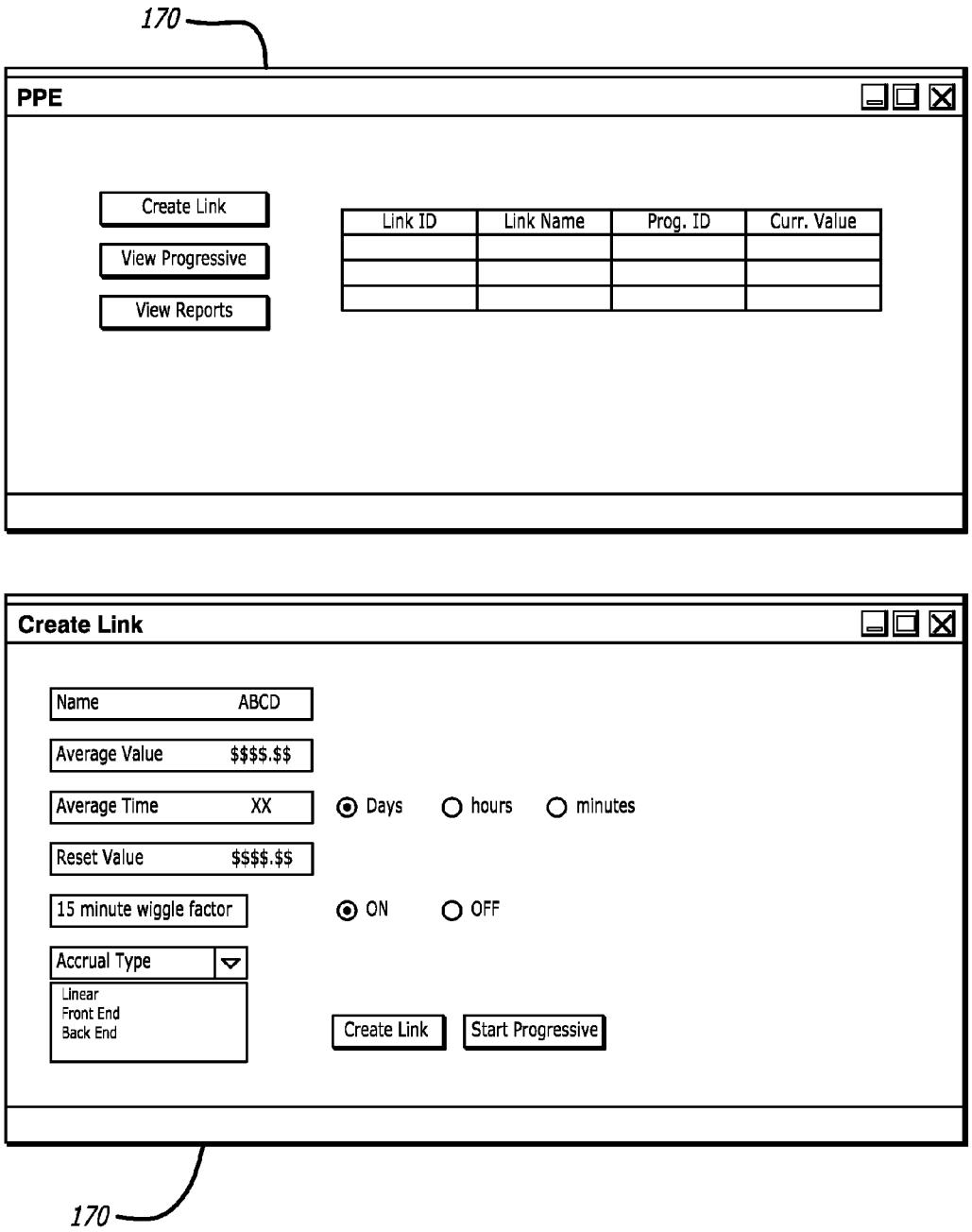

In a preferred embodiment, as shown in FIGS. 2A-1, 2A-2, 2A-3, 2A-4, and 2B, the progressive game 10 is a system game that is displayed on a system game user interface 100, such as an iVIEW-type device (described in further detail below). However, in another preferred embodiment, the progressive game 10 may be implemented over another gaming platform. Preferably, one embodiment of the progressive game 10 is a time-based and value-based progressive game, having a progressive prize that is funded from marketing dollars, which is paid to one or more players who have a player-tracking card inserted into the game when the award is activated. However, in another preferred embodiment, the time-based progressive game 10 may utilize other funding methods, as indicated in FIGS. 1, 2A, and 2B (e.g., wagered dollars, 3rd party incentives, 3rd party services, and the like).

In another aspect of a preferred embodiment, the progressive game 10 is self-tunable to a desired casino profitability level by adjusting the targeted progressive prize amount to be awarded and the targeted time in which the progressive prize is to be awarded, during the processing of the progressive prize information, which takes into account the total money in and out of the entire business per unit time. In one preferred embodiment, no player interaction is required with the progressive game in order to enhance the player's ability to win or enhance the amount of the player's win. However, in another preferred embodiment, the progressive game 10 may utilize (or allow) at least some limited type of player interaction like a simulated game bingo. Moreover, an alternative to dispensing cash to players at the gaming terminal is to dispense the prizes to player account buckets, including bonus points, eCash, eGameCash, and the like. In this regard, progressive prizes may be in a form that includes, by way of example only, and not by way of limitation, prize points, bonus points, cash, eCash, eGameCash, or any other point or credit system used by a casino or by a third party (e.g., points.com, airline points, and the like).

As stated above, preferably all players that have their player cards inserted into an eligible gaming machine in the gaming system are eligible to win the progressive prize. Additionally, the progressive prize that is available may be grouped in many different ways, including by way of example only, and not by way of limitation: by game denomination, by group of game machines on the floor (i.e., grouped according to a distinguishable game machine characteristic), or by random grouping of game machines on the floor. Alternatively, the progressive prize available may be inclusive of all game machines on the floor. Otherwise stated, in a preferred embodiment of the time-based progressive game 10, gaming machines on the floor are dynamically groupable by virtually any desired criteria. Moreover, the progressive prize is preferably awarded to a randomly chosen player once the progressive prize requirement has been satisfied, typically using a random number generator algorithm. Alternatively, in another preferred embodiment, the winner of the progressive prize is selected by type of players (e.g., club level=silver, gold, platinum, and the like). Typically, historical play data is typically used to calculate the players club level. In another preferred embodiment, a progressive game 10 spans multiple property locations and the associated progressive prize is awarded to any player or machine at any of the property locations linked to the progressive ID of that progressive prize.

In a preferred embodiment of the progressive game 10, a player inserts its player tracking card 54 in an associated game machine 50. The player is then able to view specific progressive games/prizes on the system game user interface 100 that are eligible to the player. In one preferred embodiment, the progressive values, the progressive rules, and any help information are all displayed to the player over the system game user interface 100 from a gaming system server. Preferably, the player is automatically eligible for a specific set of progressive games and does not need to interact with the system game user interface 100 to enhance the player's opportunity to win one of the progressive games. Additionally, in one preferred embodiment, the player is able to select to play a specific progressive game from amongst a plurality of eligible progressive games. For example, the number of choices may be limited to just one or two of a multitude. In another preferred embodiment, the player may select to play a plurality of eligible progressive games simultaneously. Typically, when a player removes its player tracking card 54 from the progressive game 10, the player becomes ineligible to win a progressive prize.

In another aspect of a preferred embodiment, the progressive processing system 12 includes a player tracking system that comprises a graphic display, a keypad, and one or more player input means. The player input means include, by way of example only, and not by way of limitation, a touch bezel associated with the graphic display, soft keys, touchpad, trackball, joystick, micro-joystick, annular touch surface (e.g., iPod® click wheel), sub-located buttons, voice command, or a remote devices (e.g., mobile phones, PDAs, and the like).

As stated above, in a preferred embodiment of the progressive game 10, to be eligible to win a specific progressive prize, the player must have its player-tracking card 40 inserted in a game machine 50 that is associated with the specific progressive prize at the time of progressive prize is given. For example, in one specific non-limiting example, the casino may run three gaming promotions simultaneously: one for nickel ($0.05) denomination machines; one for quarter ($0.25) denomination machines; and one for all machines on the floor. In such an embodiment, a player that has its player-tracking card 40 inserted into a nickel machine is eligible to win both the nickel promotion and the floor wide promotion (i.e., the player is able to select to play a plurality of eligible progressive games simultaneously). The progressive game 10 need only know which player-tracking cards 40 are inserted at which game machines 50, as well as details of the base game (e.g., game denomination), in order to be able to award progressive game winnings to the player.

In a preferred embodiment of the progressive game 10, when determining what progressive prizes to make available, casino personnel have the ability to control (1) the types of progressives games/awards to make available, (2) the progressive details (e.g., progressive prize value and time to progressive prize payout) of progressive games/awards made available, and (3) how the progressive funds are distributed to a player that wins a progressive prize.

With respect to the types of progressives, the progressive game 10 enables casino personnel with the ability to provide different progressives for different players by utilizing grouping criteria that includes, by way of example only, and not by way of limitation, game denomination, grouping of gaming machines 50 by physical location on the gaming floor, grouping of all gaming machines 50 on the gaming floor, player tracking card 54 player level (e.g., silver, gold, platinum), and combinations thereof. Additionally, rated theoretical wins or losses for a player or group of players could also be used in the player selection criteria.

As discussed above, in one preferred embodiment, the targeted progressive value is modified by a yield analysis to correlate with the desired casino profitability. For example, if a casino had low earnings last week, and the casino ran a $10,000 progressive game, then the casino may only want to give a $5,000 progressive game this week. In another preferred embodiment, the progressive processing system 12 is modified dynamically prior to the next weekly recurring progressive game. This automatic tuning of the desired casino profitability may involve altering the progressive prize size and/or progressive prize time, thereby tuning to the current business needs. In some preferred embodiments, this tuning takes place while the progressive game is "live" (i.e., in progress).

With respect to the progressive details of progressives games/awards made available, the progressive game 10 enables casino personnel to determine the targeted time at which a progressive prize is given and the targeted dollars amount that will be distributed at that time. As previously stated, in one preferred embodiment, these targeted values are theoretical average values. The actual progressive prize time and progressive prize dollar amount will vary. As such, players (and potential players) will not be able to guess the exact time or amount of the progressive prize and use this information to "camp out" when the progressive prize is eminent.

The following is a non-limiting example of a progressive promotional award customized by a casino using the time-based progressive game 10. A casino desires a daily progressive that pays an average of $300 with a start/reset value of $85. All machines on the floor are eligible to participate in the progressive. Using a "Promotion Administration Tool," the casino would enter the following information: Targeted progressive value: $300; Progressive reset value: $85; Machines included in progressive: All; Targeted progressive prize time: 24 hours, 0 minutes (daily); Number of Winners: 1; Percentage of pot for each winner: 100%; and optionally, the +/−tolerance range for the desired numbers (e.g., progressive value=$300+/−25%). This criteria is typically categorized in table format for a casino administrator to complete, including the percentage for each winner in the event of multiple winners in a single progressive game. Various examples of progressive parameter set-up screens 170 are shown in FIGS. 3A-3F.

Referring again to FIGS. 1, 2A-1, 2A-2, 2A-3, 2A-4, and 2B, in one preferred embodiment, the group of gaming devices in the specific promotion is set up in the SMS (slot management system) and/or the CMP/CMS (casino market place/casino management system) system to create a promotion ID. This promotion ID is then assigned to a Progressive ID in the progressive processing system 12. In this manner, the eligible players that are available to win the specific progressive ID are controlled outside of the server of the progressive processing system 12. In this preferred embodiment, the progressive processing system 12 decides "when" a progressive prize will be awarded and the "value" of the progressive prize to be given. In such a preferred embodiment, the previously existing servers in the casino select "who" will win the progressive prize. In this manner, a preferred embodiment of the progressive processing system 12 is easily incorporated with slot floor systems in the field that have promotional capability.

Additionally, the progressive processing system 12 can be utilized by any business that seeks to offer promotional give-backs to their customers. In such an embodiment, these businesses merely have to select winners from their customers when the progressive processing system 12 notifies them to do so. Preferably, the business' other systems would manage player accounts and the computing devices as currently preformed. Typically, these systems would not require the support of progressive processing system 12. In another preferred embodiment, the software of the progressive processing system 12 is tightly embedded into existing operating business servers.

A preferred embodiment of the progressive processing system 12 includes a progressive engine 60. In a preferred embodiment, the progressive engine 60 performs several calculations utilized in the progressive game 10. These calculations are performed at predetermined "time slices" and "time sub-slices" (in accordance with the targeted progressive prize time). In one preferred embodiment, a "time slice" is equal to 1/100th of the total targeted length of time for the progressive to be awarded, as set by casino personnel. In one such embodiment, the progressive will be won 50% of the time on or by the targeted set time and will always be won by 125% of this desired time. In another preferred embodiment, there is no absolute payout time prompt. A sub-slice is yet a smaller slice of time within a time slice. Preferably, a "time sub-slice" is close to a minute in size, but obviously will vary in length depending on the desired targeted length of time selected for awarding the progressive prize. At each sub-slice of time, the progressive engine 60 tests for a winner. In a preferred embodiment, the progressive engine 60 uses time slices and sub-slices to accommodate progressive games 10 of any length of time, ranging from five minutes to over five years. Otherwise stated, virtually any length of progressive game 10 can be accommodated.

In a preferred embodiment of the progressive game 10, a setup procedure is performed for each progressive game. Preferably, this process includes: resetting the progressive prize to the progressive reset value; setting a progressive timer to the progressive start time; setting a sub-slice timer (this should be the same as the progressive timer to begin); setting the time slice counter to zero; setting the time slice increment rate; setting the number of time sub-slices per time slice; setting the time sub-slice increment rate; and starting the progressive game 10.

In one preferred embodiment of the progressive game 10, the following formulas and calculations are employed. In a preferred embodiment, the proper time slice increment rate is calculated by dividing the desired length of time for the progressive game by 100, which is the number of time slices in this embodiment. The result is the targeted length of each time slice in minutes. Thus, in an example 24-hour progressive game period, the time slice increment rate would be 14.4 minutes/slice. During a progressive game 10, the time-based progressive game 10 preferably uses values from a table, based on the number of the current time slice.

Another preferred aspect of a progressive engine 60 is the ability to emulate a traditional progressive game (e.g., a bonus progressive game), if desired, that is tied to wagering activity on the gaming floor. In one preferred embodiment, the progressive engine 60 emulates the "heart beat" of the floor (e.g., the number of players connected to the progressive gaming system), but is not tied in anyway to the wagering activity.

Additionally, in a preferred embodiment of the time-based progressive game 10, the number of time sub-slices per time slice is calculated by first truncating the time slice increment rate. If the resulting value is less than one, then the number of time sub-slices per time slice is set to one. This ensures that there is always at least one time sub-slice per time-slice. Preferably, there is always at least one time sub-slice per time-slice because the time-based progressive engine 60 tests for a progressive winner and increments the progressive prize based on the time sub-slices. Therefore, there must be at least one time sub-slice per time-slice in order to insure the math for the progressive game will work correctly. Accordingly, in the 24-hour progressive game period example discussed above, there are 14 time sub-slices.

Continuing, in a preferred embodiment of the progressive game 10, the time sub-slice increment rate is calculated by dividing the time slice increment rate by the number of time sub-slices per time slice. In this manner, the length of each sub-slice is determined. Typically, this value is close to one minute. Thus, in an example 24-hour progressive game period, the time sub-slice increment rate is 14.4 minutes (time slice incremental rate) divided by 14 minutes (number of time sub-slices per time slice)=61.7143 seconds.

In a preferred embodiment of the progressive game 10, progressive gaming calculations are performed during every time sub-slice interval of the progressive game by the progressive engine 60. Preferably, at the start of a new sub-slice, the by the progressive engine 60 runs a test to determine if a progressive prize is to be awarded at that time. Additionally, the growth rate of the progressive prize for each sub-slice is also determined at the start of a new sub-slice. In a preferred embodiment, these functions are repeated at the start of every time sub-slice until the progressive prize is awarded. Moreover, in a preferred embodiment of the progressive game 10, it is possible for the progressive prize to be won instantly (i.e., in the first time sub-slice of the first time slice), or for the progressive game to run until the game has passed the 100th time slice. In one preferred embodiment, the progressive game 10 is able to continue for many time slices past the 100th time slice, instead of having the progressive game incorporate a forced payout when the 100th time slice is reached. In such an embodiment, each of these time slices is the same length as the slices before the 100th time slice. In one preferred embodiment, the progressive game 10 also incorporates one or more enticement factor calculations that run in the background on the system server (independent of which particular progressive games are active). These calculations are backed up data every 15 minutes, as well as returning data to the progressive engine 60 on request.

In a preferred embodiment of the progressive processing system 12, the progressive game 10 allows players to have the opportunity to win the progressive prize as soon as the progressive game begins. In one preferred embodiment, there is not any progressive prize value trigger that must be reached in order to allow the progressive prize to be eligible to be won, other than the initiating of the progressive game itself. In a preferred embodiment of the progressive game 10, a calculation is made for each time sub-slice to determine if there is a win of the progressive prize. For each time sub-slice there is a different number of remaining possible winning time sub-slices. Therefore, a calculation is performed at the beginning of every time sub-slice for the length of the progressive game in order to determine whether the progressive prize is given. For each calculation, the progressive game 10 accesses an associated table (see example "Winning Time Slice Table" below) for the win value (i.e., number of "winning time slices") of the current time slice.

For example, at time-slice number four, the following calculation is performed:

```
IF Random(1)*(1,000,000*# of Sub-Slices per Time
    Slice (14 in our 24 hour progressive))<=Winning
    Time Slice Table [Time Slice] THEN winner
    right now=TRUE

OR (in this example);

IF Random(1)*(14,000,000)<=Winning Time Slice
    Table[4] THEN winner right now=TRUE

OR;

If Random(1)*(14,000,000)<=8 THEN win=TRUE
```

(Random(1) returns a 32 bit random number between 0-1)

Continuing, in a preferred embodiment of the time-based progressive game 10, if the random number picked is less than or equal to the win value in the Winning Time Slice table for the current time slice, then the progressive prize value (the progressive "pot") is awarded. In a preferred embodiment, the number of time sub-slices is multiplied by 1,000,000 so that the win value from the table is comparable to the random number based on the entire time-slice. For example, if there is one time sub-slice per time-slice in a progressive game, then there is a one in 1,000,000 chance of selecting a "winning" time slice. In this same manner (referring to the table below), if there are 14 time sub-slices, then there is an eight in 14,000,000 chance of selecting a "winning" time slice. This mathematical profile is selected in order to create to casino administrator's desired payout curve. Moreover, this mathematical profile is applicable to any length of progressive game 10. In one preferred embodiment, if the 125th time slice is reached, the progressive prize is automatically won on the first sub-slice test. However, in other preferred embodiments, the progressive prize is automatically won at a different time slice, or is never automatically won at any time slice.

Example Winning Time Slice Table

| Time Slice | # of Winning Tickets |
|---|---|
| 1 | 1 |
| 2 | 2 |
| 3 | 3 |
| 4 | 8 |
| . . . | . . . |
| 122 | 463,702 |
| 123 | 560,125 |
| 124 | 785,129 |
| 125 | ALWAYS WIN |

In one preferred embodiment, above table is loaded into the progressive processing system 12 by selecting and dragging points on the payout curve, after which the number of time slices of winning tickets is reverse calculated, as well as the associated probability of winning. In one preferred embodiment, the payout curve can be manually modified, or alternatively, the payout curve drawn for the user.

In a preferred embodiment of the progressive game 10, if a win value is not selected for a time sub-slice that produces a progressive prize, then the progressive prize value is incremented. This is sometimes referred to as the pot growth rate. In one preferred embodiment, the pot growth rate formula has a non-linear growth rate. Additionally, in one preferred embodiment the pot growth rate loosely associates the movement of the progressive "pot" value to the number of active players. However, in another preferred embodiment, the pot growth rate is not associated with the number of active players. In one specific embodiment, the pot growth at any given minute is described by the following formula:

(Base growth rate for current time slice)+(15 minute enticement factor)+(sub-slice enticement factor)

The formula in the above non-limiting example calculates a dollar value to be added to the progressive "pot" value that is visible to the players, and which can be won over the next time sub-slice. In one specific embodiment, components of the formula include: (1) the desired overall pot growth for the entire length of the progressive game; (2) base growth rate for sub-slices in this time slice; (3) a 15-minute floor activity enticement factor; (4) a time sub-slice random enticement factor. However, other preferred embodiments of the progressive game 10 include fewer components (e.g., fewer enticement factors), additional components (e.g., more enticement factors), or modified components (e.g., different enticement factors).

In one specific non-limiting example, $300 is the desired (or theoretical average) value for the progressive game to distribute on a daily basis. In this non-limiting example, the reset value of the progressive pot is $85. Therefore, the progressive pot grows during a targeted progressive game by $215 (i.e., $300 minus $85). Once again, this desired progressive prize value of $300 is an average. If the progressive prize actually paid out every time that the progressive pot hit exactly $300, players would only play the progressive game just as the pot approached the $300 value.

As described above, in a preferred embodiment of the progressive game 10, the base growth rate formula for the progressive "pot" value is customizable. However, a preferred embodiment of the progressive game 10 further includes several pre-designed growth rate formulas that can be utilized by a casino or other hosting establishment. One such pre-designed growth rate formula component of the progressive game 10 is a "front-loading" curve for the progressive prize incrementing rate that increases quickly in the beginning and then later tapers off.

Examinations of casino information have shown that this type of front-loading of a progressive prize value may increase progressive game play. In preferred embodiments of the progressive game 10, this front-loading curve is similar for all progressive games, regardless of: (1) the actual dollar amount being played on the progressive games, and (2) the actual dollar amount being awarded for the progressive games. Preferably, the base growth rate for time sub-slices is the component of the formula that keeps the progressive pot tracking correctly. This base growth rate value is determined by locating a value in a Pot Growth table and multiplying that value by the remaining factors of the progressive incremental growth rate formula. Preferably, the base growth rate remains the same for each time sub-slice in a given time-slice. In a preferred embodiment, the current time slice is utilized to locate a Pot Growth rate value on a Pot Growth table. In one specific non-limiting example, at time slice 4, the following formula is used to calculate the base growth rate for this time slice:

(overall desired pot growth (average $−reset $)*pot growth value table [time slice])/10,000

OR (($300−$85)*pot growth value table [4])/10,000

OR ($215*300)/10,000=$6.45 (Total amount to add during this time-slice)

In the above non-limiting example, the number 10,000 was incorporated into the formula to generate the Progressive Pot Growth table shown below. Dividing by 10,000 produces the correct amount of total dollars to increment the pot growth for the time-slice. Continuing, in this non-limiting example, the value $6.45 is the total amount to be added to the progressive prize value for this time-slice. In a preferred embodiment, this value is divided by the number of time sub-slices per time slice. In the above non-limiting example, which is based off of a one-day progressive game, the progressive pot growth rate value is 14. However, this value will vary depending on the length of the progressive game. In this regard, a six-month progressive would have approximately 1296 time sub-slices per time-slice.

$6.45/14 Sub-Slices=$0.46 (Base Growth rate for this time sub-slice)

Example Pot Growth Table

| Time Slice | Pot Growth Value |
|---|---|
| 1 | 500 |
| 2 | 500 |
| 3 | 400 |
| 4 | 300 |
| . . . | . . . |
| 122 | 10 |
| 123 | 5 |
| 124 | 2 |
| 125 | 1 |

In one preferred embodiment, the data in the above table is entered manually by a casino administrator, while in another preferred embodiment, points on the payout curve are selected and dragged by a casino administrator in order to create the table.

A preferred embodiment of the progressive game 10 includes what is referred to herein as an "enticement factor." One specific, non-limiting example of an enticement factor is a 15-minute floor enticement factor. In a preferred embodiment, the 15-minute enticement factor is configured to give players the impression that the progressive growth rate is linked to actual floor activity on the gaming floor. In one preferred embodiment, the 15-minute enticement factor produces up to +/−23.75% of the base growth rate of the progressive pot for a given time sub-slice. Alternatively, this information may be manually entered by a casino administrator.

In a preferred embodiment of the progressive game 10, this component of the front-loading curve utilizes a separate calculation that is performed on a server that tracks player activity during a rolling 24 hour period and return values to any progressive game upon request. For example, in one preferred embodiment, the progressive engine 60 requests a rank value from this enticement factor calculation. This enticement factor calculation uses in the following formula:

(Rank−47.5)/200

The result of this formula is a value between −0.2375 and +0.2375. Notably, this equates to the +/−23.75% desired range of change. In the above example, this value is then multiplied by the base growth rate for this sub-slice in order to determine the final value.

In the following non-limiting example, an example rank of 87 is selected for illustrative purposes:

Base Growth Rate of Time Sub-slice*((Rank−47.5)/200)

OR (in this example);

$0.46*((87−47.5)/200)

OR $0.46*(0.1950)=$0.09 (for the 15 minute floor enticement factor)

Figure 4A:
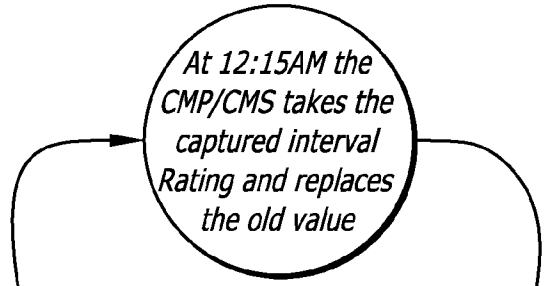
FIG. 4A illustrates multiple "floor activity" tables that keep multiple floor activity rolling and sorted tables.

As described above, a preferred embodiment of the progressive game 10 utilizes another calculation to produce for a 15-minute floor enticement factor (or other enticement factor in another preferred embodiment). A 15-minute interval is a preferred time interval because this time interval correlates with the current network capacity (or interval rating) for many casino systems. In one embodiment, the progressive game 10 performs this additional calculation every 15 minutes, preferably on the quarter hour. In order to perform this calculation, the progressive game 10 tracks the floor activity for the last 15 minutes. This "floor activity" value is typically captured by an Interval Rating Engine (or other appropriate engine in the progressive processing system 12). Referring now to FIG. 4A, in a preferred embodiment, the "floor activity" value is logged to a rolling table that keeps this value for each 15-minute period over the last 24 hours. Preferably, this rolling table includes 96 rows (i.e., four 15-minute periods per hour multiplied by 24 hours). As shown in FIG. 4A, each time a new value is calculated, this new value replaces the oldest value on the rolling table from 24 hours ago. In a preferred embodiment, this enticement factor calculation is constantly performed, regardless of whether there is any active progressive game play. This ensures that there are always "floor activity" values for the last 24-hours if a progressive game is to start at any time.

Additionally, a preferred embodiment of the progressive game 10 requires that the enticement factor background process also sort the floor activity values into a second table, as shown in FIG. 4A. This enables the time order to be preserved in the first table, i.e., the rolling table. The enticement factor background process sorts these floor activity values by the number of players, from the least number of players to the greatest number of players. In this manner, the time period with the biggest value would be in row 96. After the time periods have been sorted by activity level, the enticement factor background process returns the rank of the current time slice (i.e., a number between 1 and 96) to the progressive game upon request.

Another preferred embodiment of the progressive game 10 includes a different enticement factor. A non-limiting example of another enticement factor is a sub-slice floor enticement factor. In a preferred embodiment, the sub-slice enticement factor is configured to give players the impression that the progressive growth rate has more "life" (e.g., a more erratic, less predictable growth rate). Preferably, the sub-slice enticement causes the progressive growth rate to erratically move in a +/−10% range. In other preferred embodiments, the sub-slice enticement causes the progressive growth rate to erratically move in a +/−5% or +/−15% range. In one specific, non-limiting example, the following formula defines the sub-slice floor enticement factor:

(Random (2000)−1000)/10,000

This formula returns a value between −0.1 and +0.1, with four decimal point accuracy. This equates to a +/−10% range. In a preferred embodiment, this sub-slice floor enticement factor is multiplied by the base growth rate for this sub-slice to determine the final progressive value. In one specific, non-limiting example, the random number equating to the sub-slice floor enticement factor is 0.0473.

Base Growth rate for this sub-slice*((Random(2000)−1000)/10,000), or (in this example);

$0.46*(−0.0473)=−$0.02

Therefore, in a preferred embodiment, the final calculation for the determining the progressive pot growth rate of the front-loading curve utilizes the above described components of the formula curve. In one specific embodiment, the pot growth at any given minute is described by the following formula:

(Base growth rate for sub-slice)+(15 minute enticement factor)+(sub-slice enticement factor), or (incorporating the above-selected sample values);

$0.46+(−$0.02)+$0.09=$0.53 (total to be added to the progressive pot during this sub-slice).

Figure 4B:
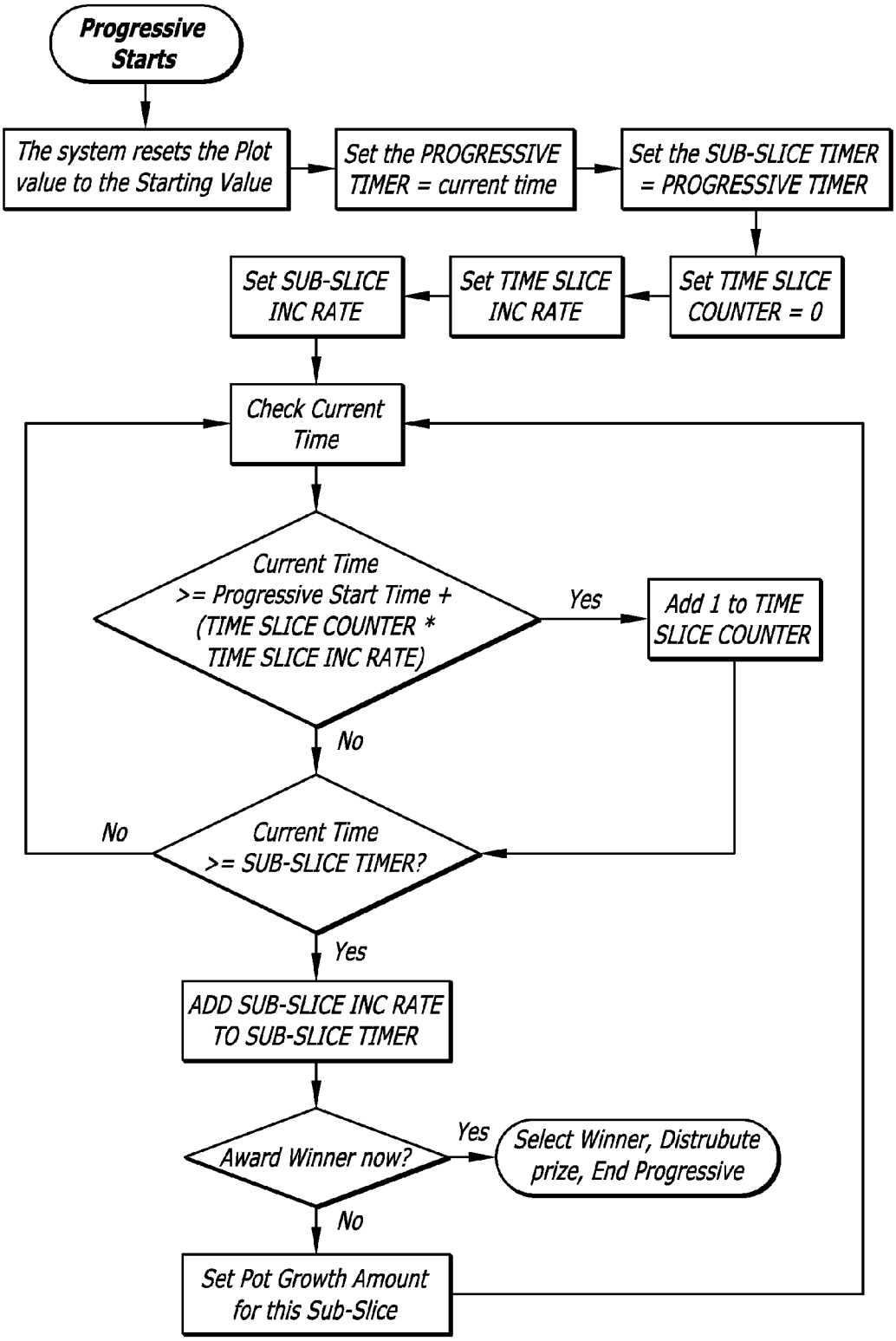
FIG. 4B illustrates a logic flow diagram of a preferred embodiment of the progressive game.

Referring now to FIG. 4B, a logic flow diagram of a preferred embodiment of the time-based progressive game 10 is shown. FIG. 4B details the process that is undergone during the execution of the time-based progressive game 10.

Figure 4C:
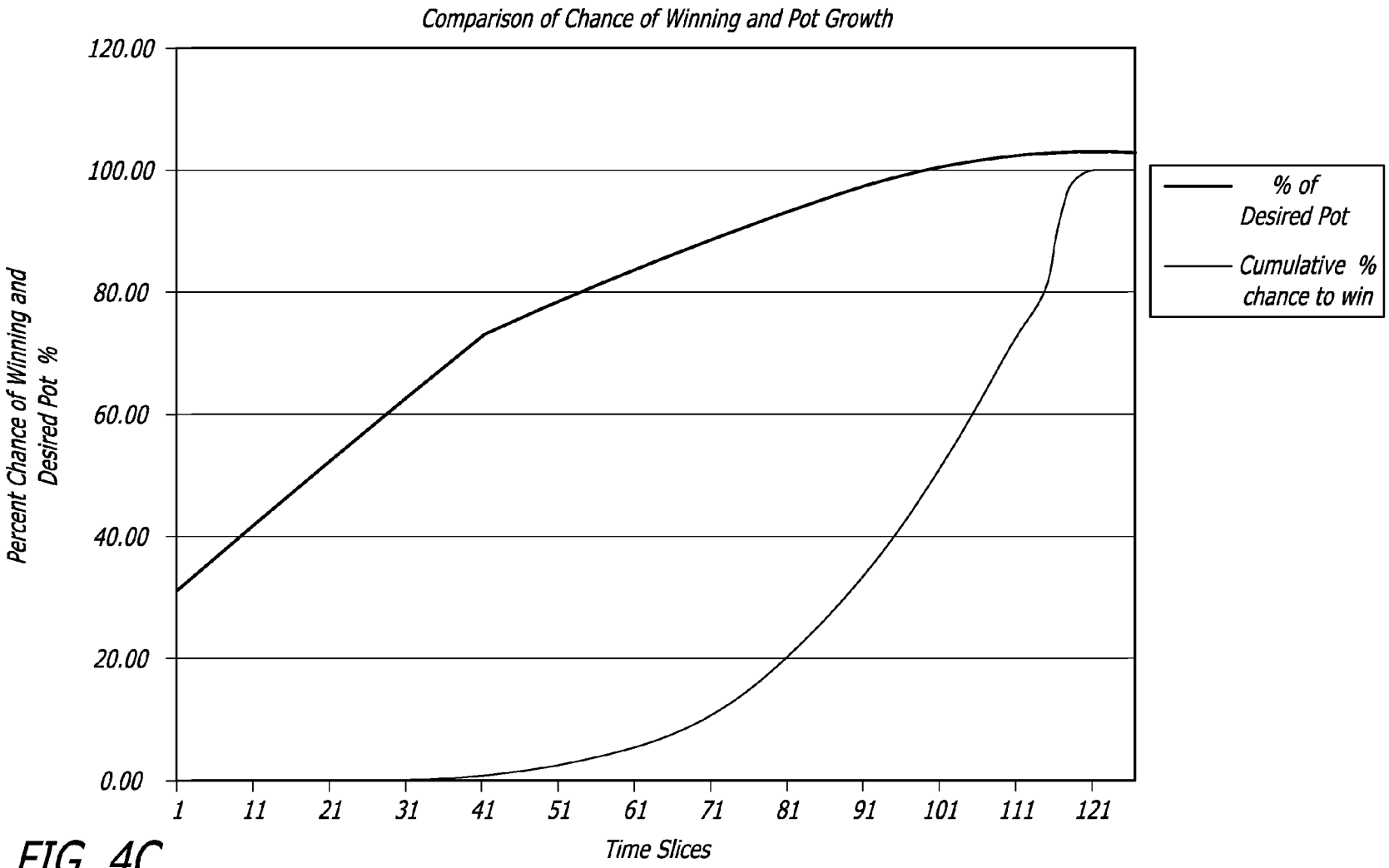
FIG. 4C illustrates a comparison chart of the percentage of the targeted (theoretical) progressive pot value (i.e., percentage of the targeted progressive prize value) versus the cumulative chance to win over time.

Furthermore, with respect to the distribution of progressive funds, FIG. 4C illustrates a comparison of the percentage of the theoretical average of the progressive pot value (i.e., percentage of the targeted progressive prize value) versus the cumulative chance to win. This comparison chart elucidates the "front loading" concept that is employed by a preferred embodiment of the progressive game 10. In one preferred embodiment, the progressive prize has a lower cumulative probability of being awarded early in the time period and increases to a higher cumulative probability of being awarded later in the time period.

In a preferred embodiment of the progressive processing system 12, the cumulative percent chance to win is a statistical technique used to create a winning time slice table, as shown above. The winning time slice table is referenced at each time sub-slice to determine the chance for a progressive prize to be won at that time sub-slice. In a preferred embodiment, the winning time slice table has 125 values that represent the number of winning time sub-slices out of 1,000,000 in any given time slice. The winning time slice table contains cumulative percent chance values. In this regard, the cumulative percent chance of selecting a progressive prize at any given time slice increases the closer that time slice is to the targeted progressive prize time. In a preferred embodiment, the cumulative percent chance is within a range of time that is acceptable to allow the progressive game 10 to have a broad enough range of lengths that players are unable to determine the ending time of the progressive game with any degree of accuracy.

In a preferred embodiment of the progressive processing system 12, the winning time slice table is generated using a spreadsheet that includes automated formulas. This enables a user to fill in some data in the table and then have the remainder of the data automatically generated. In a preferred embodiment, the spreadsheet shows the cumulative payback percent chance at each time slice. One example of the formula for finding how many time-slices exist at each time slice is:

Time Slice Number (1.5+a value added to the exponent), where the "value added to the exponent" is equal to the "Time Slice Number" divided by "a value based upon the slice number" and key time slice settings. In a preferred embodiment, the "divide value based on slice number" is determined after the user decides what time slices they want to effect and the cumulative percent chance to win at each time slice.

In one specific example, shown below, the value for time slices 1-80 is 168.59 (Original div value). This divide value is used in the "Additive to factorial" column. Any change to this value then filters through the spreadsheet, thereby producing a new "percent chance to win value" for all time slices. Preferably, setting a goal seek value in the "Used for Goal Seek" column changes the value in the "Original Div Value" column. In one specific example, this is a built-in function of the spreadsheet.

| Used for Goal | | | | | |
|---|---|---|---|---|---|
| | Div Values | | Seek | Key Slice | Desired % |
| Original div vale | 168.59 | | 0% | 0 | 0.00% |
| After $1^{st}$ key | 118.1886 | | 10.0000% | 80 | 10.00% |
| After 2nd key | 105.492 | | 50.0000% | 100 | 50.00% |
| All remaining slices | 93.5 | | 95.0000% | 115 | 95.00% |
| | | | 100.0000% | 125 | 100.00% |
| Additive to factorial | Slice number | Winning Tickets | Fail chance this slice | Cumulative fail chance | Cumulative Win % |
| 0.00593155 | 1 | 1 | 99.9999% | 99.9999% | 0.0001% |
| 0.0118631 | 2 | 2 | 99.9998% | 99.9997% | 0.0003% |
| 0.01779465 | 3 | 5 | 99.9995% | 99.9992% | 0.0008% |
| 0.0237262 | 4 | 8 | 99.9992% | 99.9984% | 0.0016% |
| 0.02965775 | 5 | 11 | 99.9989% | 99.9973% | 0.0027% |

In a preferred embodiment of the progressive processing system 12, a casino operator or bonus game manufacturer creates an original table of probabilities. In one such embodiment, an operator creates a probability curve by choosing one or more key time slices. The operator then decides what percent of the winners should occur by the chosen key slices. For example, in one embodiment, the 80th time slice is selected as the time slice by which to have 10% of all progressive prizes are to be awarded. Preferably, at the 100th time slice, 50% of the progressive prizes have been won, so as to make the overall average length of the progressive games be approximately equal to the targeted award time. Continuing, at the 115th slice, 95% of the progressive prizes have been won. Finally, in one preferred embodiment, at the 125th time slice 100% of the progressive prizes have been won, thereby restricting the top end length of the progressive to be 25% over the targeted progressive time. In this one preferred embodiment, the 25% value was chosen arbitrarily and can be modified (or removed altogether) to suit customer preference.

Preferably, adding to this 25% in value entails adding corresponding additional time slices after the 125th time slice. In other preferred embodiments, there are multiple key time slices both before and after the 100th time slice. However, even in such preferred embodiments, the target for the cumulative percent chance to win at each key slice becomes larger as the slice number increases.

In another step involved with creating an original table, the user would then goal seek for the desired percent for the first key slice by changing the original div value (divisional value). Continuing, the user repeats this process for each remaining key, and finally for the 125th time slice. The winning tickets column is then filled with the correct number of time sub-slices to ensure the progressive plays as intended.

In another aspect of a preferred embodiment, the spreadsheet is used to calculate for each time slice, the cumulative chance for the progressive prize to be won. This is determined by: (1) finding the percent chance to fail for a given time slice, (2) multiplying the percent chance to fail for all time slices up to a given point (i.e., this is the cumulative percent chance to fail at this point), and (3) subtracting the cumulative chance to fail from 100 percent to find the percent chance to win.

The following table provides an illustrative example:

| Additive to factorial | Slice number | Winning Tickets | Fail chance this slice | Cumulative fail chance | Cumulative Win % |
|---|---|---|---|---|---|
| 0.00593155 | 1 | 1 | 99.9999% | 99.9999% | 0.0001% |
| 0.0118631 | 2 | 2 | 99.9998% | 99.9997% | 0.0003% |
| 0.01779465 | 3 | 5 | 99.9995% | 99.9992% | 0.0008% |
| 0.0237262 | 4 | 8 | 99.9992% | 99.9984% | 0.0016% |
| 0.02965775 | 5 | 11 | 99.9989% | 99.9973% | 0.0027% |

In the table above, at Time Slice 1 there is 1 winning time ticket. So there are 999,999 chances in 1,000,000 to lose (i.e., 99.9999% chance to lose). As this is the first time slice, 99.999% is also the cumulative percent chance to fail. The chance to win at this point is then 100%-99.9999 or 0.0001%.

Referring now to the table and time slice 2, there are 2 winning tickets, and a 99.9998% chance to lose on this time slice. By multiplying 99.9999% (i.e., the cumulative chance to fail at time slice 1) times 99.9998% (i.e., the cumulative chance to fail at time slice 2), it is determined that there is a 99.997% cumulative percent chance to lose at time slice 2. Correspondingly, this translates into a 0.0003% chance to award the progressive prize at time slice 2.

Referring now to the table and time slice 3, there are 5 winning tickets, and a 99.9995% chance to lose on this time slice. By multiplying 99.9997% (i.e., the cumulative chance to fail at time slice 2) times 99.9995% (i.e., the cumulative chance to fail at time slice 3), it is determined that there is a 99.992% cumulative chance to lose at time slice 3. This correlates with a 0.0008% chance to win at time slice 3.

In a preferred embodiment of the progressive game 10, after the progressive engine 60 has determined that there is a winner for the current time sub-slice, the system then randomly selects a winner of the progressive game using a random number generating algorithm. In one preferred embodiment, a player is eligible to win the progressive prize if they have a player-tracking card inserted in a game machine 50 that is eligible to win that specific progressive prize at the time the progressive prize is selected. For example, if the progressive prize was awarded for all nickel machines on the floor, the progressive game 10 would select a winner randomly from one of the player-tracking cards inserted into any nickel machine on the casino floor. In the case of a progressive game that awards to multiple winners, multiple cards are chosen as winners in accordance with the set-up of the progressive game. In these types of multi-winner progressive games, each player may win an equal share or there may be a range of payouts.

If there are no players playing on eligible gaming machines 50 for a specific progressive game at the time that the progressive game 10 determines there is a win for that progressive game, the progressive prize will be awarded to the next player(s) to insert a player tracking card 54 into an eligible game machine 50. In another preferred embodiment, the progressive prize is deposited into a winning player's account without even requiring the player to be present. In one such embodiment, the winning player is then notified of the deposit by e-mail, regular mail, given on the next visit or over multiple visits, or other known means.

In another preferred embodiment of the progressive game 10, all active players on the floor are eligible to win the progressive prize, not only the player with inserted player tracking cards. In one embodiment, the winning "non-player tracking card" player must use the progressive prize at that winning machine, since the player does not have a player tracking card 54 to associate the winning with that player.

In a preferred embodiment of the progressive game 10, progressive prize is then dispensed to the winning player by crediting the player's eGameCash bucket. As shown in FIG. 5, a player is able to view his or her eGameCash bucket screen 180, as well as other game setup screens 182 and personal account screens 184, typically via the user interface 100 in the progressive processing system 12. In one embodiment, as shown in FIG. 6, these credits in the player's eGameCash bucket can be transferred (as shown on the eGameCash purchase screen 186) to the base game upon request from the player (following PIN entry or some other suitable means of player identification). Additionally, personal account activity screens 188 are also displayed in FIG. 6. Referring now to FIG. 7, a preferred embodiment of the progressive processing system 12 also includes a game selection screen 190, game setup screen 192 for modifying a bingo game, and a personal account display screen 194 that shows both cashable and uncashable funds for a system game in the same display screen. FIG. 8 shows a progressive game 10 displaying the "attract mode" screen 196 on the user interface 100, as well as an "award display" screen 198 that is shown to a player after winning a progressive prize.

In a preferred embodiment of the progressive game 10, the application design of the progressive game includes many various programs. Preferably, such programs include by way of example only and not by way of limitation: a master maintenance program including a graphic user interface, a link maintenance program, a promotion detail maintenance program, a progressive update program, a progressive winner program, a progressive increment override program, a "Pick the Winner" program, and a "create promotion" program (machines and/or player).

The master maintenance program enables data entry for the promotion master file. This program calls the link maintenance program and enables the user to set-up the progressive link. Optionally, the promotion may be started by the promotion detail maintenance program to create the promotion detail file and perform the necessary system calculations. Referring now to the link maintenance program, this program enables users to select a subset of gaming machines 50 for entry into the progressive link file for a particular promotion game. Additionally, the promotion detail maintenance program performs calculations based on information in the promotion master file to determine the trigger amount and trigger date/time, as well as to write this information to the promotion detail file.

Referring now to FIG. 9, in one preferred embodiment, web services are connected to the progressive processing system 12 that enable viewing of the progressive games 10 from any casino, home web browser, cell phone, PDA, and the like. In another preferred embodiment of the time-based progressive game 10, the progressive update program continually updates the current progressive pot value and sends updates to the slot system, and optionally, to a plasma display system. This data can also be fetched from the progressive processing system 12 upon request from any authorized device or server. Further, the progressive update program determines when a trigger time/date has occurred and invokes the progressive winner program. Preferably, the progressive winner program randomly selects a winner from the accounts with an inserted player tracking card 54 at the time the trigger was activated. This program will update the progressive winner file and send notification to the slot system. Finally, the progressive increment override program enables users to override the increment amounts for a promotion. The override is a dollar amount for a user defined date and hour.

In another aspect of a preferred embodiment, the progressive processing system 12 includes a "weighting" option to the random selection of progressive prize winner. Preferably, this weighting option enables the casino to "weight" the odds of a player being selected as the "random winner" of the progressive prize, based on casino defined criteria. In one specific, non-limiting example, this weighting technique initially involves setting every qualified player with a "Base Value" of 100 points. Further, the weighting option incorporates a table in which "casino established rules" are used to add or subtract from the 100 points before the random selection of the winner, thereby changing the odds of a selecting the winner of the progressive prize.

Typical weighting calculation might include, by way of example only, and not by way of limitation: (1) silver carded players receives+50 points, gold carded players receives+100 points, and platinum carded players receives+150 points; (2) extra points are received based on "time played" multiplied by "average bet" for the day (e.g., compensating for a player participating higher denomination games by increasing the weighted winning odds, and compensating for a player that is playing at a slow rate waiting for the progressive to hit by deceasing the weighted winning odds, and the like); and (3) extra points are received based on total bet for the day or average over a number of days.

In one preferred embodiment, the weighting option logic is used to handle a "free chance" that may be required in some locations (to meet some states lottery requirements). In one embodiment, such a weighting option gives players a "free chance" to be awarded a prize when using a kiosk or simply by inserting a patron card into a machine. In another preferred embodiment, a casino may elect to have such a free chance be good for a selected number of minutes, and have a weighting factor that is equal to 1, 10, or the selected number of minutes.

In one specific, non-limiting embodiment, the weighted "points" discussed above appear as drawing tickets in a promotion barrel from which a winner drawn. In such an embodiment, the base players have 100 chances out of X total chances, and gold members have 200 chances out of X total chances, and platinum members have 300 chances out of X total chances. Preferably, the winner selection calculation then use the same logic used for Electronic Quick Draw. These calculations include, by way of example only, and not by way of limitation: (1) place chances in a virtual barrel; (2) total number of chances in the virtual barrel=Y; (3) randomly select number from 1 to Y; (4) if multiple winners being picked, (5) confirm that random number has not been used; (6) check which account/gaming machine is the winner; (7) check casino rules on multiple winners for same account and re-draw if needed; and (8) record winner and process award.

In a preferred embodiment of the time-based progressive game 10, the system database design of the progressive gaming system includes many various data files. In one preferred embodiment, the promotion master file includes the following data: promotion code (primary key), promotion description, start date, start time, targeted progressive trigger value, minimum progressive trigger value, progressive reset value, targeted progressive prize time, minimum progressive prize time, key for progressive link file, stop date, stop time, iVIEW winner broadcast show number, and iVIEW winner asset show number.

In one preferred embodiment, the Slot Management servers and the Casino Marketplace servers maintain promotions (Promotion ID) for groups of players and groups of machines. Each Progressive ID is associated with a specific Promotion ID, typically outside of the server/service of the progressive processing system 12. However, in another preferred embodiment, these systems are all merged.

In one preferred embodiment, the detail promotion file includes the following data: the promotion code, the players, and/or groups of machines included in the promotion. In another preferred embodiment, the progressive increment override file includes the following data: promotion code, hour, day, and override amount. In a preferred embodiment, the progressive winner file includes the following data: promotion code, account number, winner notified (y/n), amount, date, and time. In a preferred embodiment, the progressive link file includes the following data: promotion code and asset number.

Figure 10A:
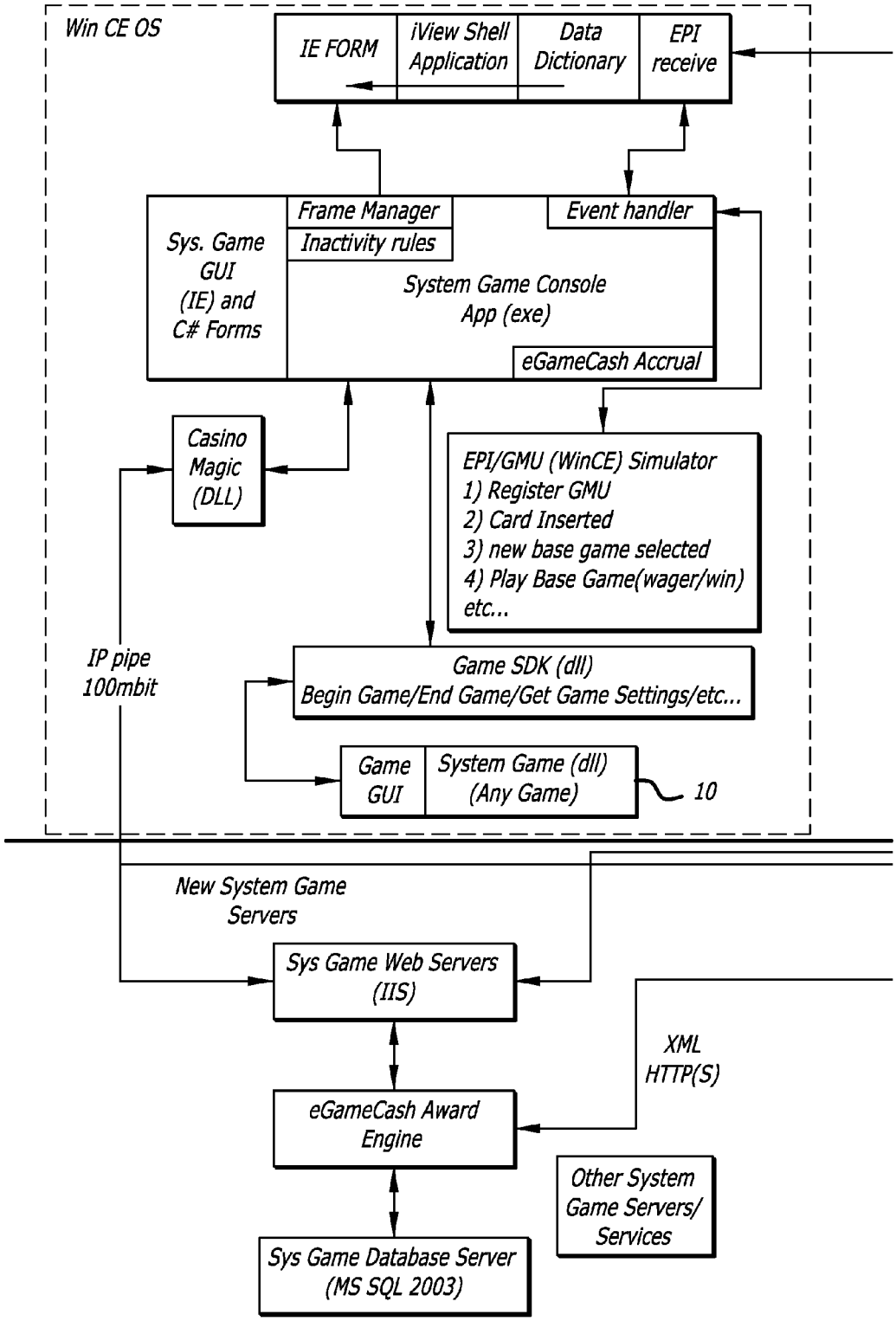
FIGS. 10A and 10B illustrate client side applications/services/hardware, as well as system gaming servers.
Figure 10B:
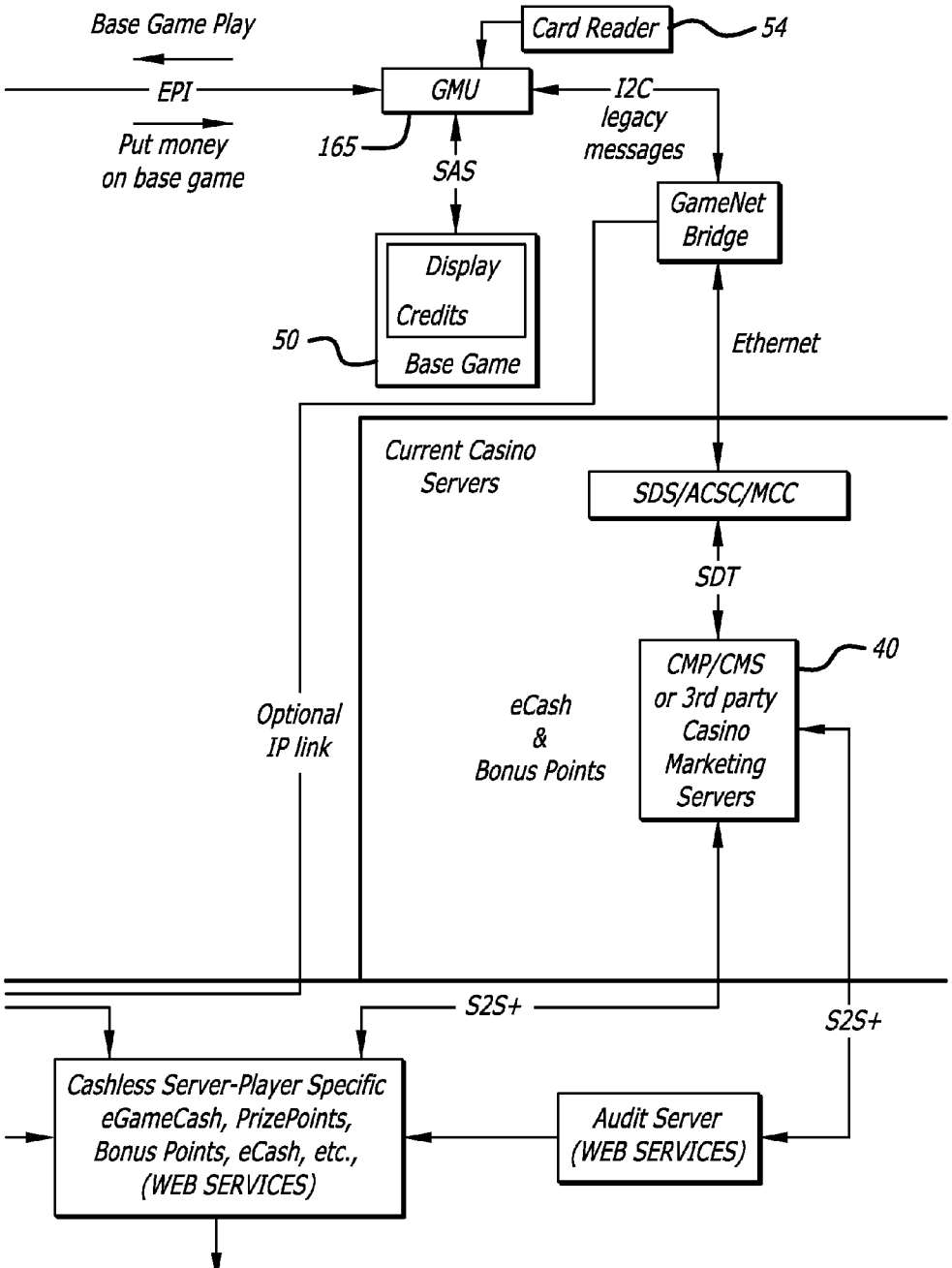

In one preferred embodiment of the progressive processing system 12, an optional way of awarding a progressive prize utilizes reverse mapping. In one such embodiment, the progressive processing system 12 tells a System Gaming Server and Client Side Game Device (e.g., an iVIEW, as shown in FIGS. 10A and B) that a specific player has won a progressive prize. In response, the progressive game 10 running on a gaming device forcefully triggers a specific winning combination in a game (e.g., 777 in a reel spinner, Royal Flush in poker, and the like). The game then starts its win sequence and informs the player that the progressive prize has been won. In other preferred embodiments, other winning combinations are generated from either a central random number generator, a finite pool of prizes, or from a client side random number generator.

In another aspect of a preferred embodiment, the progressive processing system 12 incorporates further promotions in addition to the system game promotions discussed above in which players receive promotional eGameCash with which to play. For example, one promotional progressive may simply be randomly given to a player whenever the progressive processing system 12 determines that it is time for a progressive prize. In this regard, the player may even be in the middle of a normal system game at the time of the award.

In another aspect of a preferred embodiment, the progressive processing system 12 is utilized in conjunction with non-gaming third party promotions. In one example embodiment, a gas station chain has a $1,000,000.00 progressive game 10. In another embodiment, the prize is a non-cash prize (e.g., a new car). When the progressive processing system 12 of the gas station determines that it is time for a progressive prize to be given away, the system may (1) give the award to a person standing in front of a gas pump at that time with a card in the progressive device (e.g., the gas pump), or (2) assign the progressive prize to a player's account number. In another example embodiment, web businesses that incorporate a progressive processing system 12 may use this type of non-gaming third party promotions as a means to draw customers to their site. If a progressive prize occurs while a person is browsing the site of the web business, then the browsing person will win.

In this manner, the progressive processing system 12 is a universal, promotional, progressive engine 60 that can be integrated with almost any business that desires to give something back to patrons. In one embodiment, spending money at the business is required, but in other embodiments, no purchase is required at the business, thereby bypassing sweepstakes issues. In one preferred embodiment, patrons are able to mail in entry forms, and software in the progressive processing system 12 selects a winner from either the mailed in entries or the patrons at the business at the progressive award time.

In another aspect of a preferred embodiment, the progressive processing system 12 incorporates overhead video displays that show data including, by way of example only, and not by way of limitation, current progressive values, targeted progressive size, targeted win time, start time, actual winners, information revealing that a progressive prize is about to be given, player qualification rules, or combinations thereof. These overhead video displays include, by way of example only, and not by way of limitation, plasma displays, liquid crystal displays, cathode ray tube displays, digital light processing displays, video projectors, or other similar technology. Further, in one preferred embodiment, overhead video displays that present data from multiple progressive games 10, and from multiple facilities, thereby facilitating player interaction with other property locations as well.

In yet another aspect of a preferred embodiment, the progressive processing system 12 can be configured to prevent a progressive prize win during certain time periods (e.g., preventing a progressive prize from being awarded at a certain time period during the day). Additionally, the progressive processing system 12 enables the opportunity to win a progressive prize to be turned off by an administrator at any time. In some preferred embodiments, the awarding of the progressive prize is automatically reoccurring after each progressive prize is awarded. Further, in some embodiments, a delay is inserted after the awarding of a progressive prize and before the beginning of the next automatically reoccurring progressive prize.

In still another aspect of a preferred embodiment, the award process includes payment techniques that include, by way of example only, and not by way of limitation, hand-paying a winner; using EFT (electronic funds transfer) to transfer the award to a base game upon a player selecting to redeem the award at the base game; using AFT (advanced funds transfer) to transfer the award to a base game upon a player selecting to redeem the award at the base game; using other approved funds transfer protocols to the gaming devices; sending the award to a player account bucket; enabling the award to be collected at a cashier cage; mailing the award to the winner; placing the award in the player's private banking account; and placing the award as a credit on the player's credit card, debit card, player club account, or other financial account.

In another preferred embodiment, the progressive processing system 12 utilizes progressive identifiers that enable the opportunity to win a progressive prize to be activated from a remote server. Preferably, the progressive identifier is created using required data that is supplied through XML messaging or by using a management screen. The data required to generate a progressive identifier includes, by way of example only, and not by way of limitation: desired progressive value data, desire progressive win time data, progressive reset value data, maximum progressive value data, desired start time of the progressive data, whether the progressive auto-restarts after a win, how many times the progressive repeats, whether any enticement factors are utilized, progressive payout curve data, maximum progressive prize value data, desired start time of the progressive data, selectable progressive auto-restarts after a win, selectable number of progressive repeats, enticement factors data, and progressive payout curve data.

In one preferred embodiment of a progressive game 10 the administrator sets (1) the "actual" progressive prize value that will be awarded and (2) the targeted progressive prize time at which the progressive prize is to be awarded. In this embodiment, the progressive game 10 will be awarded at a random time that is calculated around the targeted progressive prize time entered by the administrator.

Alternately, in another preferred embodiment of a progressive game 10 the administrator sets (1) the targeted progressive prize value to be awarded and (2) the "actual" progressive prize time at which the progressive prize will be awarded. In such an embodiment, the progressive prize value grows to a random number calculated using the targeted progressive prize value. The awarding of the progressive prize is then compelled at the "actual" progressive prize time entered by the administrator. Clearly, in such an embodiment, the "actual" progressive prize time must be kept highly confidential.

Moreover, in a preferred embodiment, a progressive prize from the progressive processing system 12 is able to trigger additional events or promotions in the casino (e.g., consolation prizes, a $10 prize to each carded player now playing, and the like). Therefore, the progressive processing system 12 can be utilized as a promotions prize control engine that controls frequency at which promotional prizes (but progressive and non-progressive) are awarded based upon time.

In one preferred embodiment, the promotional progressive system 12 (PPS) is a service that runs on a server and performs backend processing for progressive game 10, provides various devices on a casino floor with information to display, and notifies other servers when a progressive prize event occurs and needs to be awarded to a winner. In some preferred embodiments, other servers are utilized to select one or more winners of the progressive prize to be awarded. In other preferred embodiments, the winner selection functionalities are integrated with the rest of the progressive game 10 functionalities in the promotional progressive system 12.

Preferably, the progressive processing system 12 (i.e., where the progressive processing service is performed) also incorporates devices such as signage that display the current progressive prize value on a casino floor (e.g., modern COOL SIGNS type devices, legacy Player Tracking Displays, iVIEWs, and the like). Additionally, a preferred embodiment of the promotional progressive system 12 also incorporates a Slot Management System (or other type of casino floor management system) that provides floor statistics that enable a progressive game 10 to run, as well as perform a redemption function (i.e., select a progressive winner and award the progressive prize to the winner). Further, a preferred embodiment of the progressive processing system 12 also incorporates a Web interface, as shown in FIG. 9. Preferably, the Web interface resides on a separate server and provides administration of the progressive processing system 12, as well as reporting through the World Wide Web.

In a preferred embodiment, a Web Interface is utilized to create and manage a progressive game 10 from a remote location. Additionally, in a preferred embodiment, the Web Interface enables enhanced reporting capabilities including, by way of example only, and not by way of limitation: the ability to lookup specific Program Identifier status and details, the ability to generate a report on a specific progressive over a time period, the ability to generate a report on multiple progressive games 10 for the same casino over a selected time period, the ability to generate ad-hoc queries to provide support for business decisions (e.g., targeted progressive prize value, targeted progressive prize time, effective grouping of slot machines and/or carded players, and the like).

The following table shows the messages that are communicated between the progressive processing system 12 and other devices. As referenced below, a Program Identifier (ProgID) is a unique identifier for progressive game 10 on the promotional progressive system 12. As such, other servers and processes are able to reference a specific progressive game 10 using the associated ProgID.

TABLE 1

| | SMS | Signage | Web Interface |
|---|---|---|---|
| To PPS | Create ProgID<br>Get ProgID meter<br>Check ProgID win<br>Post Floor Statistic<br>Notify ProgID win redemption | | Create ProgID<br>Admin ProgID<br>Check ProgID status<br>Reports |
| From PPS | Get Floor Statistic<br>Notify ProgID win | Add/Remove ProgID<br>Update ProgID meter<br>Notify ProgID win | |

TABLE 2

| Message Name | From | To | Description | Request Data | Reply Data |
|---|---|---|---|---|---|
| Create ProgID | SMS | PPS | SMS creates progressive game on PPS (total the average progressive $ win value, progressive reset value in $, average length of time for a progressive to run, scheduling data for a progressive). Normally, setup happens through the web interface. | All game data | ProgID<br>Error Codes |
| Get ProgID meter | SMS | PPS | SMS requests current meter value for ProgID | ProgID | ProgID<br>Meter Value<br>Error Codes |
| Check ProgID win | SMS | PPS | SMS checks if ProgID is won. If yes, it had been stopped by PPS. | ProgID | Won (yes/ no)<br>Meter Value<br>Error Codes |

TABLE 2-continued

| Message Name | From | To | Description | Request Data | Reply Data |
|---|---|---|---|---|---|
| Post Floor Statistic | SMS | PPS | For game to function correctly, it needs some timely floor statistic for a certain period of time (15 min) like<br>Number of carded players active or<br>Number of un-carded players active or<br>Total $ spent for each group (ProgID) and the like. | ProgID<br>StatName<br>StatValue | Error Codes |
| Notify ProgID win redemp-tion | SMS | PPS | When ProgID is won, SMS/CMP has to perform some processing to determine the winner and after that is done, it will notify PPS, so the ProgID is closed and that PPS can notify Signage to display a winning sequence: create excitement, do winner's recognition, display amount won, and the like. | ProgID<br>Winner's data (if any) | Error Codes |
| Get Floor Statistic | PPS | SMS | This is a request for "Post Floor Statistic" message. Depending on implementation, we can have PPS send this request to SMS or have SMS do "Post Floor Statistic" on agreed periods of time | ProgID | ProgID<br>StatName<br>StatValue<br>Error Codes |
| Notify ProgID win | PPS | SMS | This is an unsolicited "Check ProgID win" reply. It tells SMS/CMP that a ProgID win happened. Depending on implementation, we can have PPS notify SMS when ProgID is won | ProgID<br>Meter Value | Error Codes |

In a preferred embodiment, these messages originate from the progressive processing system 12.

TABLE 3

| Message Name | Description | Request Data | Reply Data |
|---|---|---|---|
| Add/ Remove ProgID | PPS will register or un-register a ProgID with Signage. A proper assignment of displays on a casino floor to a ProgID and to specific video content will be done at the Signage Network Controller. | ProgID<br>ProgName<br>Action(add/ remove) | Error Codes |
| Update ProgID meter | PPS will notify Signage in a timely manner about current meter value of ProgID. | ProgID<br>Meter value | Error Codes |
| Notify ProgID win | PPS will notify Signage when ProgID is won. This will happen after PPS gets a notification from SMS that ProgID redemption is completed. Signage will then perform winner's recognition, create excitement around the win, and the like. | ProgID<br>Meter Value<br>Winner's data (if any) | Error Codes |

A preferred embodiment of the progressive processing system 12 generates a progressive game 10 that is managed by the casino and can be offered to multiple customers. Preferably, a progressive game 10 uses a variety of criteria to determine player eligibility and winner selection on multiple slot machines. These features include, by way of example only, and not by way of limitation: (1) promotional progressive games focused on carded play only (i.e., game play by players that are using player tracking cards 54); (2) progressive games in which progressive contributions offer reset amounts, minimum/maximum levels, and a variety of methods for progression; (3) progressive games in which progressive prize growth rate is not generated based on direct or indirect gaming activity (e.g., the progressive prize increases based on a pre-determined rate that varies by day, dates, or time according to casino's decision on progression rates); (4) progressive games in which multiple progressives are overlapping; (5) progressive games that include a secondary reset amount; (6) progressive games in which the awarding of a progressive prize is based on a randomly selected point in the progressive prize value growth, or a randomly selected progressive prize time within a range; (7) progressive games in which a progressive prize winner is be selected from a specific group of players, all carded players, or other criteria (e.g., players with a minimum of 50 points in last 24 hours and still actively playing or customers playing more that $20 in "coin in" for the last hour); (8) progressive games in which the winner selection is performed using either selected player/account or slot machine location (also multiple card accounts, such as spouses sharing accounts); (9) progressive games in which signage and graphics are utilized for a promotion); (10) progressive games that are either isolated to a specific casino or operate over multiple properties; and (11) progressive games in which lotteries are incorporated (e.g., one swipe or entry a day translates into one minute of qualified play and a chance to win if a winner is selected during that time period).

In one preferred embodiment, the progressive game 10 is a floor-wide progressive game that is player-centric rather than game-centric. Preferably, there are no protocol or other requirements for slot machines to be eligible to participate in the progressive game 10. In a preferred embodiment, participation is based on casino-selected criteria that designates what types of eligible carded player activity contribute to increasing of the progressive prize. Preferably, the progressive prize values and other promotion status messages are displayed on video display signage throughout the casino, as well as being sent to the gaming machines as directed messages.

In one preferred embodiment, the progressive processing system 12 enables multiple progressive promotions or flat payout promotions that could run simultaneously. For example, the progressive processing system 12 enables a casino to have a four level progressive game with smaller progressive prizes hitting more frequently, thereby enabling each of the four to be configured separately using separate criteria. Preferably, in this type of tiered progressive game, these qualifiers are consistent to make it easier for players to understand the multi-tiered game.

In still another preferred embodiment of the progressive processing system 12, the progressive prize value is hidden from the players. In such an embodiment, a surprise award amount is given to the players when the progressive processing system 12 determines that the award has occurred.

In yet another preferred embodiment of a progressive processing system 10, the progressive prize is awarded directly out of the gaming device by printing a cash or prizepoint voucher. In such a preferred embodiment, the game monitoring unit enables direct printing to dual port printers (e.g., one for the base game and one for system printing).

One preferred embodiment of a progressive game 10 is the chain reaction progressive game. In the chain reaction progressive game, an incrementing rate is created for multiple progressives or flat amounts. In a preferred embodiment, a casino administrator selects a progressive prize growth rate, which can vary based on numerous criteria. Preferably, the chain reaction progressive game enables multiple promotional progressive games to be played while overlapping each other. In a preferred embodiment, game information is sent to displays throughout the casino to further encourage player excitement. Preferably, a casino administrator selects the game parameters, and the progressive prizes are awarded at random progressive prize values and/or random progressive prize times within a "time for a winner" parameter set by the casino. Finally, when a progressive prize is to be awarded, the winner is selected from active players on the casino floor that match "select a winner" parameters, as set by the casino.

Figure 11:
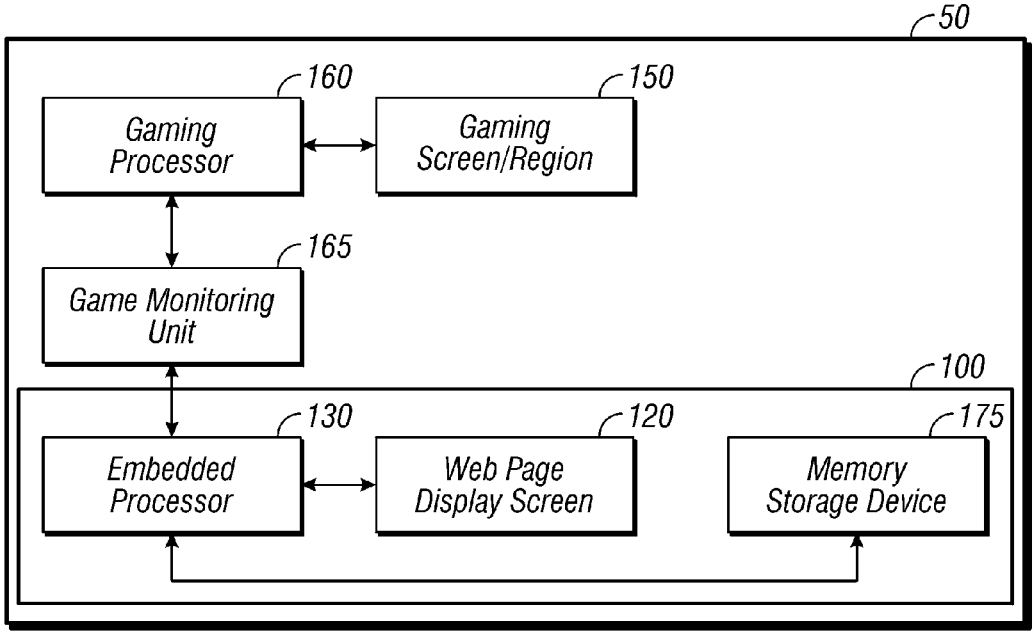
FIG. 11 illustrates a relational diagram of an embedded additional user interface utilizing a web page display screen and an embedded processor that receives data messages from a game monitoring unit that are translated into web page content and mapped to the web page display screen.

Referring now to one specific, non-limiting, embodiment of a user interface 100 shown in FIG. 11, an iView-type device is described herein in greater detail. The user interface 100 is sometimes referred to herein as "additional" in that the user interface is preferably separate from the gaming screen (or other gaming presentation). Further, the user interface is sometimes referred to herein as "embedded" in that the user interface preferably includes its own processor in some preferred embodiments. The functionality of the user interface includes, by way of example only, and not by way of limitation, the ability to display animation, multimedia, and other web-type content. The embedded additional user interface 100 enables presentation of additional information (e.g., enhanced player information) to a player (or potential player) through the web page display screen 120 in an exciting, eye-catching format, while not interfering with the normal gaming processes being displayed on the gaming screen 150. Further, the embedded additional user interface 100 does not interfere with the normal gaming hardware in the gaming machine 50, but rather is easily integrated into a gaming machine 50.

In situations involving multiple gaming machine (or gaming component) manufactures, an embedded additional user interface 100 can be incorporated into a game machine 50 (either originally or by retrofitting) without requiring access to the game logic or other gaming systems that might be proprietary and inaccessible with a game machine 50 from another gaming manufacturer. Thus, in a preferred embodiment, the embedded additional user interface 100, which includes a web page display screen 120 for presenting supplementary information to a player, is incorporated into a gaming machine 50 in addition to the standard gaming screen 150 typically found in a gaming machine. The embedded additional user interface 100 may also be incorporated into a gaming machine 50 that utilizes a gaming region (e.g., a reel-spinner) instead of a standard game machine 50. This supplemental information may include general gaming information, player specific information, player excitement and interest captivation content, advertising content (targeted or otherwise), and the like. Further, in other preferred embodiments, the embedded additional user interface 100 may have the ability to interact with the game logic of the gaming processor 160, and thus, provide further functionality, such as bonus games and/or the ability to incorporate awards, promotional offers, or gifts from the web page display screen 120 to the game machine 50. Moreover, the web page display screen 120 may display supplemental information in "attract mode" when there is no game play occurring.

In a preferred embodiment, the embedded additional user interface 100 is used to make casino services more accessible and friendly to casino patrons. In one preferred embodiment, the embedded additional user interface 100 is designed to interface with the hardware configuration of game platforms currently employed in an existing gaming communication systems network, thus decreasing implementation costs for the casino. A standard gaming network interface to the systems network, such as a Mastercom system, includes a multidrop bus method of communicating to a keypad and display. The Mastercom system is available from Bally Manufacturing, and is described in U.S. Pat. No. 5,429,361 to Raven et al. incorporated herein by reference. One such currently utilized bus is an EPI bus (Enhanced Player Interface bus), which uses industry standard I2C hardware and signaling.

In one preferred embodiment, the embedded additional user interface 100 is used to replace/upgrade an EPI device. Preferably, the embedded additional user interface 100 replaces the EPI device in the game machine 50 in a "plug and play" manner. In other words, the old EPI device can be unplugged from the bus and the new embedded additional user interface 100 can simply be plugged into the I2C bus of the gaming machine 50, where the user interface 100 utilizes the currently employed industry standard I2C hardware and signaling without requiring any further modification. The embedded processor 130 of the embedded additional user interface 100 reads incoming I2C data (content), translates the data into a web authoring language (e.g., HTML, DHTML, XML, MACROMEDIA FLASH, animated Gifs, and JAVA Applets), and maps the data to the web page display screen 120. In this manner, the previous I2C data messages, which were typically presented on a two-line, twenty character VF display, are automatically transformed by the embedded additional user interface 100 into an attention grabbing, animated (multimedia) web page style format. This results in enhanced player satisfaction and excitement with extremely minimal retrofitting requirements.

Since, in one preferred embodiment, the embedded additional user interface 100 utilizes I2C hardware and signaling, this enables the user interface 100 to speak and understand the I2C protocol message set, and thus, communicate directly with the gaming processor 160 of the gaming machine 50 (or other networked devices) in the same fashion in which the gaming processor previously communicated with the EPI device. Accordingly, in a preferred embodiment, the functionality of the previously utilized hardware (e.g., the EPI device) is replaced and substantially upgraded with the integration of the embedded additional user interface 100 into the gaming machine 50. As such, the external hardware of any such system components (e.g., a keypad and a two-line, twenty character VF display) is eliminated.

As stated above, in one preferred embodiment, the incoming data received by the embedded additional user interface 100 is I2C signaling protocol; however, in other preferred embodiments other serial communication protocols (or electronic communication format) are utilized. Preferably, the embedded processor 130 communicates with the gaming processor 160, and/or other connected devices, over an I2C bus (or over another serial communications bus in embodiments that utilize another protocol). The web page display screen 120 of the embedded additional user interface 100 is preferably a color-graphic touch screen display. Preferably, the embedded processor 130 is at least a 32-bit processor. A preferred embodiment utilizes a 32-bit processor because cryptographic techniques, such as SHA-1 and DSA algorithms, are written and operate natively on a 32-bit system. Additionally, the Microsoft® Windows® environment, which is utilized in some preferred embodiments is also 32-bit. Further, the internal operating system of the embedded additional user interface 100 is preferably customized to match the specific hardware to which the internal operating system attaches.

Preferably, the embedded additional user interface 100 is an embedded computer board that, in addition to the embedded processor 130 and the web page display screen 120, further includes a removable COMPACT FLASH card 175 (or other memory storage device), as shown in FIG. 11, and a network adapter port. Content and feature updates to the embedded additional user interface 100 are accomplished by physically swapping out the COMPACT FLASH card 175 (or other memory storage device). Thus, in order to retrieve data from the embedded additional user interface 100, the data is accessed by physically removing and reading the COMPACT FLASH card 175.

In one preferred embodiment, the internal operating system utilized by the embedded processor 130 of the embedded additional user interface 100 is WINDOWS® CE version 4.2 (or higher). Preferably, the embedded additional user interface 100 is built upon a PXA255-based board developed by the Kontron Corporation. Additionally, in a preferred embodiment of the embedded additional user interface 100, the browser control for the web page display screen 120 is MICROSOFT® INTERNET EXPLORER® 6.0 (or higher), which is shipped standard with WINDOWS® CE 4.2, the preferred internal operating system for the embedded processor 130.

Figure 12:
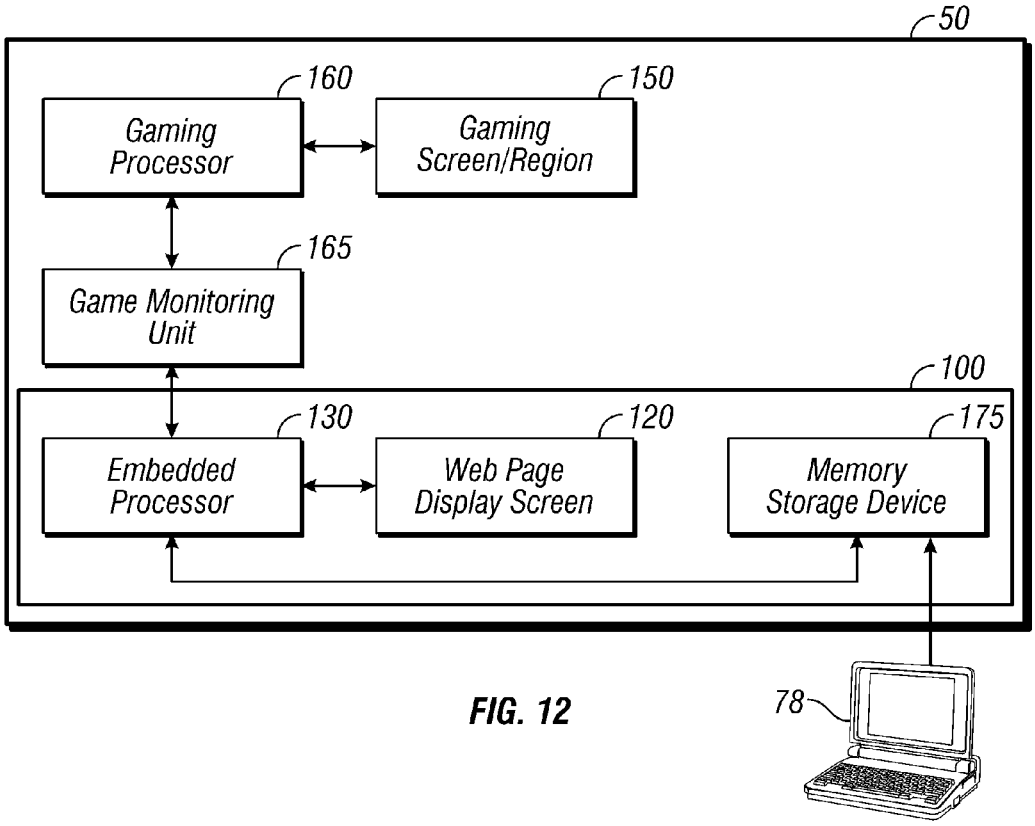
FIG. 12 illustrates a relational diagram of an embedded additional user interface utilizing a web page display screen and an embedded processor that receives cryptographically certified web page content from a portable computer via a network adapter port.

Referring now to FIG. 12, in this preferred embodiment, content may be locally downloaded. Specifically, in one preferred embodiment, the content is updated through a physical USB (or other connection) that is used to download the new content. In one preferred embodiment, the data on the COMPACT FLASH card 175 can be accessed by connecting a separate computer 178 to the network adapter port of the embedded additional user interface 100. This embodiment allows updating the contents of the operating system, changing the operating system itself, and receiving data from the COMPACT FLASH card 175. Physical removal of the COMPACT FLASH card 175 is also still an option for update and inspection of files on the embedded additional user interface 100.

In one preferred embodiment, a portable computer is used to store and publish data content to the COMPACT FLASH card 175 on the embedded additional user interface 10, as well as to receiving data from the COMPACT FLASH card 175 on the embedded additional user interface. In this embodiment, all content on the embedded additional user interface 100 is authenticated as if it were a gaming machine.

In another preferred embodiment, a network adapter port is run on the embedded computer board of the user interface 100. This embodiment also includes a boot loader. Further, in this embodiment, the portable computer 178 (described above) includes components for use in uploading data to, and downloading data from, the COMPACT FLASH card 175 on the embedded additional user interface 100. Specifically, the components that run on the portable computer 178 are for moving new data content to the embedded additional user interface 100, and for validation and verification of the data content that is on the embedded additional user interface. Preferably, all data that is used to update the COMPACT FLASH card 175 moves to or from the embedded additional user interface 100 over the single built in network adapter port on the board.

Prior to the advent of the embedded additional user interface 100, gaming regulators would have been unwilling to allow casino administrators to design their own content. However, due to the cryptographic technology implemented by the embedded processor 30 in the embedded additional user interface 100, a certification process is provided with sufficient security for gaming regulators to allow casino administrators to design their own content. Specifically, in one preferred embodiment, the certification process offered ensures authentication and non-repudiation of the casino administrator designed web content. Preferably, the certification process provided further ensures auditability and traceability. Various cryptographic technologies, such as authentication and non-repudiation (described herein below), are utilized in preferred embodiments, to provide sufficient security for gaming regulators to allow casino administrators to design their own content.

In one preferred embodiment, this certification process is used to certify "signed content" (created by the casino owners) in the same manner that a "signed program" is certified. Preferably, PKI (Public Key Infrastructure) is utilized in the certification process. PKI is a system of digital certificates, Certificate Authorities, and other registration authorities that verify authenticity and validity. In one preferred embodiment, a "new tier" or second PKI is created that is rooted in the primary PKI and that leverages the capabilities of the certificate (e.g., a x509 certificate) that allow for limited access. Thus, this preferred embodiment allows the attributes within the certificate to be used to provide "levels" of code access and acceptance in the gaming industry.

In one embodiment, the content is protected by digital signature verification using DSA (Digital Signature Algorithm) or RSA (Rivest-Shamir-Adleman) technology. In this regard, the content is preferably protected using digital signature verification so that any unauthorized changes are easily identifiable. A digital signature is the digital equivalent of a handwritten signature in that it binds an individual's identity to a piece of information. A digital signature scheme typically consists of a signature creation algorithm and an associated verification algorithm. The digital signature creation algorithm is used to produce a digital signature. The digital signature verification algorithm is used to verify that a digital signature is authentic (i.e., that it was indeed created by the specified entity). In another embodiment, the content is protected using other suitable technology.

In one preferred embodiment, a Secure Hash Function-1 (SHA-1) is used to compute a 160-bit hash value from the data content or firmware contents. This 160-bit hash value, which is also called an abbreviated bit string, is then processed to create a signature of the game data using a one-way, private signature key technique, called Digital Signature Algorithm (DSA). The DSA uses a private key of a private key/public key pair, and randomly or pseudo-randomly generated integers, to produce a 320-bit signature of the 160-bit hash value of the data content or firmware contents. This signature is stored in the database in addition to the identification number.

Another preferred embodiment utilizes a Message Authentication Code (MAC). A Message Authentication Code is a specific type of message digest in which a secret key is included as part of the fingerprint. Whereas a normal digest consists of a hash (data), the MAC consists of a hash (key+data). Thus, a MAC is a bit string that is a function of both data (either plaintext or ciphertext) and a secret key. A Message Authentication Code is attached to data in order to allow data authentication. Further, a MAC may be used to simultaneously verify both the data integrity and the authenticity of a message. Typically, a Message Authentication Code (MAC) is a one-way hash function that takes as input both a symmetric key and some data. A symmetric-key algorithm is an algorithm for cryptography that uses the same cryptographic key to encrypt and decrypt the message.

A Message Authentication Code can be generated faster than using digital signature verification technology; however, a Message Authentication Code is not as robust as digital signature verification technology. Thus, when speed of processing is critical the use of a Message Authentication Code provides an advantage, because it can be created and stored more rapidly than digital signature verification technology.

In one preferred embodiment, the authentication technique utilized is a bKey (electronic key) device. A bKey is an electronic identifier that is tied to a particular individual. In this manner, any adding, accessing, or modification of content that is made using a bKey for authentication is linked to the specific individual to which that bKey is associated. Accordingly, an audit trail is thereby established for regulators and/or other entities that require this kind of data or system authentication.

Figure 13:
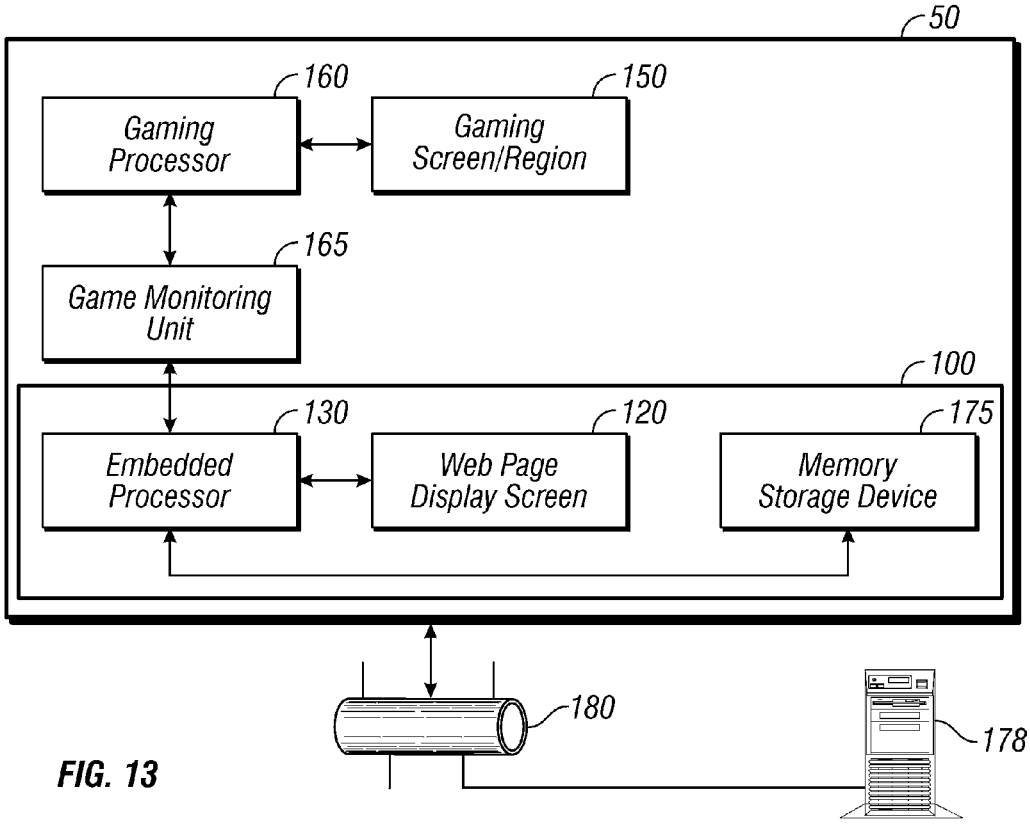
FIG. 13 illustrates a relational diagram of an embedded additional user interface utilizing a web page display screen and an embedded processor that receives web page content from a back-end server via an Ethernet-networked backbone.

Referring now to FIG. 13, in one preferred embodiment, the embedded additional user interface 100 connects to an Ethernet-networked backbone 180 instead of a local system network. Currently, casino networks are not Ethernet, but rather are smaller, more simplistic local system networks. Thus, in this Ethernet-networked backbone 180 embodiment, the current system network is replaced by an industry standard Ethernet backbone, such as 10/100 base T Ethernet running over Cat 3, 4, 5, 6, or higher. Thus, a standard 10/100 base T Ethernet card is added to the processor in this embodiment. Preferably, the network employs TCP/IP, HTTP, and XML messaging or a variant of XML. Nevertheless any suitable protocol may be used.

Further, in another preferred embodiment, the embedded additional user interface 100 connects to a full featured, back end, download configuration server 190 through the above-described Ethernet-networked backbone 180 as shown in FIG. 13. In such an embodiment, the full-featured server 190 can schedule downloads of content (gaming or otherwise) as well as upload information from the gaming machines 50, such as what options the gaming machines 50 currently possess. Accordingly, in a preferred embodiment, the primary use of the server 190 is as a data download and data retrieval server. While this server 190 does upload and download web content style information, it is typically not connected to the World Wide Web. This server 190 must be authenticated (just like a game machine 50) to make the content served to the embedded additional user interface 100 acceptable to the gaming regulators. Preferably, utilization of the Ethernet-networked backbone 180 and the server 190 provides many system benefits, including but not limited to reliability, maintainability, security, content staging, content testing, deployment procedures, and incident recovery. In one embodiment, deliverables also preferably include content templates and guidelines for casino owners and administrators to create their own web content for deployment to the web server. In one embodiment, the web server 190 has its content authenticated in the same manner as the embedded additional user interface 100 to allow content to be downloaded to the web page display screen 120.

Figure 14:
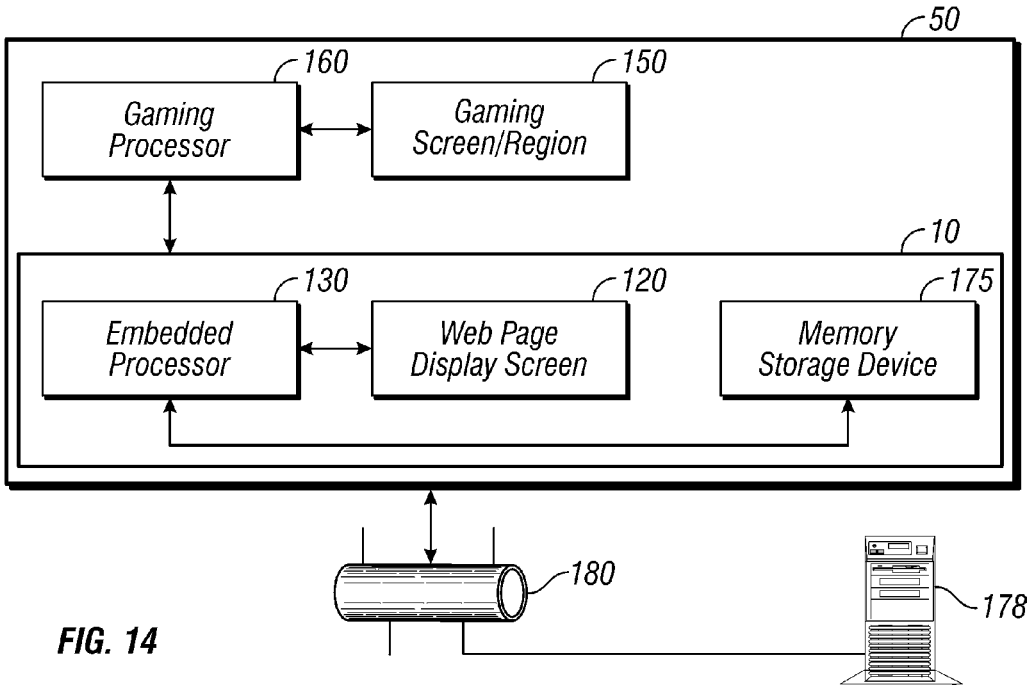
FIG. 14 illustrates a relational diagram of an embedded additional user interface utilizing a web page display screen and an embedded processor that includes the functionality of a standard gaming processor.

Referring now to FIG. 14, in another preferred embodiment, the functions previously performed by the gaming monitoring unit 165, as shown in FIGS. 11-13, of the gaming machine 50 are supported by the embedded processor 130 of the embedded additional user interface 100. Otherwise stated, the GMU code is transitioned from the gaming monitoring unit 165 into the embedded processor 130 in the embedded additional user interface 100. Accordingly, such a configuration removes the need for the gaming monitoring unit 165 in the gaming machine 50. This results in a significant reduction in the amount and complexity of the hardware, as well as completing a phased transition of more traditional style gaming machines 50 into more modernized upgraded gaming machines.

Thus, such a preferred embodiment is directed towards an embedded additional user interface 100 that is incorporated into a gaming machine 50, the gaming machine in turn including a game machine 150 or other appropriate gaming region (e.g., spinning reels), but does not include a gaming monitoring unit 165. Such an embedded additional user interface 100 still includes a web content capable display screen 120 and an embedded processor 130. Once again, the web content capable display screen 120 presents web information to a user via the display screen. The embedded processor 130 preferably utilizes an internal operating system. Furthermore, in this embodiment the embedded processor 130 additionally includes standard gaming monitoring unit functionality (GMU code), since it replaces the gaming monitoring unit 165 in the gaming machine 50. As before, the embedded processor 130 reads incoming data, translates the data into a web protocol (web authoring language), if necessary, and maps the data to the web content capable display screen 120.

In a preferred embodiment, information can also be input by a user into the web page display screen 120 of the user interface 100. The web page display screen 120 of the user interface 100 employs a virtual keypad. Further, the user interface 100 uses a keypad dictionary that allows a user to be able to enter a vastly greater amount of information than was previously possible using a twelve-digit VF keypad. For example, the virtual key on the touch screen that is displayed by the browser is pressed by a user. This calls the Keypad object by calling its Dispatch interface with a string that identifies which virtual key was pressed. The Keypad object looks up the string in the Dictionary object that has been loaded at initialization time with a set of keys to return when that string is passed to it. When it retrieves this set of zero or more key characters, it passes them to the GMU by calling the interface exposed by the object.

Typically, a network interface (or equivalent system) is used to control the flow of funds used with the gaming machine 50 within a particular casino. By utilizing the embedded additional user interface 100, the gaming network interface can be instructed to move funds between player's accounts and gaming devices by merely touching the web page display screen 120. In addition, many other more sophisticated commands and instructions may be provided. Thus, the embedded additional user interface 100 improves the player and casino employee interface to the gaming machine 50, directly at the gaming device itself.

In a preferred embodiment, the web page display screen 120 of the embedded additional user interface 100 enables a player to be shown player messages in an animated, multimedia, web content style environment. These messages would previously have been displayed in a significantly more mundane format on a separate display device (e.g., a two-line VF display device). In some preferred embodiments, touch screen buttons in the web page display screen 120 are used by the player to navigate between windows in web page display screen 120 and allow access to system functions such as cashless withdraw, balance requests, system requests, points redemption, and the like. In other preferred embodiments, the web page display screen 120 utilizes various other data input techniques commonly known in the art, instead of the touch screen data entry. Thus, implementation of the embedded additional user interface 100 is an efficient, highly beneficial, and substantial upgrade to a gaming machine 50 that greatly increases the functionality over what was previously possible using an EPI device.

In one preferred embodiment, text data messages are translated into web page navigation requests by the embedded processor 130 and then displayed on the web page display screen 120 as shown and discussed with respect to FIGS. 15A and 15B below. Script languages, such as JAVA SCRIPT and VB SCRIPT, are also utilized for some of the web pages. Preferably, the embedded additional user interface 100 emulates the twelve-digit keypad and the two-by-twenty VF display on the web page display screen 120, which has touch screen capabilities. In this embodiment, commands that were previously displayed on the two-by-twenty VF display are matched to a corresponding URL and a browser is used to render the page on the web page display screen 120. The web pages displayed contain touch-screen keys that effectively emulate hardware keys.

Figure 15A:
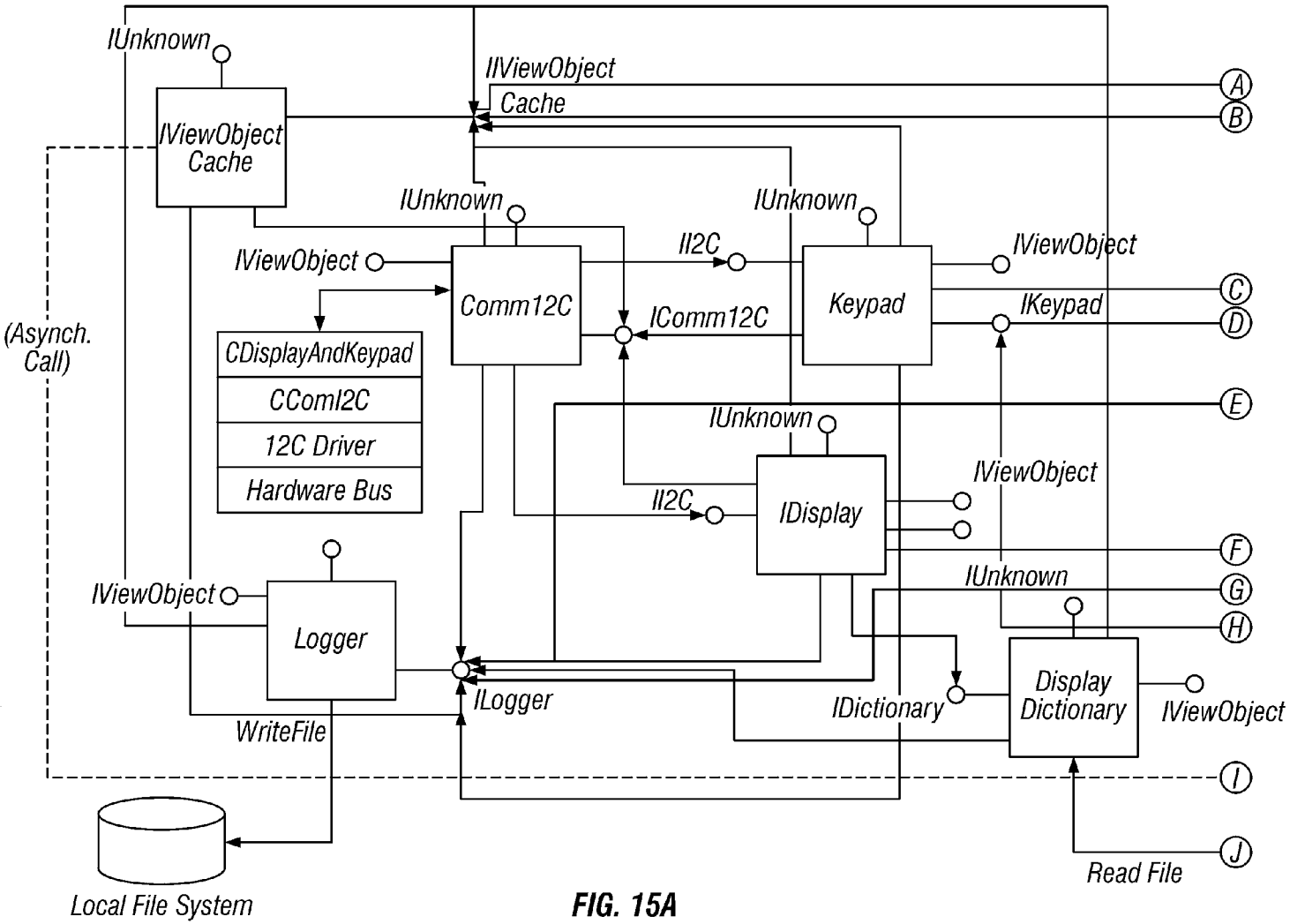
FIGS. 15A and 15B are each partial views of a diagram that illustrates an object interaction diagram of an embedded additional user interface.
Figure 15B:
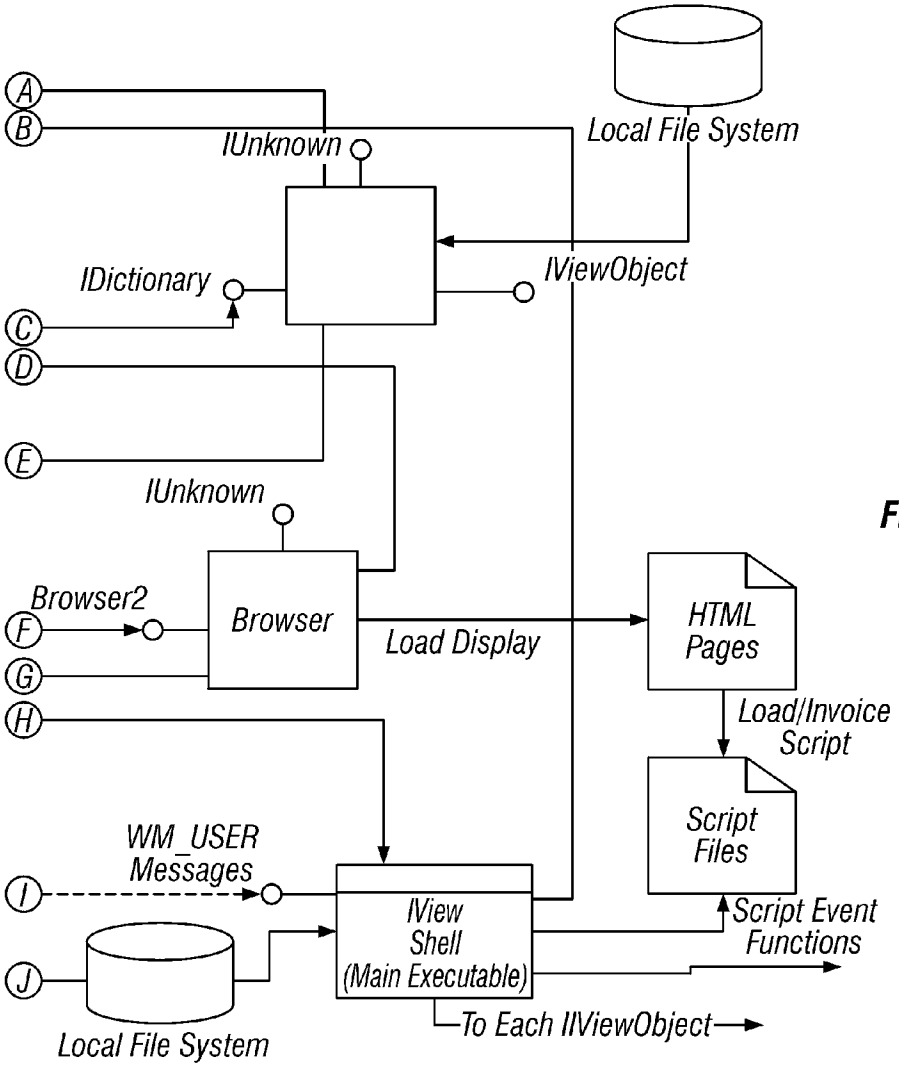
Figure 16:
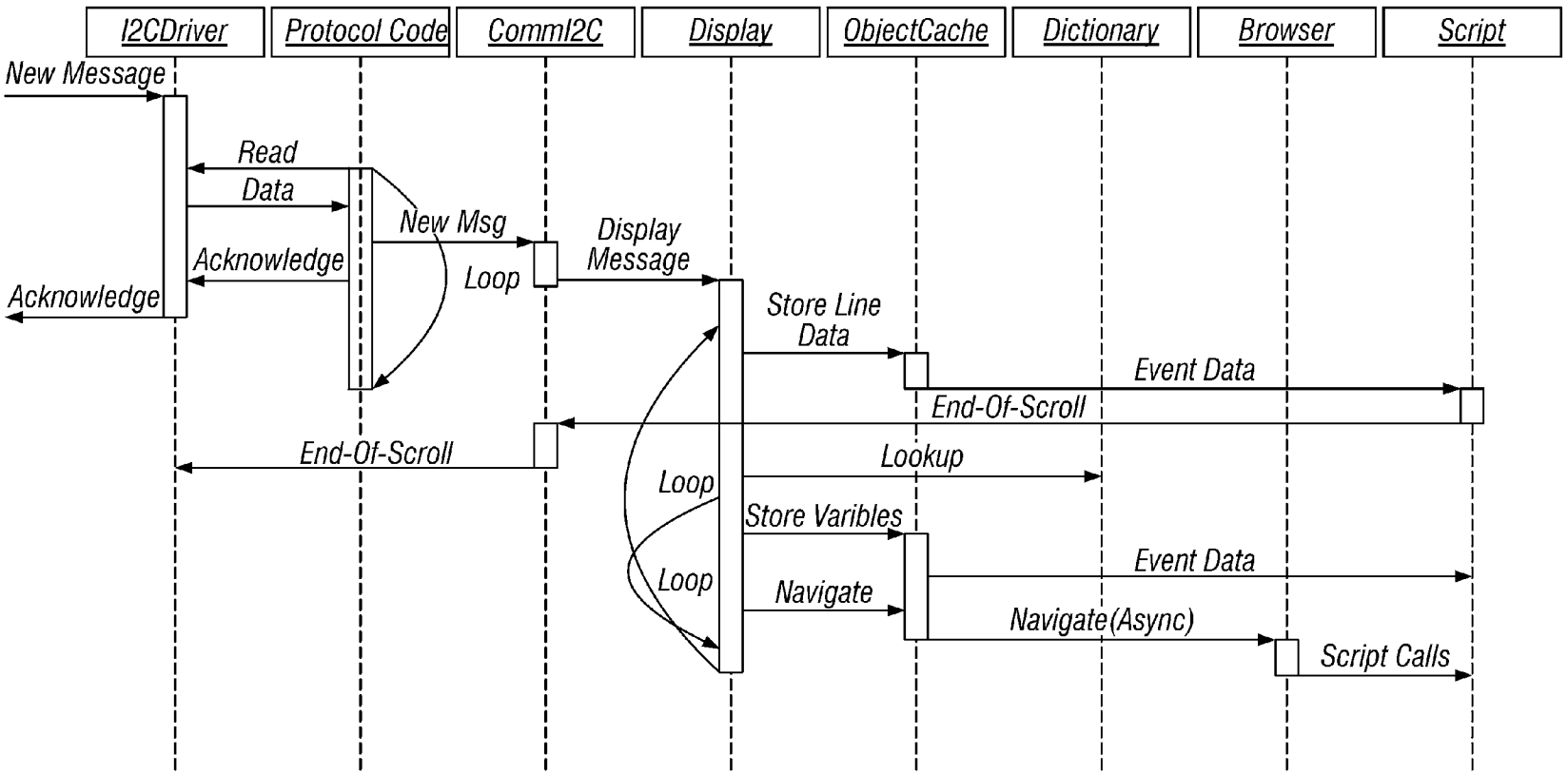
FIG. 16 is a diagram showing the sequence of events that occur when data is sent between the embedded additional user interface and the game monitoring unit.

With reference to FIGS. 15A and 15B, in one preferred embodiment, a dictionary URL approach is used for translating the data messages into web page information. In this manner, data messages are "looked up" in a dictionary data file where they can be redirected to an attractive URL. The embedded processor 130 responds to requests on the I2C bus that were intended for the prior art enhanced player interface (EPI device) VF display. The web page display screen 120 is not a passive display device like traditional PC monitors, but rather the display screen 120 must respond to commands with text type responses. These requests include initialization requests, status requests, and display requests. With reference to FIG. 16, as each text data message to be displayed is passed into the embedded processor 130, the processor 130 calls a URL Dictionary to look up a URL with which to replace the text data message. Once the substitution is complete, the embedded processor 130 instructs the web page display screen 120 to present (or navigate to) the appropriate web page.

Figure 17:
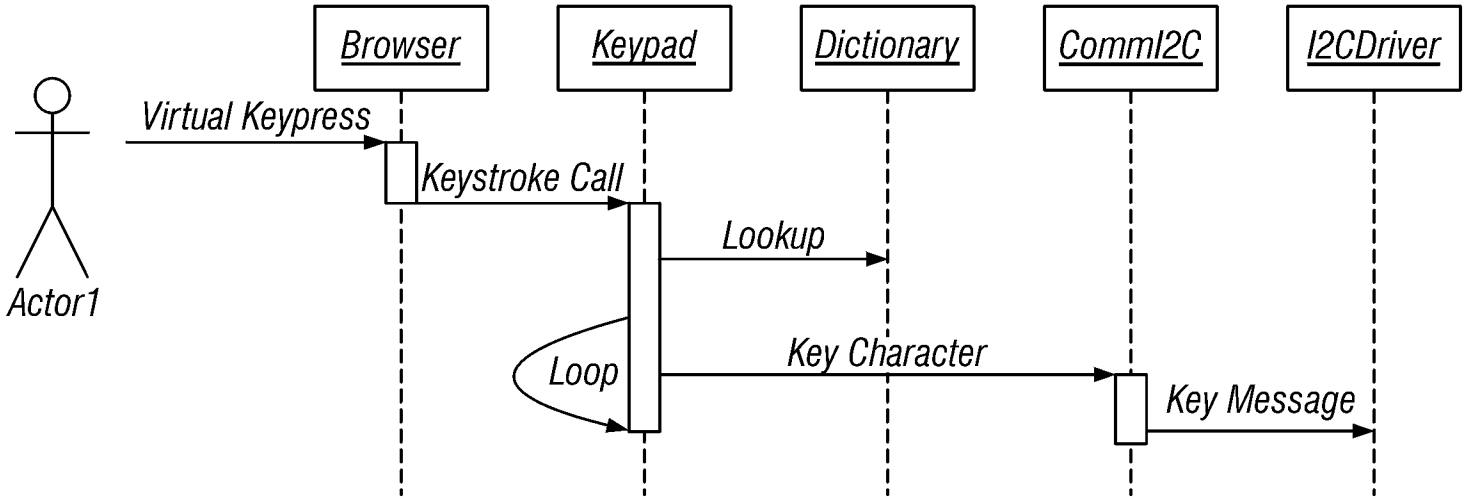
FIG. 17 is a diagram showing the sequence of events that occurs when a virtual key is pressed on the web page display screen.

Accordingly, with reference to FIG. 17, a URL Dictionary component is used to map a text string, sent from the embedded processor 130 and intended for the display on the two-by-twenty VF display, to a URL that can be used to display a much more visually enhanced graphical representation of the same message. Thus, the URL Dictionary component contains a listing of the possible text messages to be supported that could be sent from the embedded processor 130, and a mapping to a set of the desired eye-catching, web content to be displayed on the web page display screen 120. In this event that a message is not in the URL Dictionary, such a message is mapping to a page that substitutes for the two-line mode.

In the preferred embodiments described above, the embedded processor 130 of the embedded additional user interface 100 reads incoming I2C data messages, translates the I2C data messages into a web authoring language (e.g., HTML, DHTML, XML, MACROMEDIA FLASH), and maps the newly translated web page data message to the web page display screen 120. Additionally, the embedded additional user interface 100 can also read incoming data messages that are already in a web authoring language (e.g., HTML, DHTML, XML, MACROMEDIA FLASH), and map this web page data to the web page display screen 120. Further, and highly advantageously, a preferred embodiment also allows casinos that are using the embedded additional user interface 100 to design and use their own content, thereby giving the casinos the ability to decide what the web page presented on the web page display screen 120 of the user interface 100 will look like.

The potential advantages of utilizing the embedded additional user interface 100 are numerous. These potential advantages include, by way of example only, and not by way of limitation; providing animated and/or multimedia web style content, providing fonts and icons which are larger and more aesthetically appealing; providing special services to players, (e.g., multiple languages, assistance for handicapped individuals); facilitating interactive uses of the web page display screen 120; providing the ability to customize the "look and feel" of the web page display screen 120 for players and casino employees; increased player excitement and participation; and simplified replaceability and/or upgradeability from an EPI device or other similar non-web page style components.

Referring now to a preferred embodiment of the progressive processing system 12 as shown in FIGS. 1, 2A-1, 2A-2, 2A-3, 2A-4, and 2B, information utilized by the system to generate a progressive game 10 includes, by way of example only, and not by way of limitation, the following preferred specification parameters: average length of time is in minutes, 15 characters, leading zeros; all amount fields are in whole dollars, 15 characters, leading zeros; progressive game code is generated on the iSERIES, 8 characters; the system PROG.ID is generated by the engine 60, 8 characters; NUMBER OF SLOTS, is generated on the iSERIES, 10 characters, leading zeros, (number of slots included in the promotion); NUMBER CARDED SLOTS, is generated on the iSERIES, 10 characters, leading zeros, (number of slots machines included in a promotion with patron cards inserted) and SEQUENCE NUMBER, generated on the iSERIES, 3 characters, leading zeros.

In one specific preferred embodiment, in order to generate a new promotion progressive game 10 to the progressive processing system 12, the user first creates a new promotion on the iSERIES. Next, the SMS (slot management system) programming detects the new promotion progressive game 10 should be activated, and generates an "ADD TO ENGINE" transaction. Preferably, the transaction is then sent to a data queue SDSM0068. In one preferred embodiment, the ADD transaction written to the data queue contains the following data fields:

| | | | | |
|---|---|---|---|---|
| ADD TO ENGINE, value 001 | TRID001 | A | 01 | 03 |
| AVERAGE WIN AMOUNT | AVG$001 | A | 04 | 18 |
| AVERAGE LENGTH OF TIME, MIN | AVGT001 | A | 19 | 33 |
| SMS MOUNDS-OF-MONEY CODE | PRCD001 | A | 34 | 41 |

-continued

| | | | | |
|---|---|---|---|---|
| MOUNDS-OF-MONEY DESCRIPTION | PRZD001 | A | 42 | 81 |
| STARTING DATE YYYYMMDD | SDHY001 | A | 82 | 89 |
| STARTING TIME HHMMSS | STME001 | A | 90 | 95 |
| RESET AMOUNT | STR$001 | A | 96 | 110 |
| SEQUENCE NUMBER | SEQ#001 | A | 111 | 113 |

In one preferred embodiment, the connection program on the iSERIES reads the data queue and forwards the "ADD TO ENGINE" transaction to the engine 60. When the engine 60 receives the "ADD TO ENGINE" transaction, the engine generates a "PROG.ID CODE', and responds (with the following data) back to the iSERIES. Preferably, the connection program writes the following image to a data queue SDSM0066.

| | | | | |
|---|---|---|---|---|
| ADDED TO ENGINE, value 101 | TRID101 | A | 01 | 03 |
| SMS MOUNDS-OF-MONEY CODE | PRCD101 | A | 04 | 11 |
| ENGINE PROG. ID CODE | PRCL101 | A | 12 | 19 |
| SEQUENCE NUMBER | SEQ#001 | A | 20 | 22 |

In a preferred embodiment, the SMS programming on the iSERIES, reads the data queue SDSM0066 and updates the promotion record as having been added and activated on the engine 60. Additionally, the engine PROG.ID is linked to the new promotion progressive game 10 code.

In one specific preferred embodiment, in order to delete (remove) an existing promotion progressive game 10 on the progressive processing system 12, the user first flags the existing promotion for deletion on the iSERIES. Preferably, the SMS programming then generates a "DELETE FROM ENGINE" transaction and sends this transaction to a data queue SDSM0068. In one preferred embodiment, the DELETE transaction written to the data queue contains the following data fields:

| | | | | |
|---|---|---|---|---|
| DELETE FROM ENGINE, value 002 | TRID002 | A | 01 | 03 |
| SMS MOUNDS-OF-MONEY CODE | PRCD002 | A | 04 | 11 |
| ENGINE PROG.ID CODE | PRCL002 | A | 12 | 19 |
| SEQUENCE NUMBER | SEQ#002 | A | 20 | 22 |

In a preferred embodiment, the connection program on the iSERIES reads the data queue and forwards the "DELETE FROM ENGINE" transaction to the engine 60. When the engine 60 receives the "DELETE FROM ENGINE" transaction, it removes the progressive game 10 from its active progressive games 10 and responds (with the following data) back to the iSERIES. Preferably, the connection program writes the following image to a data queue SDSM0066.

| | | | | |
|---|---|---|---|---|
| DELETED FROM ENGINE, value 102 | TRID102 | A | 01 | 03 |
| SMS MOUNDS-OF-MONEY CODE | PRCD102 | A | 04 | 11 |
| ENGINE PROG. ID CODE | PRCL102 | A | 12 | 19 |
| SEQUENCE NUMBER | SEQ#102 | A | 20 | 22 |

In a preferred embodiment, the number of slots and number of carded slots in a promotion progressive game 10 may require updating. Preferably, the iSERIES SMS programming periodically updates each active promotion game "Number of Assets" and "Number of Carded Assets". Once the iSERIES has been updated, it notifies progressive processing system 12 of the updated values with an "UPDATE NUMBERS" transaction and sends the transaction to a data queue SDSM0068. Preferably, the "UPDATE NUMBERS" transaction written to the data queue contains the following data fields:

| | | | | |
|---|---|---|---|---|
| UPDATE NUMBERS, VALUE 003 | TRID003 | A | 01 | 03 |
| NUMBER OF SLOTS | #AST003 | A | 04 | 13 |
| NUMBER CARDED SLOTS | #CRD003 | A | 14 | 23 |
| ENGINE PROG. ID CODE | PRCL003 | A | 24 | 31 |

In a preferred embodiment, the connection program on the iSERIES reads the data queue and forwards the "UPDATE NUMBERS" transaction to the engine 60. When the engine 60 receives a "UPDATE NUMBERS" for the promotion, it uses these numbers to compute the value of the promotion progressive prize. Preferably, the engine 60 does not need to respond to the "UPDATE NUMBERS" transactions.

In a preferred embodiment, the promotion progressive game 10 may be required to obtain promotional prize values from the engine 60. The iSERIES SMS programming periodically acquires the active promotional progressive prize values for each active promotion progressive prize from the engine 60 using a "GET CURRENT VALUE" transaction, which sends the transaction to a data queue SDSM0068. Preferably, the "GET CURRENT VALUE" transaction written to the data queue contains the following data fields:

| | | | | |
|---|---|---|---|---|
| GET CURRENT VALUE, VALUE 004. | TRID004 | A | 01 | 03 |
| ENGINE PROG. ID CODE | PRCL004 | A | 04 | 11 |

In a preferred embodiment, the connection program on the iSERIES reads the data queue and forwards the "GET CURRENT VALUE" transaction to the engine 60. Preferably, when the engine 60 receives a "GET CURRENT VALUE" transaction for a promotional progressive game, it responds with the following data to the iSERIES. Preferably, the connection program writes the following image to a data queue SDSM0066.

| | | | | |
|---|---|---|---|---|
| RESPONSE CURRENT VALUE, VALUE 104. | TRID104 | A | 01 | 03 |
| ENGINE PROG. ID CODE | PRCL104 | A | 04 | 11 |
| PROG. ID AMOUNT | CUR$104 | A | 12 | 26 |

In a preferred embodiment, the SMS programming on the iSERIES, reads data queue SDSM0066, and updates the promotional progressive prize value with the current cash value from the engine 60.

Referring now to another aspect of a preferred embodiment of the progressive processing system 12, when the engine 60 has determined that it is time for a promotional progressive prize to be awarded, the engine generates a "SELECT WINNER VALUE" transaction. The engine 60 informs the iSERIES of the win event by sending the following transaction to the iSERIES. Preferably, it also stops incrementing the promotional progressive prize's value. In a preferred embodiment, the iSERIES connection program writes the following image to a data queue SDSM0066.

| | | | | |
|---|---|---|---|---|
| SELECT WINNER VALUE, VALUE 105 | TRID105 | A | 01 | 03 |
| ENGINE PROG. ID CODE | PRCL105 | A | 04 | 11 |
| WINNING AMOUNT | CUR$105 | A | 12 | 26 |

In a preferred embodiment, the SMS programming on the iSERIES, reads the data queue SDSM0066, updates the promotional progressive prize's value, and selects a winning patron.

Once the progressive processing system 12 indicates that the criteria has been met for awarding the progressive prize for a promotional progressive game 10, the iSERIES programming selects a winner of the progressive prize. Specifically, the iSERIES programming reads all SMS active slot machine (asset) records from the active assets file (SFPAT) and builds a work file (SFPP7). In one preferred embodiment, the slot machine selection only includes slot machines with: (1) a patron card inserted, (2) where the patron's card type matches the card type(s) assigned to be included in the promotion, (3) where the slot machine's zone on the casino floor matches the zone(s) assigned to be include in the promotion, and (4) where the slot machine's SMS manufacture code matches the manufacture code(s) to be included in the promotion. Preferably, the work file SFPP7 contains the following data:

| | |
|---|---|
| ASSET NUMBER | 5.0 |
| PATRONS ACCOUNT NUMBER | 9 |
| PATRONS ACCOUNT SUFFIX | 2 |
| RATINGS ASSET DENOMINATION | 7.2 |
| RATINGS ASSET DENOMINATION | 1 |
| GEAR-BOX ID | 3.0 |
| RATINGS ASSET LOCATION | 4.0 |
| RATINGS ASSET ZONE | 2 |

In a preferred embodiment, once all included assets records have been written into the work file, the number of included records is known. Preferably, the programming uses a random number program to generate a random number between one and the number of records in the work file SFPP7. In a preferred embodiment, this record contains the winning player's account number, and the slot machine (asset) number. Preferably, the progressive processing system 12 designates this player as the winning player to the promotional progressive game 10. In a preferred embodiment, the system 12 broadcasts transactions to all slot machines on the casino floor announcing the winner, as well as sending a transaction to the slot machine of the winning patron, announcing the selected player as winner.

If no winner selected, the iSERIES programming passes by the "selecting a winner" transactions until the next cycle (e.g., approximately 15 seconds to one minute). Preferably, once the SMS programming on the iSERIES selects a winning player, it notifies the engine 60 of the winner with a "POST WINNER DATA" transaction, and sends the transaction to a data queue SDSM0068. In a preferred embodiment, the "POST WINNER DATA" transaction written to the data queue contains the following data fields:

| | | | | |
|---|---|---|---|---|
| POST WINNER DATA, VALUE 005 | TRID005 | A | 01 | 03 |
| ENGINE PROG. ID CODE | PRCL005 | A | 04 | 11 |
| WINNERS NAME | NAME005 | A | 12 | 41 |
| WINNERS CITY | CITY005 | A | 42 | 71 |
| WINNERS STATE/COUNTRY | STAT005 | A | 72 | 101 |

In a preferred embodiment, the connection program on the iSERIES reads the data queue and forwards the "POST WINNER DATA" transaction to the engine 60. When the engine 60 receives the "POST WINNER DATA" transaction, it transmits the winning patron data to any signage connected thereto. Preferably, the engine 60 does not need to respond to the POST WINNER transaction.

Although the disclosed embodiments have been described in language specific to computer structural features, methodological acts, and by computer readable media, it is to be understood that the disclosed embodiments defined in the appended claims are not necessarily limited to the specific structures, acts, or media described. Therefore, the specific structural features, acts and media are disclosed as exemplary embodiments.

Furthermore, the various embodiments described above are provided by way of illustration only and should not be construed to limit the invention. Those skilled in the art will readily recognize various modifications and changes that may be made to the disclosed embodiments without following the example embodiments and applications illustrated and described herein, and without departing from the true spirit and scope of the disclosed embodiments, which is set forth in the following claims.

What is claimed is:

1. A non-transitory storage medium having stored thereon a progressive game program to implement a progressive game on a gaming system, wherein the gaming system includes one or more gaming machines connected to a server, and wherein the progressive game has a progressive prize with a progressive prize value that increases according to a progressive prize growth rate, the progressive game program upon execution on the gaming system providing execution of the progressive game comprising:

a selectable targeted progressive prize value;

a selectable targeted progressive prize time which is a theoretical average time when the progressive prize is awarded;

an erratic movement enticement factor, wherein the erratic movement enticement factor contributes erratic motion to the progressive prize growth rate that causes the progressive growth rate to erratically increase and decrease in a +/−5% range, wherein the progressive prize growth rate is determined using the selectable targeted progressive prize value, the selectable targeted progressive prize time, and the erratic movement enticement factor; and wherein if a progressive prize win has not been identified, the progressive prize value is incremented by the progressive prize growth rate; and wherein if a progressive prize win has been identified, one or more winners of the progressive prize are determined.

2. The progressive game of claim 1, wherein the progressive prize growth rate is determined by referencing a table of values.

3. The progressive game of claim 1, wherein the progressive prize growth rate is determined by referencing a formula.

4. The progressive game of claim 1, wherein the one or more winners of the progressive prize are determined using a random number generation algorithm.

5. The progressive game of claim 1, wherein the one or more winners of the progressive prize are determined using predetermined selection criteria.

6. The progressive game of claim 1, wherein the one or more enticement factors are selected from a group consisting of:

a player activity enticement factor, a number of eligible players enticement factor, an erratic movement enticement factor, and a casino revenue factor;

wherein the player activity enticement factor partially associates player floor activity to the progressive prize growth rate, wherein the number of eligible players enticement factor associates the number of eligible players on a gaming floor to the progressive prize growth rate, wherein the erratic movement enticement factor contributes randomized motion to the progressive prize growth rate, and wherein the casino revenue factor enables self-tuning of the progressive game to facilitate achieving a desired casino profitability level.

7. The progressive game of claim 1, wherein an enticement factor is derived from third party revenue data.

8. The progressive game of claim 1, wherein the progressive prize is funded from non-wagered funds.

9. The progressive game of claim 8, wherein the non-wagered funds include funds designed to correlate with data selected from the group consisting of: data relating to the number of eligible participants, loss data from related base games, coin out data from related base games, other statistical data from related base games, and data derived from related base game data, data derived from combinations of related base game data, and data derived from mathematical manipulations of related base game data.

10. The progressive game of claim 8, wherein the non-wagered funds originate from marketing funds.

11. The progressive game of claim 8, wherein the non-wagered funds originate from promotions department funds.

12. The progressive game of claim 1, wherein the progressive prize is available to all players having a player tracking card inserted into a gaming machine that is part of the gaming system.

13. The progressive game of claim 1, wherein the progressive prize is available to all players playing at a gaming machine that fulfills predetermined selection criteria.

14. The progressive game of claim 1, wherein the progressive prize is awarded randomly to one or more players having a player tracking card inserted into a gaming machine that is part of the gaming system.

15. The progressive game of claim 1, wherein the progressive prize can be awarded from a beginning of the progressive game.

16. The progressive game of claim 1, wherein the progressive game requires no player interaction during the progressive game.

17. The progressive game of claim 1, wherein the progressive prize is available to all players that are dynamically grouped in accordance with any identifiable gaming machine parameter.

18. The progressive game of claim 1, wherein the progressive game is displayed on a user interface that is additional to a primary game presentation of a gaming machine in the gaming system.

19. The progressive game of claim 1, wherein the progressive game is operatively associated with a player tracking device.

20. The progressive game of claim 1, wherein the progressive game is player-selected from a plurality of available progressive games.

21. The progressive game of claim 1, wherein a carded player is eligible to win a progressive prize, even if the carded player is not present when the progressive prize is given, by meeting predetermined eligibility criteria.

22. The progressive game of claim 1, wherein a payout curve is displayed to a casino administrator, and wherein the payout curve is the progressive prize value plotted against the progressive prize time.

23. The progressive game of claim 22, wherein the payout curve includes points along the payout curve and an alterable shape, and wherein points along the payout curve are selectable and dragable by a game administrator to modify the shape of the payout curve, thereby correspondingly altering intersection points of the progressive prize value with the progressive prize time along the payout curve.

24. The progressive game of claim 22, wherein a graphical user interface enables a game administrator to modify the shape of the payout curve, by selecting and dragging points along the payout curve to modify the shape of the payout curve.

25. The progressive game of claim 22, wherein the payout curve is plotted using data points that are manually entered from an administrator.

26. The progressive game of claim 22, wherein the payout curve is modifiable during the progressive game.

27. The progressive game of claim 22, wherein the payout curve for the progressive prize is a non-linear growth curve.

28. The progressive game of claim 22, wherein the payout curve is a front-loaded payout curve.

29. A progressive gaming method implemented on a gaming system, wherein the gaming system includes one or more gaming machines connected to a server, and wherein the progressive gaming method has a progressive prize with a progressive prize value that increases according to a progressive prize growth rate until a winning time period occurs, the progressive gaming method comprising:

receiving a selectable targeted progressive prize value;

receiving a selectable targeted progressive prize time which is a theoretical average time when the progressive prize is awarded;

calculating the progressive prize growth rate using the selectable targeted progressive prize value, the selectable targeted progressive prize time, and an erratic movement enticement factor, wherein the erratic movement enticement factor contributes erratic motion to the progressive prize growth rate that causes the progressive growth rate to erratically increase and decrease in a +/−5% range, and wherein the progressive prize growth rate is funded from non-wagered funds;

determining if there is a progressive prize win at each calculated time period, wherein the selectable targeted progressive prize time is used to calculate the time period for testing for a progressive prize win;

if a progressive prize win has not been identified, incrementing the progressive prize value by the progressive prize growth rate; and if a progressive prize win has been identified, determining one or more winners of the progressive prize.

30. The progressive gaming method of claim 29, wherein a winner of the progressive prize is selected from the group consisting of: a player, a player account, a gaming machine, a game monitoring unit, and a gaming device.

31. The progressive gaming method of claim 29, wherein the progressive prize is partitioned between a plurality of winning players.

32. The progressive gaming method of claim 29, wherein the entire progressive prize value is given to all eligible winning players.

33. The progressive gaming method of claim 29, wherein a first randomly chosen winner receives the entire progressive prize value, and secondary winners receive a portion of the progressive prize value.

34. The progressive gaming method of claim 29, wherein a first randomly chosen winner receives the entire progressive prize value, and secondary winners receive a fixed value prize.

35. The progressive gaming method of claim 29, wherein calculating the progressive prize growth rate comprises:

calculating the progressive prize growth rate from a formula using the selectable targeted progressive prize value, the selectable targeted progressive prize time, and the one or more enticement factors.

36. The progressive gaming method of claim 29, wherein calculating the progressive prize growth rate comprises:

calculating the progressive prize growth rate from a table and interpolating the growth rate using the selectable targeted progressive prize value, the selectable targeted progressive prize time, and the one or more enticement factors.

37. The progressive gaming method of claim 29, wherein determining one or more winners of the progressive prize comprises:

activating a random number generation algorithm to determine one or more winners of the progressive prize.

38. The progressive gaming method of claim 29, wherein the one or more enticement factors are selected from a group consisting of: a player activity enticement factor, a number of eligible players enticement factor, and an erratic movement enticement factor, wherein the player activity enticement factor partially associates player floor activity to the progressive prize growth rate, wherein the number of eligible players enticement factor associates the number of eligible players on a gaming floor to the progressive prize growth rate, and wherein the erratic movement enticement factor contributes erratic motion to the progressive prize growth rate.

39. The progressive gaming method of claim 29, wherein the non-wagered funds include funds designed to correlate with data selected from the group consisting of: data relating to the number of eligible participants, loss data from related base games, coin out data from related base games, other statistical data from related base games, and data derived from related base game data, data derived from combinations of related base game data, and data derived from mathematical manipulations of related base game data.

40. The progressive gaming method of claim 29, wherein the progressive prize is available to all players having a player tracking card inserted into a gaming machine that is part of the gaming system.

41. The progressive gaming method of claim 29, wherein the progressive prize is awarded randomly to one or more identified eligible players.

42. The progressive gaming method of claim 29, wherein identified eligible players comprise players selected from a group consisting of: players having a player tracking card inserted into a gaming machine that is part of the gaming system, and players that are logged on to the gaming system.

43. The progressive gaming method of claim 29, wherein players that are logged on to the gaming system comprise players with username and password accounts, players with player card accounts, players with other unique identifiers to their accounts.

44. The progressive gaming method of claim 29, wherein the progressive prize can be awarded at a beginning of the progressive gaming method.

45. The progressive gaming method of claim 29, wherein the progressive gaming method requires no player interaction during the progressive gaming method.

46. The progressive gaming method of claim 29, wherein the progressive prize is available to all players that are dynamically grouped in accordance with any identifiable gaming machine parameter.

47. The progressive gaming method of claim 29, wherein the progressive gaming method is displayed on a user interface that is additional to a primary game presentation of a gaming machine in the gaming system.

48. The progressive gaming method of claim 29, wherein the progressive gaming method is displayed on any user interface of a gaming machine in the gaming system.

49. The progressive gaming method of claim 29, wherein the progressive gaming method is player-selected from a plurality of eligible progressive gaming methods.

50. The progressive gaming method of claim 29, wherein a payout curve is displayed to a casino administrator, and wherein the payout curve is the progressive prize value plotted against the progressive prize time.

51. The progressive gaming method of claim 50, wherein the payout curve includes points along the payout curve and an alterable shape, and wherein points along the payout curve are selectable and dragable by a game administrator to modify the shape of the payout curve, thereby correspondingly altering intersection points of the progressive prize value with progressive prize time along the payout curve.

52. The progressive gaming method of claim 50, wherein a graphical user interface enables a game administrator to modify the shape of the payout curve, by selecting and dragging points along the payout curve to modify the shape of the payout curve.

53. The progressive gaming method of claim 50, wherein the payout curve is modifiable during the progressive game.

54. The progressive gaming method of claim 50, wherein the payout curve for the progressive prize is a non-linear growth curve.

55. The progressive gaming method of claim 50, wherein the payout curve is a front-loaded payout curve.

56. A non-transitory storage medium having stored thereon a progressive game program to implement a progressive game on a gaming system, wherein the gaming system includes one or more gaming machines connected to a server, and wherein the progressive game has a progressive prize with a progressive prize value that increases according to a progressive prize growth rate, the progressive game program upon execution on the gaming system providing execution of the progressive game comprising:

a selectable targeted progressive prize value;

a selectable targeted progressive prize time which is a theoretical average time when the progressive prize is awarded;

an erratic movement enticement factor, wherein the erratic movement enticement factor contributes erratic motion to the progressive prize growth rate that causes the progressive growth rate to erratically increase and decrease in a +/−10% range, wherein the progressive prize growth rate is determined using the selectable targeted progressive prize value, the selectable targeted progressive prize time, and the erratic movement enticement factor; and wherein if a progressive prize win has not been identified, the progressive prize value is incremented by the progressive prize growth rate; and wherein if a progressive prize win has been identified, one or more winners of the progressive prize are determined.

57. The progressive game of claim 56, wherein winning the progressive prize triggers additional events or promotions.

58. The progressive game of claim 56, wherein the progressive prize growth rate is determined by referencing a table of values.

59. The progressive game of claim 56, wherein the one or more winners of the progressive prize are determined using a random number generation algorithm.

60. The progressive game of claim 56, wherein the one or more winners of the progressive prize are determined using predetermined selection criteria.

61. The progressive game of claim 56, wherein the time period, which is successively used to determine if a progressive prize has been won, is manually entered by a casino administrator.

62. The progressive game of claim 56, wherein the incremental progressive rate is successively incremented using a different time period than the time period used to test if there is a progressive prize win.

63. A progressive gaming method implemented on a gaming system, wherein the gaming system includes one or more gaming machines connected to a server, and wherein the progressive gaming method has a progressive prize with a progressive prize value that increases according to a progressive prize growth rate until a winning time period occurs, the progressive gaming method comprising:

receiving a selectable targeted progressive prize value;

receiving a selectable targeted progressive prize time which is a theoretical average time when the progressive prize is awarded;

calculating the progressive prize growth rate using the selectable targeted progressive prize value, the selectable targeted progressive prize time, and an erratic movement enticement factor, wherein the erratic movement enticement factor contributes erratic motion to the progressive prize growth rate that causes the progressive growth rate to erratically increase and decrease in a +/−10% range, and wherein the progressive prize growth rate is funded from non-wagered funds;

determining if there is a progressive prize win at each calculated time period, wherein the selectable targeted progressive prize time is used to calculate the time period for testing for a progressive prize win;

if a progressive prize win has not been identified, incrementing the progressive prize value by the progressive prize growth rate; and if a progressive prize win has been identified, determining one or more winners of the progressive prize.

64. The progressive gaming method of claim 63, wherein winning the progressive prize triggers additional events or promotions.

65. The progressive gaming method of claim 63, wherein determining one or more winners of the progressive prize comprises:

activating a random number generation algorithm to determine one or more winners of the progressive prize.

66. The progressive gaming method of claim 63, wherein the award process includes payment techniques selected from the group consisting of: hand-paying a winner; using EFT to transfer the award to a base game upon a player selecting to redeem the award at the base game; using AFT to transfer the award to a base game upon a player selecting to redeem the award at the base game; sending the award to a player account bucket; enabling the award to be collected at a cashier cage; mailing the award to the winner; placing the award in the player's private banking account; and placing the award as a credit on the player's credit card, debit card, player club account, or other financial account.

67. The progressive gaming method of claim 63, wherein the awarding of the progressive prize is performed automatically without requiring player interaction.

68. A non-transitory storage medium having stored thereon a progressive game program to implement a progressive game on a gaming system, wherein the gaming system includes one or more gaming machines connected to a server, and wherein the progressive game has a progressive prize with a progressive prize value that increases according to a progressive prize growth rate, the progressive game program upon execution on the gaming system providing execution of the progressive game comprising:

a selectable targeted progressive prize value;

a selectable targeted progressive prize time which is a theoretical average time when the progressive prize is awarded;

an erratic movement enticement factor, wherein the erratic movement enticement factor contributes erratic motion to the progressive prize growth rate that causes the progressive growth rate to erratically increase and decrease in a +/−15% range, wherein the progressive prize growth rate is determined using the selectable targeted progressive prize value, the selectable targeted progressive prize time, and the erratic movement enticement factor; and wherein if a progressive prize win has not been identified, the progressive prize value is incremented by the progressive prize growth rate; and wherein if a progressive prize win has been identified, one or more winners of the progressive prize are determined.

69. The progressive processing system of claim 68, wherein the progressive processing system comprises a system for providing an opportunity to win a non-gaming promotional award.

70. The progressive processing system of claim 69, wherein the opportunity to win the non-gaming promotional award is presented at a business that is selected from a group consisting of: kiosks, gas station chains, toll stations, bus stations, subway stations, restaurants, grocery stores, Internet-based web businesses, government agencies, and businesses regulated by government agencies.

71. The progressive processing system of claim 68, wherein the progressive processing system comprises a system that provides opportunities to win multiple overlapping, promotional awards.

72. The progressive processing system of claim 71, wherein the opportunities to win multiple overlapping, promotional awards are assigned by groups of games, groups of machines, groups of players, or combinations thereof.

73. The progressive processing system of claim 68, further comprising overhead video displays that show data selected from the group consisting of: current progressive values, targeted progressive size, targeted win time, start time, actual winners, information revealing that a progressive prize is about to be given, player qualification rules, or combinations thereof.

74. The progressive processing system of claim 73, wherein the overhead video displays comprise plasma displays, liquid crystal displays, cathode ray tube displays, or digital light processing displays.

75. The progressive processing system of claim 68, wherein the algorithm that tests to determine if there is a progressive prize win is configured to prevent a progressive prize win during certain time periods.

76. The progressive processing system of claim 68, wherein the opportunity to win a progressive prize can be turned off by an administrator at any time.

77. The progressive processing system of claim 68, further comprising a progressive identifier that enables the opportunity to win a progressive prize to be activated from a remote server.

78. The progressive processing system of claim 77, wherein the progressive identifier is created using required data that is supplied through XML messaging or by using a management screen.

79. The progressive processing system of claim 77, wherein the progressive identifier is created using required data that is supplied through non-XML messaging.

80. The progressive processing system of claim 78, wherein the required data for the progressive identifier includes: desired progressive value data, desire progressive win time data, progressive reset value data, maximum progressive value data, desired start time of the progressive data, whether the progressive auto-restarts after a win, how many times the progressive repeats, whether any enticement factors are utilized, and progressive payout curve data.

81. The progressive processing system of claim 80, wherein additional data for the progressive identifier is selected from the group consisting of: maximum progressive prize value data, desired start time of the progressive data, selectable progressive auto-restarts after a win, selectable number of progressive repeats, enticement factors data, and progressive payout curve data.

82. The progressive processing system of claim 68, wherein the progressive processing system provides an automatically recurring opportunity to win a progressive prize.

83. The progressive processing system of claim 68, wherein the progressive processing system comprises a system that provides an opportunity to randomly win a promotional award at any time an eligible person is at a gaming machine.

84. The progressive processing system of claim 68, wherein the one or more winners of the progressive prize receive the award by having the award reverse mapped into a specific winning combination on each game machine at which the one or more winners are playing; thereby creating a player perception that the specific winning combination on each gaming machine caused presentation of the progressive prize.

85. The progressive processing system of claim 84, wherein the specific winning combination is selected from a group consisting of: a royal flush, four-of-a-kind, full house, flush in a video poker game, a blackjack in video blackjack game, a multiple jackpot symbol in a reel spinner game, a marked bingo card, a marked keno card, a winning raffle ticket, and a winning sweepstakes ticket.

86. The progressive processing system of claim 85, wherein a base game is instructed to go into a bonus round in which the progressive prize is awardable.

87. A progressive gaming method implemented on a gaming system, wherein the gaming system includes one or more gaming machines connected to a server, and wherein the progressive gaming method has a progressive prize with a progressive prize value that increases according to a progressive prize growth rate until a winning time period occurs, the progressive gaming method comprising:

receiving a selectable targeted progressive prize value;

receiving a selectable targeted progressive prize time which is a theoretical average time when the progressive prize is awarded;

calculating the progressive prize growth rate using the selectable targeted progressive prize value, the selectable targeted progressive prize time, and an erratic movement enticement factor, wherein the erratic movement enticement factor contributes erratic motion to the progressive prize growth rate that causes the progressive growth rate to erratically increase and decrease in a +/−15% range, and wherein the progressive prize growth rate is funded from non-wagered funds;

determining if there is a progressive prize win at each calculated time period, wherein the selectable targeted progressive prize time is used to calculate the time period for testing for a progressive prize win;

if a progressive prize win has not been identified, incrementing the progressive prize value by the progressive prize growth rate; and if a progressive prize win has been identified, determining one or more winners of the progressive prize.

88. The progressive processing method of claim 87, wherein the progressive processing method is automatically restarted after a progressive prize is awarded.

89. The progressive processing method of claim 88, wherein a time delay is inserted between the automatic restarting of the progressive processing method.

90. The progressive processing method of claim 87, wherein the progressive processing method comprises a method for providing an opportunity to win a non-gaming promotional award.

91. The progressive processing method of claim 90, wherein the opportunity to win the non-gaming promotional award is presented at a business that is selected from a group consisting of: gas station chains, toll stations, bus stations, subway stations, restaurants, grocery stores, and Internet-based web businesses.

92. The progressive processing method of claim 87, wherein the progressive processing method comprises providing opportunities to win multiple overlapping, promotional awards.

93. The progressive processing method of claim 92, wherein the opportunities to win multiple overlapping, promotional awards are assigned by groups of games, groups of machines, groups of players, or combinations thereof.

94. The progressive processing method of claim 92, further comprising providing overhead video displays that show the current progressive values, targeted progressive size, targeted win time, start time, actual winners, information revealing that a progressive prize is about to be given, player qualification rules, or combinations thereof.

95. The progressive processing method of claim 94, wherein the overhead video displays comprise plasma display interfaces.

96. The progressive processing method of claim 92, wherein the algorithm that tests to determine if there is a progressive prize win is configured to prevent a progressive prize win during certain time periods.

97. The progressive processing method of claim 92, wherein the opportunity to win a progressive prize can be turned off by an administrator at any time.

98. The progressive processing method of claim 92, further comprising creating a progressive identifier that enables the opportunity to win a progressive prize to be activated from a remote server.

99. The progressive processing method of claim 98, wherein the progressive identifier is created using required data that is supplied through XML messaging or by using a management screen.

100. The progressive processing method of claim 99, wherein the required data for the progressive identifier includes: desired progressive value data, desired progressive win time data, progressive reset value data, maximum progressive value data, desired start time of the progressive data, whether the progressive auto-restarts after a win, how many times the progressive repeats, whether any enticement factors are utilized, and progressive payout curve data.

101. The progressive processing method of claim 92, wherein the one or more winners of the progressive prize receive the award by having the award reverse mapped into a specific winning combination on each game machine at which the one or more winners are playing; thereby creating a player perception that the specific winning combination on each gaming machine caused presentation of the progressive prize.

102. The progressive processing system of claim 101, wherein a specific win is selected from a group consisting of: a royal flush, four-of-a-kind, full house, flush in a video poker game, a blackjack in video blackjack game, and a triple jackpot symbol in a reel spinner game.

103. A progressive prize processing system, the system comprising:

one or more gaming machines connected to a server;

a first server software module, wherein the first server software module increments a progressive prize over a configurable bonus time period, which is a theoretical average time when the progressive prize is awarded, from an initial progressive value towards a targeted progressive value, wherein an erratic movement enticement factor contributes erratic motion to the progressive prize growth rate that causes the progressive growth rate to erratically increase and decrease in a +/−5% range, wherein the first server software module determines a winning time by testing for the winning time at multiple time intervals during the configurable bonus time period; and a second server software module, wherein the second server software module determines one or more winners of the progressive prize, wherein the first server software module sends a current progressive value to the second server software module when the winning time has been identified, and wherein the second server software module initiates distribution of the progressive prize to the one or more winners.

104. A casino based progressive prize system for providing a progressive prize when a winning time occurs, the system comprising:

one or more gaming machines connected to a server;

a server side progressive software module, wherein the server side progressive software module increments a current progressive prize value over a configurable bonus time period, which is a theoretical average time when the progressive prize is awarded, from an initial progressive prize value, wherein an erratic movement enticement factor contributes erratic motion to the progressive prize growth rate that causes the progressive growth rate to erratically increase and decrease in a +/−5% range, and wherein the server side progressive software module determines a winning time during the configurable bonus time period; and a user interface in connection with a gaming device, wherein the current progressive prize value is displayable on the user interface at some point during the bonus time period;

wherein the progressive prize value incrementing is stopped when the winning time is determined, wherein a final progressive value is determined by the server side progressive software module when the winning time slice is determined.

* * * * *

UNITED STATES PATENT AND TRADEMARK OFFICE

CERTIFICATE OF CORRECTION

PATENT NO. : 8,734,239 B2
APPLICATION NO. : 13/728923
DATED : May 27, 2014
INVENTOR(S) : Bryan M. Kelly et al.

It is certified that error appears in the above-identified patent and that said Letters Patent is hereby corrected as shown below:

In the Specification

Column 4, In line 6, replace “of” with --or--

Column 4, In line 47, replace “is” with --are--

Column 13, In line 58, add --S-- to “DRAWING”

Column 14, In line 4, add --S-- to “FIG”

Column 14, In line 18, delete “s” from “transfers”

Column 20, In line 41, replace “anyway” with --any way--

Column 21, In line 2, before “the progressive” delete “the by”

Column 26, In line 52, replace “+a” with --+ a--

Column 27, In line 5, replace “vale” with --value--

Column 30, In line 29, after “of” delete “a”

Column 30, In line 33, delete “s” from “receives” in both instances

Column 30, In line 34, delete “s” from “receives”

Column 30, In line 40, replace “deceasing” with --decreasing--

Column 36, In line 40, insert --to-- before “be”

Column 36, In line 43, replace “that” with --than--

Column 47, In line 32, delete “s” from “assets”

Signed and Sealed this
Fourteenth Day of October, 2014

Michelle K. Lee

Michelle K. Lee
*Deputy Director of the United States Patent and Trademark Office*